US010217467B2

(12) United States Patent
Chebiyyam et al.

(10) Patent No.: US 10,217,467 B2
(45) Date of Patent: Feb. 26, 2019

(54) ENCODING AND DECODING OF INTERCHANNEL PHASE DIFFERENCES BETWEEN AUDIO SIGNALS

(71) Applicant: QUALCOMM Incorporated, San Diego, CA (US)

(72) Inventors: Venkata Subrahmanyam Chandra Sekhar Chebiyyam, San Diego, CA (US); Venkatraman Atti, San Diego, CA (US)

(73) Assignee: Qualcomm Incorporated

( * ) Notice: Subject to any disclaimer, the term of this patent is extended or adjusted under 35 U.S.C. 154(b) by 0 days.

(21) Appl. No.: 15/620,695

(22) Filed: Jun. 12, 2017

(65) Prior Publication Data

US 2017/0365260 A1 Dec. 21, 2017

Related U.S. Application Data

(60) Provisional application No. 62/352,481, filed on Jun. 20, 2016.

(51) Int. Cl.
*H04R 5/00* (2006.01)
*G10L 19/008* (2013.01)
(Continued)

(52) U.S. Cl.
CPC ..... *G10L 19/008* (2013.01); *G10L 19/167* (2013.01); *G10L 19/22* (2013.01); *G10L 19/002* (2013.01)

(58) Field of Classification Search
CPC ..... G10L 19/008; G10L 19/167; G10L 19/22; G10L 19/002
(Continued)

(56) References Cited

U.S. PATENT DOCUMENTS 8,620,672 B2 12/2013 Visser et al.
9,275,646 B2 3/2016 Lang et al.
(Continued)

FOREIGN PATENT DOCUMENTS

CN 104681029 A 6/2015
EP 3057095 A1 8/2016

OTHER PUBLICATIONS

Lindblom J et al: "Flexible sum-difference stereo coding based on time-aligned signal components", Applications of Signal Processing to Audio and Acoustics, 2005. IEEE Workshop on New Paltz, NY, USA Oct. 16-19, 2005, Piscataway, NJ, USA, IEEE, Oct. 16, 2005 (Oct. 16, 2005), pp. 255-258.*
(Continued)

*Primary Examiner* — Vivian Chin
*Assistant Examiner* — Ammar Hamid
(74) *Attorney, Agent, or Firm* — Toler Law Group, P.C.

(57) ABSTRACT

A device for processing audio signals includes an interchannel temporal mismatch analyzer, an interchannel phase difference (IPD) mode selector and an IPD estimator. The interchannel temporal mismatch analyzer is configured to determine an interchannel temporal mismatch value indicative of a temporal misalignment between a first audio signal and a second audio signal. The IPD mode selector is configured to select an IPD mode based on at least the interchannel temporal mismatch value. The IPD estimator is configured to determine IPD values based on the first audio signal and the second audio signal. The IPD values have a resolution corresponding to the selected IPD mode.

31 Claims, 12 Drawing Sheets

(51) Int. Cl.
*G10L 19/22* (2013.01)
*G10L 19/16* (2013.01)
*G10L 19/002* (2013.01)

(58) Field of Classification Search
USPC ..... 381/22
See application file for complete search history.

(56) References Cited

U.S. PATENT DOCUMENTS

2005/0159942 A1 7/2005 Singhal
2010/0085102 A1 4/2010 Lee et al.
2011/0044457 A1* 2/2011 Seo ..... G10L 19/008 381/22
2013/0230176 A1 9/2013 Virette et al.
2014/0112482 A1* 4/2014 Virette ..... G10L 19/008 381/23
2016/0133262 A1* 5/2016 Fueg ..... G10L 19/008 381/22

OTHER PUBLICATIONS

International Search Report and Written Opinion—PCT/US2017/037198—ISA/EPO—dated Oct. 6, 2017.
ITU-T, "7kHz Audio-Coding within 64 kbit/s: New Annex D with stereo embedded extension", ITU-T Draft; Study Period 2009-2012, International Telecommunications Union, Geneva; CH, vol. 10/16, May 8, 2012 (May 8, 2012), XP044050906, pp. 1-52.
Lindblom J., et al., "Flexible Sum-Difference Stereo Coding based on Time-Aligned Signal Components", Applications of Signal Processing to Audio and Acoustics, IEEE Workshop on New Paltz, NY, USA, Oct. 16-19, 2005 (Oct. 16, 2005), XP010854377, pp. 255-258.

* cited by examiner

ENCODING AND DECODING OF INTERCHANNEL PHASE DIFFERENCES BETWEEN AUDIO SIGNALS

I. CROSS-REFERENCE TO RELATED APPLICATIONS

The present application claims priority from U.S. Provisional Patent Application No. 62/352,481 entitled "ENCODING AND DECODING OF INTERCHANNEL PHASE DIFFERENCES BETWEEN AUDIO SIGNALS," filed Jun. 20, 2016, the contents of which are incorporated by reference herein in their entirety.

II. FIELD

The present disclosure is generally related to encoding and decoding of interchannel phase differences between audio signals.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

In some examples, computing devices may include encoders and decoders that are used during communication of media data, such as audio data. To illustrate, a computing device may include an encoder that generates a downmixed audio signals (e.g., a mid-band signal and a side-band signal) based on a plurality of audio signals. The encoder may generate an audio bitstream based on the downmixed audio signals and encoding parameters.

The encoder may have a limited number of bits to encode the audio bitstream. Depending on the characteristics of audio data being encoded, certain encoding parameters may have a greater impact on audio quality than other encoding parameters. Moreover, some encoding parameters may "overlap," in which case it may be sufficient to encode one parameter while omitting the other parameter(s). Thus, although it may be beneficial to allocate more bits to the parameters that have a greater impact on audio quality, identifying those parameters may be complex.

IV. SUMMARY

In a particular implementation, a device for processing audio signals includes an interchannel temporal mismatch analyzer, an interchannel phase difference (IPD) mode selector, and an IPD estimator. The interchannel temporal mismatch analyzer is configured to determine an interchannel temporal mismatch value indicative of a temporal misalignment between a first audio signal and a second audio signal. The IPD mode selector is configured to select an IPD mode based on at least the interchannel temporal mismatch value. The IPD estimator is configured to determine IPD values based on the first audio signal and the second audio signal. The IPD values have a resolution corresponding to the selected IPD mode.

In another particular implementation, a device for processing audio signals includes an interchannel phase difference (IPD) mode analyzer and an IPD analyzer. The IPD mode analyzer is configured to determine an IPD mode. The IPD analyzer is configured to extract IPD values from a stereo-cues bitstream based on a resolution associated with the IPD mode. The stereo-cues bitstream is associated with a mid-band bitstream corresponding to a first audio signal and a second audio signal.

In another particular implementation, a device for processing audio signals includes a receiver, an IPD mode analyzer, and an IPD analyzer. The receiver is configured to receive a stereo-cues bitstream associated with a mid-band bitstream corresponding to a first audio signal and a second audio signal. The stereo-cues bitstream indicates an interchannel temporal mismatch value and interchannel phase difference (IPD) values. The IPD mode analyzer is configured to determine an IPD mode based on the interchannel temporal mismatch value. The IPD analyzer is configured to determine the IPD values based at least in part on a resolution associated with the IPD mode.

In another particular implementation, a device for processing audio signals includes an interchannel temporal mismatch analyzer, an interchannel phase difference (IPD) mode selector, and an IPD estimator. The interchannel temporal mismatch analyzer is configured to determine an interchannel temporal mismatch value indicative of a temporal misalignment between a first audio signal and a second audio signal. The IPD mode selector is configured to select an IPD mode based on at least the interchannel temporal mismatch value. The IPD estimator is configured to determine IPD values based on the first audio signal and the second audio signal. The IPD values have a resolution corresponding to the selected IPD mode. In another particular implementation, a device includes an IPD mode selector, an IPD estimator, and a mid-band signal generator. The IPD mode selector is configured to select an IPD mode associated with a first frame of a frequency-domain mid-band signal based at least in part on a coder type associated with a previous frame of the frequency-domain mid-band signal. The IPD estimator is configured to determine IPD values based on a first audio signal and a second audio signal. The IPD values have a resolution corresponding to the selected IPD mode. The mid-band signal generator is configured to generate the first frame of the frequency-domain mid-band signal based on the first audio signal, the second audio signal, and the IPD values.

In another particular implementation, a device for processing audio signals includes a downmixer, a pre-processor, an IPD mode selector, and an IPD estimator. The downmixer is configured to generate an estimated mid-band signal based on a first audio signal and a second audio signal. The pre-processor is configured to determine a predicted coder type based on the estimated mid-band signal. The IPD mode selector is configured to select an IPD mode based at least in part on the predicted coder type. The IPD estimator is configured to determine IPD values based on the first audio signal and the second audio signal. The IPD values have a resolution corresponding to the selected IPD mode.

In another particular implementation, a device for processing audio signals includes an IPD mode selector, an IPD estimator, and a mid-band signal generator. The IPD mode selector is configured to select an IPD mode associated with a first frame of a frequency-domain mid-band signal based at least in part on a core type associated with a previous frame of the frequency-domain mid-band signal. The IPD estimator is configured to determine IPD values based on a first audio signal and a second audio signal. The IPD values have a resolution corresponding to the selected IPD mode. The mid-band signal generator is configured to generate the first frame of the frequency-domain mid-band signal based on the first audio signal, the second audio signal, and the IPD values.

In another particular implementation, a device for processing audio signals includes a downmixer, a pre-processor, an IPD mode selector, and an IPD estimator. The downmixer is configured to generate an estimated mid-band signal based on a first audio signal and a second audio signal. The pre-processor is configured to determine a predicted core type based on the estimated mid-band signal. The IPD mode selector is configured to select an IPD mode based on the predicted core type. The IPD estimator is configured to determine IPD values based on the first audio signal and the second audio signal. The IPD values have a resolution corresponding to the selected IPD mode.

In another particular implementation, a device for processing audio signals includes a speech/music classifier, an IPD mode selector, and an IPD estimator. The speech/music classifier is configured to determine a speech/music decision parameter based on a first audio signal, a second audio signal, or both. The IPD mode selector is configured to select an IPD mode based at least in part on the speech/music decision parameter. The IPD estimator is configured to determine IPD values based on the first audio signal and the second audio signal. The IPD values have a resolution corresponding to the selected IPD mode.

In another particular implementation, a device for processing audio signals includes a low-band (LB) analyzer, an IPD mode selector, and an IPD estimator. The LB analyzer is configured to determine one or more LB characteristics, such as a core sample rate (e.g., 12.8 kilohertz (kHz) or 16 kHz), based on a first audio signal, a second audio signal, or both. The IPD mode selector is configured to select an IPD mode based at least in part on the core sample rate. The IPD estimator is configured to determine IPD values based on the first audio signal and the second audio signal. The IPD values have a resolution corresponding to the selected IPD mode.

In another particular implementation, a device for processing audio signals includes a bandwidth extension (BWE) analyzer, an IPD mode selector, and an IPD estimator. The bandwidth extension analyzer is configured to determine one or more BWE parameters based on a first audio signal, a second audio signal, or both. The IPD mode selector is configured to select an IPD mode based at least in part on the BWE parameters. The IPD estimator is configured to determine IPD values based on the first audio signal and the second audio signal. The IPD values have a resolution corresponding to the selected IPD mode.

In another particular implementation, a device for processing audio signals includes an IPD mode analyzer and an IPD analyzer. The IPD mode analyzer is configured to determine an IPD mode based on an IPD mode indicator. The IPD analyzer is configured to extract IPD values from a stereo-cues bitstream based on a resolution associated with the IPD mode. The stereo-cues bitstream is associated with a mid-band bitstream corresponding to a first audio signal and a second audio signal.

In another particular implementation, a method of processing audio signals includes determining, at a device, an interchannel temporal mismatch value indicative of a temporal misalignment between a first audio signal and a second audio signal. The method also includes selecting, at the device, an IPD mode based on at least the interchannel temporal mismatch value. The method further includes determining, at the device, IPD values based on the first audio signal and the second audio signal. The IPD values have a resolution corresponding to the selected IPD mode.

In another particular implementation, a method of processing audio signals includes receiving, at a device, a stereo-cues bitstream associated with a mid-band bitstream corresponding to a first audio signal and a second audio signal. The stereo-cues bitstream indicates an interchannel temporal mismatch value and interchannel phase difference (IPD) values. The method also includes determining, at the device, an IPD mode based on the interchannel temporal mismatch value. The method further includes determining, at the device, the IPD values based at least in part on a resolution associated with the IPD mode.

In another particular implementation, a method of encoding audio data includes determining an interchannel temporal mismatch value indicative of a temporal misalignment between a first audio signal and a second audio signal. The method also includes selecting an IPD mode based on at least the interchannel temporal mismatch value. The method further includes determining IPD values based on the first audio signal and the second audio signal. The IPD values have a resolution corresponding to the selected IPD mode.

In another particular implementation, a method of encoding audio data includes selecting an IPD mode associated with a first frame of a frequency-domain mid-band signal based at least in part on a coder type associated with a previous frame of the frequency-domain mid-band signal. The method also includes determining IPD values based on a first audio signal and a second audio signal. The IPD values have a resolution corresponding to the selected IPD mode. The method further includes generating the first frame of the frequency-domain mid-band signal based on the first audio signal, the second audio signal, and the IPD values.

In another particular implementation, a method of encoding audio data includes generating an estimated mid-band signal based on a first audio signal and a second audio signal. The method also includes determining a predicted coder type based on the estimated mid-band signal. The method further includes selecting an IPD mode based at least in part on the predicted coder type. The method also includes determining IPD values based on the first audio signal and the second audio signal. The IPD values have a resolution corresponding to the selected IPD mode.

In another particular implementation, a method of encoding audio data includes selecting an IPD mode associated with a first frame of a frequency-domain mid-band signal based at least in part on a core type associated with a previous frame of the frequency-domain mid-band signal. The method also includes determining IPD values based on a first audio signal and a second audio signal. The IPD values have a resolution corresponding to the selected IPD mode. The method further includes generating the first frame of the frequency-domain mid-band signal based on the first audio signal, the second audio signal, and the IPD values.

In another particular implementation, a method of encoding audio data includes generating an estimated mid-band signal based on a first audio signal and a second audio signal. The method also includes determining a predicted core type based on the estimated mid-band signal. The method further includes selecting an IPD mode based on the predicted core type. The method also includes determining IPD values based on the first audio signal and the second audio signal. The IPD values have a resolution corresponding to the selected IPD mode.

In another particular implementation, a method of encoding audio data includes determining a speech/music decision parameter based on a first audio signal, a second audio signal, or both. The method also includes selecting an IPD mode based at least in part on the speech/music decision parameter. The method further includes determining IPD values based on the first audio signal and the second audio signal. The IPD values have a resolution corresponding to the selected IPD mode.

In another particular implementation, a method of decoding audio data includes determining an IPD mode based on an IPD mode indicator. The method also includes extracting IPD values from a stereo-cues bitstream based on a resolution associated with the IPD mode, the stereo-cues bitstream associated with a mid-band bitstream corresponding to a first audio signal and a second audio signal.

In another particular implementation, a computer-readable storage device stores instructions that, when executed by a processor, cause the processor to perform operations including determining an interchannel temporal mismatch value indicative of a temporal misalignment between a first audio signal and a second audio signal. The operations also include selecting an IPD mode based on at least the interchannel temporal mismatch value. The operations further include determining IPD values based on the first audio signal or the second audio signal. The IPD values have a resolution corresponding to the selected IPD mode.

In another particular implementation, a computer-readable storage device stores instructions that, when executed by a processor, cause the processor to perform operations comprising receiving a stereo-cues bitstream associated with a mid-band bitstream corresponding to a first audio signal and a second audio signal. The stereo-cues bitstream indicates an interchannel temporal mismatch value and interchannel phase difference (IPD) values. The operations also include determining an IPD mode based on the interchannel temporal mismatch value. The operations further include determining the IPD values based at least in part on a resolution associated with the IPD mode.

In another particular implementation, a non-transitory computer-readable medium includes instructions for encoding audio data. The instructions, when executed by a processor within an encoder, cause the processor to perform operations including determining an interchannel temporal mismatch value indicative of a temporal mismatch between a first audio signal and a second audio signal. The operations also include selecting an IPD mode based on at least the interchannel temporal mismatch value. The operations further include determining IPD values based on the first audio signal and the second audio signal. The IPD values have a resolution corresponding to the selected IPD mode.

In another particular implementation, a non-transitory computer-readable medium includes instructions for encoding audio data. The instructions, when executed by a processor within an encoder, cause the processor to perform operations including selecting an IPD mode associated with a first frame of a frequency-domain mid-band signal based at least in part on a coder type associated with a previous frame of the frequency-domain mid-band signal. The operations also include determining IPD values based on a first audio signal and a second audio signal. The IPD values have a resolution corresponding to the selected IPD mode. The operations further include generating the first frame of the frequency-domain mid-band signal based on the first audio signal, the second audio signal, and the IPD values.

In another particular implementation, a non-transitory computer-readable medium includes instructions for encoding audio data. The instructions, when executed by a processor within an encoder, cause the processor to perform operations including generating an estimated mid-band signal based on a first audio signal and a second audio signal. The operations also include determining a predicted coder type based on the estimated mid-band signal. The operations further include selecting an IPD mode based at least in part on the predicted coder type. The operations also include determining IPD values based on the first audio signal and the second audio signal. The IPD values have a resolution corresponding to the selected IPD mode.

In another particular implementation, a non-transitory computer-readable medium includes instructions for encoding audio data. The instructions, when executed by a processor within an encoder, cause the processor to perform operations including selecting an IPD mode associated with a first frame of a frequency-domain mid-band signal based at least in part on a core type associated with a previous frame of the frequency-domain mid-band signal. The operations also include determining IPD values based on a first audio signal and a second audio signal. The IPD values have a resolution corresponding to the selected IPD mode. The operations further include generating the first frame of the frequency-domain mid-band signal based on the first audio signal, the second audio signal, and the IPD values.

In another particular implementation, a non-transitory computer-readable medium includes instructions for encoding audio data. The instructions, when executed by a processor within an encoder, cause the processor to perform operations including generating an estimated mid-band signal based on a first audio signal and a second audio signal. The operations also include determining a predicted core type based on the estimated mid-band signal. The operations further include selecting an IPD mode based on the predicted core type. The operations also include determining IPD values based on the first audio signal and the second audio signal. The IPD values have a resolution corresponding to the selected IPD mode.

In another particular implementation, a non-transitory computer-readable medium includes instructions for encoding audio data. The instructions, when executed by a processor within an encoder, cause the processor to perform operations including determining a speech/music decision parameter based on a first audio signal, a second audio signal, or both. The operations also include selecting an IPD mode based at least in part on the speech/music decision parameter. The operations further include determining IPD values based on the first audio signal and the second audio signal. The IPD values have a resolution corresponding to the selected IPD mode.

In another particular implementation, a non-transitory computer-readable medium includes instructions for decoding audio data. The instructions, when executed by a processor within a decoder, cause the processor to perform operations including determining an IPD mode based on an IPD mode indicator. The operations also include extracting IPD values from a stereo-cues bitstream based on a resolution associated with the IPD mode. The stereo-cues bitstream is associated with a mid-band bitstream corresponding to a first audio signal and a second audio signal.

Other implementations, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
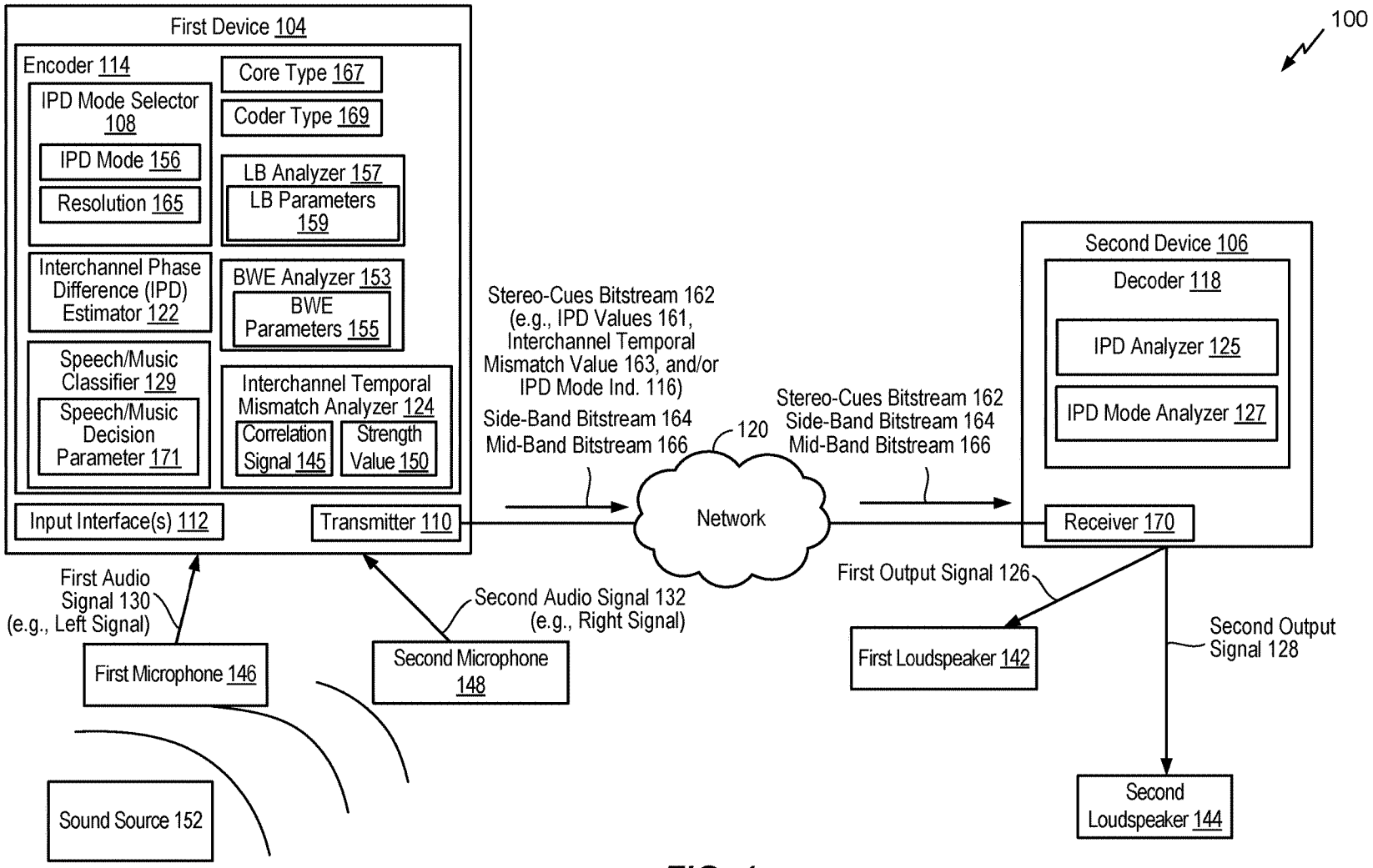
FIG. 1 is a block diagram of a particular illustrative example of a system that includes an encoder operable to encode interchannel phase differences between audio signals and a decoder operable to decode the interchannel phase differences.

A device may include an encoder configured to encode multiple audio signals. The encoder may generate an audio bitstream based on encoding parameters including spatial coding parameters. Spatial coding parameters may alternatively be referred to as "stereo-cues." A decoder receiving the audio bitstream may generate output audio signals based on the audio bitstream. The stereo-cues may include an interchannel temporal mismatch value, interchannel phase difference (IPD) values, or other stereo-cues values. The interchannel temporal mismatch value may indicate a temporal misalignment between a first audio signal of the multiple audio signals and a second audio signal of the multiple audio signals. The IPD values may correspond to a plurality of frequency subbands. Each of the IPD values may indicate a phase difference between the first audio signal and the second audio signal in a corresponding subband.

Systems and devices operable to encode and decode interchannel phase differences between audio signals are disclosed. In a particular aspect, an encoder selects an IPD resolution based on at least an inter-channel temporal mismatch value and one or more characteristics associated with multiple audio signals to be encoded. The one or more characteristics include a core sample rate, a pitch value, a voice activity parameter, a voicing factor, one or more BWE parameters, a core type, a codec type, a speech/music classification (e.g., a speech/music decision parameter), or a combination thereof. The BWE parameters include a gain mapping parameter, a spectral mapping parameter, an interchannel BWE reference channel indicator, or a combination thereof. For example, the encoder selects an IPD resolution based on an interchannel temporal mismatch value, a strength value associated with the interchannel temporal mismatch value, a pitch value, a voicing activity parameter, a voicing factor, a core sample rate, a core type, a codec type, a speech/music decision parameter, a gain mapping parameter, a spectral mapping parameter, an interchannel BWE reference channel indicator, or a combination thereof. The encoder may select a resolution of the IPD values (e.g., an IPD resolution) corresponding to an IPD mode. As used herein, a "resolution" of a parameter, such as IPD, may correspond to a number of bits that are allocated for use in representing the parameter in an output bitstream. In a particular implementation, the resolution of the IPD values corresponds to a count of IPD values. For example, a first IPD value may correspond to a first frequency band, a second IPD value may correspond to a second frequency band, and so on. In this implementation, a resolution of the IPD values indicates a number of frequency bands for which an IPD value is to be included in the audio bitstream. In a particular implementation, the resolution corresponds to a coding type of the IPD values. For example, an IPD value may be generated using a first coder (e.g., a scalar quantizer) to have a first resolution (e.g., a high resolution). Alternatively, the IPD value may be generated using a second coder (e.g., a vector quantizer) to have a second resolution (e.g., a low resolution). An IPD value generated by the second coder may be represented by fewer bits than an IPD value generated by the first coder. The encoder may dynamically adjust a number of bits used to represent the IPD values in the audio bitstream based on characteristics of the multiple audio signals. Dynamically adjusting the number of bits may enable higher resolution IPD values to be provided to the decoder when the IPD values are expected to have a greater impact on audio quality. Prior to providing details regarding selection of the IPD resolution, an overview of audio encoding techniques is presented below.

An encoder of a device may be configured to encode multiple audio signals. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted. The speech/audio from a given source (e.g., a talker) may arrive at the multiple microphones at different times, at different directions-of-arrival, or both, depending on how the microphones are arranged as well as where the source (e.g., the talker) is located with respect to the microphones and room dimensions. For example, a sound source (e.g., a talker) may be closer to a first microphone associated with the device than to a second microphone associated with the device. Thus, a sound emitted from the sound source may reach the first microphone earlier in time than the second microphone, reach the first microphone at a distinct direction-of-arrival than at the second microphone, or both. The device may receive a first audio signal via the first microphone and may receive a second audio signal via the second microphone.

Mid-side (MS) coding and parametric stereo (PS) coding are stereo coding techniques that may provide improved efficiency over dual-mono coding techniques. In dual-mono coding, the Left (L) channel (or signal) and the Right (R) channel (or signal) are independently coded without making use of interchannel correlation. MS coding reduces the redundancy between a correlated L/R channel-pair by transforming the Left channel and the Right channel to a sum-channel and a difference-channel (e.g., a side channel) prior to coding. The sum signal and the difference signal are waveform coded in MS coding. Relatively more bits are spent on the sum signal than on the side signal. PS coding reduces redundancy in each sub-band by transforming the L/R signals into a sum signal and a set of side parameters. The side parameters may indicate an interchannel intensity difference (IID), an IPD, an interchannel temporal mismatch, etc. The sum signal is waveform coded and transmitted along with the side parameters. In a hybrid system, the side-channel may be waveform coded in the lower bands (e.g., less than 2 kilohertz (kHz)) and PS coded in the upper bands (e.g., greater than or equal to 2 kHz) where the interchannel phase preservation is perceptually less critical.

The MS coding and the PS coding may be done in either the frequency-domain or in the sub-band domain. In some examples, the Left channel and the Right channel may be uncorrelated. For example, the Left channel and the Right channel may include uncorrelated synthetic signals. When the Left channel and the Right channel are uncorrelated, the coding efficiency of the MS coding, the PS coding, or both, may approach the coding efficiency of the dual-mono coding.

Depending on a recording configuration, there may be a temporal shift between a Left channel and a Right channel, as well as other spatial effects such as echo and room reverberation. If the temporal shift and phase mismatch between the channels are not compensated, the sum channel and the difference channel may contain comparable energies reducing the coding-gains associated with MS or PS techniques. The reduction in the coding-gains may be based on the amount of temporal (or phase) shift. The comparable energies of the sum signal and the difference signal may limit the usage of MS coding in certain frames where the channels are temporally shifted but are highly correlated.

In stereo coding, a Mid channel (e.g., a sum channel) and a Side channel (e.g., a difference channel) may be generated based on the following Formula:

$$M=(L+R)/2,\ S=(L-R)/2, \qquad \text{Formula 1}$$

where M corresponds to the Mid channel, S corresponds to the Side channel, L corresponds to the Left channel, and R corresponds to the Right channel.

In some cases, the Mid channel and the Side channel may be generated based on the following Formula:

$$M=c(L+R),\ S=c(L-R), \qquad \text{Formula 2}$$

where c corresponds to a complex value which is frequency dependent. Generating the Mid channel and the Side channel based on Formula 1 or Formula 2 may be referred to as performing a "downmixing" algorithm. A reverse process of generating the Left channel and the Right channel from the Mid channel and the Side channel based on Formula 1 or Formula 2 may be referred to as performing an "upmixing" algorithm.

In some cases, the Mid channel may be based other formulas such as:

$$M=(L+g_D R)/2, \text{ or} \qquad \text{Formula 3}$$

$$M=g_1 L+g_2 R \qquad \text{Formula 4}$$

where $g_1+g_2=1.0$, and where $g_D$ is a gain parameter. In other examples, the downmix may be performed in bands, where $\text{mid}(b)=c_1L(b)+c_2R(b)$, where $c_1$ and $c_2$ are complex numbers, where $\text{side}(b)=c_3L(b)-c_4R(b)$, and where $c_3$ and $c_4$ are complex numbers.

As described above, in some examples, an encoder may determine an interchannel temporal mismatch value indicative of a shift of the first audio signal relative to the second audio signal. The interchannel temporal mismatch may correspond to an interchannel alignment (ICA) value or an interchannel temporal mismatch (ITM) value. ICA and ITM may be alternative ways to represent temporal misalignment between two signals. The ICA value (or the ITM value) may correspond to a shift of the first audio signal relative to the second audio signal in the time-domain. Alternatively, the ICA value (or the ITM value) may correspond to a shift of the second audio signal relative to the first audio signal in the time-domain. The ICA value and the ITM value may both be estimates of the shift that are generated using different methods. For example, the ICA value may be generated using time-domain methods, whereas the ITM value may be generated using frequency-domain methods The interchannel temporal mismatch value may correspond to an amount of temporal misalignment (e.g., temporal delay) between receipt of the first audio signal at the first microphone and receipt of the second audio signal at the second microphone. The encoder may determine the interchannel temporal mismatch value on a frame-by-frame basis, e.g., based on each 20 milliseconds (ms) speech/audio frame. For example, the interchannel temporal mismatch value may correspond to an amount of time that a frame of the second audio signal is delayed with respect to a frame of the first audio signal. Alternatively, the interchannel temporal mismatch value may correspond to an amount of time that the frame of the first audio signal is delayed with respect to the frame of the second audio signal.

Depending on where the sound sources (e.g., talkers) are located in a conference or telepresence room or how the sound source (e.g., talker) position changes relative to the microphones, the interchannel temporal mismatch value may change from one frame to another. The interchannel temporal mismatch value may correspond to a "non-causal shift" value by which the delayed signal (e.g., a target signal) is "pulled back" in time such that the first audio signal is aligned (e.g., maximally aligned) with the second audio signal. "Pulling back" the target signal may correspond to advancing the target signal in time. For example, a first frame of the delayed signal (e.g., the target signal) may be received at the microphones at approximately the same time as a first frame of the other signal (e.g., a reference signal). A second frame of the delayed signal may be received subsequent to receiving the first frame of the delayed signal. When encoding the first frame of the reference signal, the encoder may select the second frame of the delayed signal instead of the first frame of the delayed signal in response to determining that a difference between the second frame of the delayed signal and the first frame of the reference signal is less than a difference between the first frame of the delayed signal and the first frame of the reference signal. Non-causal shifting of the delayed signal relative to the reference signal includes aligning the second frame of the delayed signal (that is received later) with the first frame of the reference signal (that is received earlier). The non-causal shift value may indicate a number of frames between the first frame of the delayed signal and the second frame of the delayed signal. It should be understood that frame-level shifting is described for ease of explanation, in some aspects, sample-level non-causal shifting is performed to align the delayed signal and the reference signal.

The encoder may determine first IPD values corresponding to a plurality of frequency subbands based on the first audio signal and the second audio signal. For example, the first audio signal (or the second audio signal) may be adjusted based on the interchannel temporal mismatch value. In a particular implementation, the first IPD values correspond to phase differences between the first audio signal and the adjusted second audio signal in frequency subbands. In an alternative implementation, the first IPD values correspond to phase differences between the adjusted first audio signal and the second audio signal in the frequency subbands. In another alternative implementation, the first IPD values correspond to phase differences between the adjusted first audio signal and the adjusted second audio signal in the frequency subbands. In various implementations described herein, the temporal adjustment of the first or the second channels could alternatively be performed in the time domain (rather than in the frequency domain). The first IPD values may have a first resolution (e.g., full resolution or high resolution). The first resolution may correspond to a first number of bits being used to represent the first IPD values.

The encoder may dynamically determine the resolution of IPD values to be included in a coded audio bitstream based on various characteristics, such as the interchannel temporal mismatch value, a strength value associated with the interchannel temporal mismatch value, a core type, a codec type, a speech/music decision parameter, or a combination thereof. The encoder may select an IPD mode based on the characteristics, as described herein, whereas the IPD mode corresponds to a particular resolution.

The encoder may generate IPD values having the particular resolution by adjusting a resolution of the first IPD values. For example, the IPD values may include a subset of the first IPD values corresponding to a subset of the plurality of frequency subbands.

The downmix algorithm to determine the mid channel and the side channel may be performed on the first audio signal and the second audio signal based on the interchannel temporal mismatch value, the IPD values, or a combination thereof. The encoder may generate a mid-channel bitstream by encoding the mid-channel, a side-channel bitstream by encoding the side-channel, and a stereo-cues bitstream indicating the interchannel temporal mismatch value, the IPD values (having the particular resolution), an indicator of the IPD mode, or a combination thereof.

In a particular aspect, a device performs a framing or a buffering algorithm to generate a frame (e.g., 20 ms samples) at a first sampling rate (e.g., 32 kHz sampling rate to generate 640 samples per frame). The encoder may, in response to determining that a first frame of the first audio signal and a second frame of the second audio signal arrive at the same time at the device, estimate an interchannel temporal mismatch value as equal to zero samples. A Left channel (e.g., corresponding to the first audio signal) and a Right channel (e.g., corresponding to the second audio signal) may be temporally aligned. In some cases, the Left channel and the Right channel, even when aligned, may differ in energy due to various reasons (e.g., microphone calibration).

In some examples, the Left channel and the Right channel may not be temporally aligned due to various reasons (e.g., a sound source, such as a talker, may be closer to one of the microphones than another and the two microphones may be greater than a threshold (e.g., 1-20 centimeters) distance apart). A location of the sound source relative to the microphones may introduce different delays in the Left channel and the Right channel. In addition, there may be a gain difference, an energy difference, or a level difference between the Left channel and the Right channel.

In some examples, the first audio signal and second audio signal may be synthesized or artificially generated when the two signals potentially show less (e.g., no) correlation. It should be understood that the examples described herein are illustrative and may be instructive in determining a relationship between the first audio signal and the second audio signal in similar or different situations.

The encoder may generate comparison values (e.g., difference values or cross-correlation values) based on a comparison of a first frame of the first audio signal and a plurality of frames of the second audio signal. Each frame of the plurality of frames may correspond to a particular interchannel temporal mismatch value. The encoder may generate an interchannel temporal mismatch value based on the comparison values. For example, the interchannel temporal mismatch value may correspond to a comparison value indicating a higher temporal-similarity (or lower difference) between the first frame of the first audio signal and a corresponding first frame of the second audio signal.

The encoder may generate first IPD values corresponding to a plurality of frequency subbands based on a comparison of the first frame of the first audio signal and the corresponding first frame of the second audio signal. The encoder may select an IPD mode based on the interchannel temporal mismatch value, a strength value associated with the interchannel temporal mismatch value, a core type, a codec type, a speech/music decision parameter, or a combination thereof. The encoder may generate IPD values having a particular resolution corresponding to the IPD mode by adjusting a resolution of the first IPD values. The encoder may perform phase shifting on the corresponding first frame of the second audio signal based on the IPD values.

The encoder may generate at least one encoded signal (e.g., a mid signal, a side signal, or both) based on the first audio signal, the second audio signal, the interchannel temporal mismatch value, and the IPD values. The side signal may correspond to a difference between first samples of the first frame of the first audio signal and second samples of the phase-shifted corresponding first frame of the second audio signal. Fewer bits may be used to encode the side channel signal because of reduced difference between the first samples and the second samples as compared to other samples of the second audio signal that correspond to a frame of the second audio signal that is received by the device at the same time as the first frame. A transmitter of the device may transmit the at least one encoded signal, the interchannel temporal mismatch value, the IPD values, an indicator of the particular resolution, or a combination thereof.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 may include an encoder 114, a transmitter 110, one or more input interfaces 112, or a combination thereof. A first input interface of the input interfaces 112 may be coupled to a first microphone 146. A second input interface of the input interface(s) 112 may be coupled to a second microphone 148. The encoder 114 may include an interchannel temporal mismatch (ITM) analyzer 124, an IPD mode selector 108, an IPD estimator 122, a speech/music classifier 129, a LB analyzer 157, a bandwidth extension (BWE) analyzer 153, or a combination thereof. The encoder 114 may be configured to downmix and encode multiple audio signals, as described herein.

The second device 106 may include a decoder 118 and a receiver 170. The decoder 118 may include an IPD mode analyzer 127, an IPD analyzer 125, or both. The decoder 118 may be configured to upmix and render multiple channels. The second device 106 may be coupled to a first loudspeaker 142, a second loudspeaker 144, or both. Although FIG. 1 illustrates an example in which one device includes an encoder and another device includes a decoder, it is to be understood that in alternative aspects, devices may include both encoders and decoders.

During operation, the first device 104 may receive a first audio signal 130 via the first input interface from the first microphone 146 and may receive a second audio signal 132 via the second input interface from the second microphone 148. The first audio signal 130 may correspond to one of a right channel signal or a left channel signal. The second audio signal 132 may correspond to the other of the right channel signal or the left channel signal. A sound source 152 (e.g., a user, a speaker, ambient noise, a musical instrument, etc.) may be closer to the first microphone 146 than to the second microphone 148, as shown in FIG. 1. Accordingly, an audio signal from the sound source 152 may be received at the input interface(s) 112 via the first microphone 146 at an earlier time than via the second microphone 148. This natural delay in the multi-channel signal acquisition through the multiple microphones may introduce an interchannel temporal mismatch between the first audio signal 130 and the second audio signal 132.

The interchannel temporal mismatch analyzer 124 may determine an interchannel temporal mismatch value 163 (e.g., a non-causal shift value) indicative of the shift (e.g., a non-causal shift) of the first audio signal 130 relative to the second audio signal 132. In this example, the first audio signal 130 may be referred to as a "target" signal and the second audio signal 132 may be referred to as a "reference" signal. A first value (e.g., a positive value) of the interchannel temporal mismatch value 163 may indicate that the second audio signal 132 is delayed relative to the first audio signal 130. A second value (e.g., a negative value) of the interchannel temporal mismatch value 163 may indicate that the first audio signal 130 is delayed relative to the second audio signal 132. A third value (e.g., 0) of the interchannel temporal mismatch value 163 may indicate that there is no temporal misalignment (e.g., no temporal delay) between the first audio signal 130 and the second audio signal 132.

The interchannel temporal mismatch analyzer 124 may determine the interchannel temporal mismatch value 163, a strength value 150, or both, based on a comparison of a first frame of the first audio signal 130 and a plurality of frames of the second audio signal 132 (or vice versa), as further described with reference to FIG. 4. The interchannel temporal mismatch analyzer 124 may generate an adjusted first audio signal 130 (or an adjusted second audio signal 132, or both) by adjusting the first audio signal 130 (or the second audio signal 132, or both) based on the interchannel temporal mismatch value 163, as further described with reference to FIG. 4. The speech/music classifier 129 may determine a speech/music decision parameter 171 based on the first audio signal 130, the second audio signal 132, or both, as further described with reference to FIG. 4. The speech/music decision parameter 171 may indicate whether first frame of the first audio signal 130 more closely corresponds to (and is therefore more likely to include) speech or music.

The encoder 114 may be configured to determine a core type 167, a coder type 169, or both. For example, prior to encoding of the first frame of the first audio signal 130, a second frame of the first audio signal 130 may have been encoded based on a previous core type, a previous coder type, or both. Alternatively, the core type 167 may correspond to the previous core type, the coder type 169 may correspond to the previous coder type, or both. In an alternative aspect, the core type 167 corresponds to a predicted core type, the coder type 169 corresponds to a predicted coder type, or both. The encoder 114 may determine the predicted core type, the predicted coder type, or both, based on the first audio signal 130 and the second audio signal 132, as further described with reference to FIG. 2. Thus, the values of the core type 167 and the coder type 169 may be set to the respective values that were used to encode a previous frame, or such values may be predicted independent of the values that were used to encode the previous frame.

The LB analyzer 157 is configured to determine one or more LB parameters 159 based on the first audio signal 130, the second audio signal 132, or both, as further described with reference to FIG. 2. The LB parameters 159 include a core sample rate (e.g., 12.8 kHz or 16 kHz), a pitch value, a voicing factor, a voicing activity parameter, another LB characteristic, or a combination thereof. The BWE analyzer 153 is configured to determine one or more BWE parameters 155 based on the first audio signal 130, the second audio signal 132, or both, as further described with reference to FIG. 2. The BWE parameters 155 include one or more interchannel BWE parameters, such as a gain mapping parameter, a spectral mapping parameter, an interchannel BWE reference channel indicator, or a combination thereof.

The IPD mode selector 108 may select an IPD mode 156 based on the interchannel temporal mismatch value 163, the strength value 150, the core type 167, the coder type 169, the LB parameters 159, the BWE parameters 155, the speech/music decision parameter 171, or a combination thereof, as further described with reference to FIG. 4. The IPD mode 156 may correspond to a resolution 165, that is, a number of bits to be used to represent an IPD value. The IPD estimator 122 may generate IPD values 161 having the resolution 165, as further described with reference to FIG. 4. In a particular implementation, the resolution 165 corresponds to a count of the IPD values 161. For example, a first IPD value may correspond to a first frequency band, a second IPD value may correspond to a second frequency band, and so on. In this implementation, the resolution 165 indicates a number of frequency bands for which an IPD value is to be included in the IPD values 161. In a particular aspect, the resolution 165 corresponds to a range of phase values. For example, the resolution 165 corresponds to a number of bits to represent a value included in the range of phase values.

In a particular aspect, the resolution 165 indicates a number of bits (e.g., a quantization resolution) to be used to represent absolute IPD values. For example, the resolution 165 may indicate that a first number of bits are (e.g., a first quantization resolution is) to be used to represent a first absolute value of a first IPD value corresponding to a first frequency band, that a second number of bits are (e.g., a second quantization resolution is) to be used to represent a second absolute value of a second IPD value corresponding to a second frequency band, that additional bits to be used to represent additional absolute IPD values corresponding to additional frequency bands, or a combination thereof. The IPD values 161 may include the first absolute value, the second absolute value, the additional absolute IPD values, or a combination thereof. In a particular aspect, the resolution 165 indicates a number of bits to be used to represent an amount of temporal variance of IPD values across frames. For example, first IPD values may be associated with a first frame and second IPD values may be associated with a second frame. The IPD estimator 122 may determine an amount of temporal variance based on a comparison of the first IPD values and the second IPD values. The IPD values 161 may indicate the amount of temporal variance. In this aspect, the resolution 165 indicates a number of bits used to represent the amount of temporal variance. The encoder 114 may generate an IPD mode indicator 116 indicating the IPD mode 156, the resolution 165, or both.

The encoder 114 may generate a side-band bitstream 164, a mid-band bitstream 166, or both, based on the first audio signal 130, the second audio signal 132, the IPD values 161, the interchannel temporal mismatch value 163, or a combination thereof, as further described with reference to FIGS. 2-3. For example, the encoder 114 may generate the side-band bitstream 164, the mid-band bitstream 166, or both, based on the adjusted first audio signal 130 (e.g., a first aligned audio signal), the second audio signal 132 (e.g., a second aligned audio signal), the IPD values 161, the interchannel temporal mismatch value 163, or a combination thereof. As another example, the encoder 114 may generate the side-band bitstream 164, the mid-band bitstream 166, or both, based on the first audio signal 130, the adjusted second audio signal 132, the IPD values 161, the interchannel temporal mismatch value 163, or a combination thereof. The encoder 114 may also generate a stereo-cues bitstream 162 indicating the IPD values 161, the interchannel temporal mismatch value 163, the IPD mode indicator 116, the core type 167, the coder type 169, the strength value 150, the speech/music decision parameter 171, or a combination thereof.

The transmitter 110 may transmit the stereo-cues bitstream 162, the side-band bitstream 164, the mid-band bitstream 166, or a combination thereof, via the network 120, to the second device 106. Alternatively, or in addition, the transmitter 110 may store the stereo-cues bitstream 162, the side-band bitstream 164, the mid-band bitstream 166, or a combination thereof, at a device of the network 120 or a local device for further processing or decoding at a later point in time. When the resolution 165 corresponds to more than zero bits, the IPD values 161 in addition to the interchannel temporal mismatch value 163 may enable finer subband adjustments at a decoder (e.g., the decoder 118 or a local decoder). When the resolution 165 corresponds to zero bits, the stereo-cues bitstream 162 may have fewer bits or may have bits available to include stereo-cues parameter(s) other than IPD.

The receiver 170 may receive, via the network 120, the stereo-cues bitstream 162, the side-band bitstream 164, the mid-band bitstream 166, or a combination thereof. The decoder 118 may perform decoding operations based on the stereo-cues bitstream 162, the side-band bitstream 164, the mid-band bitstream 166, or a combination thereof, to generate output signals 126, 128 corresponding to decoded versions of the input signals 130, 132. For example, the IPD mode analyzer 127 may determine that the stereo-cues bitstream 162 includes the IPD mode indicator 116 and that the IPD mode indicator 116 indicates the IPD mode 156. The IPD analyzer 125 may extract the IPD values 161 from the stereo-cues bitstream 162 based on the resolution 165 corresponding to the IPD mode 156. The decoder 118 may generate the first output signal 126 and the second output signal 128 based on the IPD values 161, the side-band bitstream 164, the mid-band bitstream 166, or a combination thereof, as further described with reference to FIG. 7. The second device 106 may output the first output signal 126 via the first loudspeaker 142. The second device 106 may output the second output signal 128 via the second loudspeaker 144. In alternative examples, the first output signal 126 and second output signal 128 may be transmitted as a stereo signal pair to a single output loudspeaker.

The system 100 may thus enable the encoder 114 to dynamically adjust a resolution of the IPD values 161 based on various characteristics. For example, the encoder 114 may determine a resolution of the IPD values based on the interchannel temporal mismatch value 163, the strength value 150, the core type 167, the coder type 169, the speech/music decision parameter 171, or a combination thereof. The encoder 114 may thus use have more bits available to encode other information when the IPD values 161 have a low resolution (e.g., zero resolution) and may enable performance of finer subband adjustments at a decoder when the IPD values 161 have a higher resolution.

Figure 2:
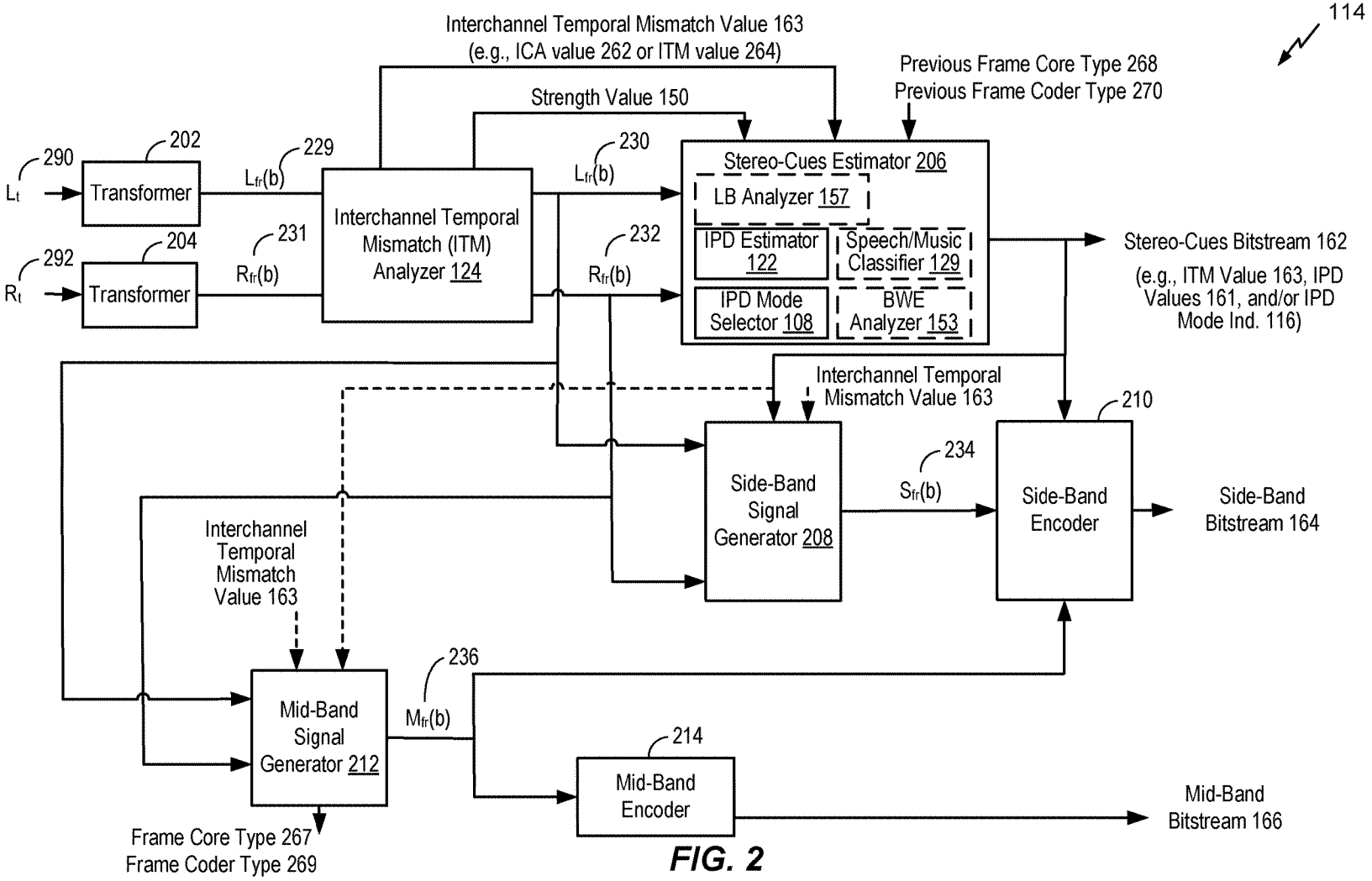
FIG. 2 is a diagram of particular illustrative aspects of the encoder of FIG. 1.
Figure 3:
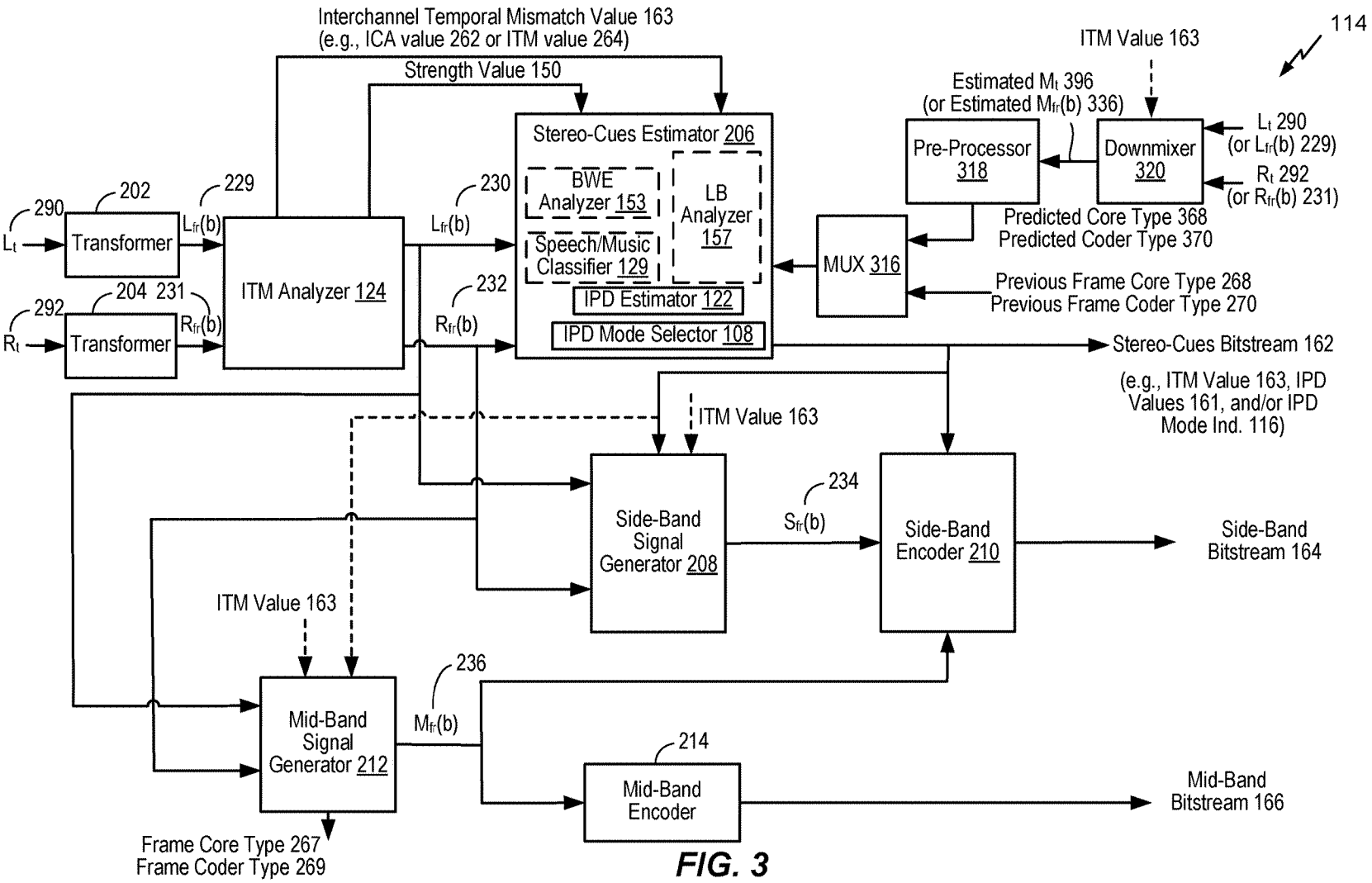
FIG. 3 is a diagram of particular illustrative aspects of the encoder of FIG. 1.

Referring to FIG. 2, an illustrative example of the encoder 114 is shown. The encoder 114 includes the interchannel temporal mismatch analyzer 124 coupled to a stereo-cues estimator 206. The stereo-cues estimator 206 may include the speech/music classifier 129, the LB analyzer 157, the BWE analyzer 153, the IPD mode selector 108, the IPD estimator 122, or a combination thereof.

A transformer 202 may be coupled, via the interchannel temporal mismatch analyzer 124, to the stereo-cues estimator 206, a side-band signal generator 208, a mid-band signal generator 212, or a combination thereof. A transformer 204 may be coupled, via the interchannel temporal mismatch analyzer 124, to the stereo-cues estimator 206, the side-band signal generator 208, the mid-band signal generator 212, or a combination thereof. The side-band signal generator 208 may be coupled to a side-band encoder 210. The mid-band signal generator 212 may be coupled to a mid-band encoder 214. The stereo-cues estimator 206 may be coupled to the side-band signal generator 208, the side-band encoder 210, the mid-band signal generator 212, or a combination thereof.

In some examples, the first audio signal 130 of FIG. 1 may include a left-channel signal and the second audio signal 132 of FIG. 1 may include a right-channel signal. A time-domain left signal ($L_t$) 290 may correspond to the first audio signal 130 and a time-domain right signal ($R_t$) 292 may correspond to the second audio signal 132. However, it should be understood that in other examples, the first audio signal 130 may include a right-channel signal and the second audio signal 132 may include a left-channel signal. In such examples, the time-domain right signal ($R_t$) 292 may correspond to the first audio signal 130 and a time-domain left signal ($L_t$) 290 may correspond to the second audio signal 132. It is also to be understood that the various components illustrated in FIGS. 1-4, 7-8, and 10 (e.g., transforms, signal generators, encoders, estimators, etc.) may be implemented using hardware (e.g., dedicated circuitry), software (e.g., instructions executed by a processor), or a combination thereof.

During operation, the transformer 202 may perform a transform on the time-domain left signal ($L_t$) 290 and the transformer 204 may perform a transform on the time-domain right signal ($R_t$) 292. The transformers 202, 204 may perform transform operations that generate frequency-domain (or sub-band domain) signals. As non-limiting examples, the transformers 202, 204 may perform Discrete Fourier Transform (DFT) operations, Fast Fourier Transform (FFT) operations, etc. In a particular implementation, Quadrature Mirror Filterbank (QMF) operations (using filterbanks, such as a Complex Low Delay Filter Bank) are used to split the input signals 290, 292 into multiple sub-bands, and the sub-bands may be converted into the frequency-domain using another frequency-domain transform operation. The transformer 202 may generate a frequency-domain left signal ($L_{fr}(b)$) 229 by transforming the time-domain left signal ($L_t$) 290, and the transformer 304 may generate a frequency-domain right signal ($R_{fr}(b)$) 231 by transforming the time-domain right signal ($R_t$) 292.

The interchannel temporal mismatch analyzer 124 may generate the interchannel temporal mismatch value 163, the strength value 150, or both, based on the frequency-domain left signal ($L_{fr}(b)$) 229 and the frequency-domain right signal ($R_{fr}(b)$) 231, as described with reference to FIG. 4. The interchannel temporal mismatch value 163 may provide an estimate of a temporal mismatch between the frequency-domain left signal ($L_{fr}(b)$) 229 and the frequency-domain right signal ($R_{fr}(b)$) 231. The interchannel temporal mismatch value 163 may include an ICA value 262. The interchannel temporal mismatch analyzer 124 may generate a frequency-domain left signal ($L_{fr}(b)$) 230 and a frequency-domain right signal ($R_{fr}(b)$) 232 based on the frequency-domain left signal ($L_{fr}(b)$) 229, the frequency-domain right signal ($R_{fr}(b)$) 231, and the interchannel temporal mismatch value 163. For example, the interchannel temporal mismatch analyzer 124 may generate the frequency-domain left signal ($L_{fr}(b)$) 230 by shifting the frequency-domain left signal ($L_{fr}(b)$) 229 based on an ITM value 264. The frequency-domain right signal ($R_{fr}(b)$) 232 may correspond to the frequency-domain right signal ($R_{fr}(b)$) 231. Alternatively, the interchannel temporal mismatch analyzer 124 may generate the frequency-domain right signal ($R_{fr}(b)$) 232 by shifting the frequency-domain right signal ($R_{fr}(b)$) 231 based on the ITM value 264. The frequency-domain left signal ($L_{fr}(b)$) 230 may correspond to the frequency-domain left signal ($L_{fr}(b)$) 229.

In a particular aspect, the interchannel temporal mismatch analyzer 124 generates the interchannel temporal mismatch value 163, the strength value 150, or both, based on the time-domain left signal ($L_t$) 290 and the time-domain right signal ($R_t$) 292, as described with reference to FIG. 4. In this aspect, the interchannel temporal mismatch value 163 includes the ITM value 264 rather than the ICA value 262, as described with reference to FIG. 4. The interchannel temporal mismatch analyzer 124 may generate the frequency-domain left signal ($L_{fr}(b)$) 230 and the frequency-domain right signal ($R_{fr}(b)$) 232 based on the time-domain left signal ($L_t$) 290, the time-domain right signal ($R_t$) 292, and the interchannel temporal mismatch value 163. For example, the interchannel temporal mismatch analyzer 124 may generate an adjusted time-domain left signal ($L_t$) 290 by shifting the time-domain left signal ($L_t$) 290 based on the ICA value 262. The interchannel temporal mismatch analyzer 124 may generate the frequency-domain left signal ($L_{fr}(b)$) 230 and the frequency-domain right signal ($R_{fr}(b)$) 232 by performing a transform on the adjusted time-domain left signal ($L_t$) 290 and the time-domain right signal ($R_t$) 292, respectively. Alternatively, the interchannel temporal mismatch analyzer 124 may generate an adjusted time-domain right signal ($R_t$) 292 by shifting the time-domain right signal ($R_t$) 292 based on the ICA value 262. The interchannel temporal mismatch analyzer 124 may generate the frequency-domain left signal ($L_{fr}(b)$) 230 and the frequency-domain right signal ($R_{fr}(b)$) 232 by performing a transform on the time-domain left signal ($L_t$) 290 and the adjusted time-domain right signal ($R_t$) 292, respectively. Alternatively, the interchannel temporal mismatch analyzer 124 may generate an adjusted time-domain left signal ($L_t$) 290 by shifting the time-domain left signal ($L_t$) 290 based on the ICA value 262 and generate an adjusted time-domain right signal ($R_t$) 292 by shifting the time-domain right signal ($R_t$) 292 based on the ICA value 262. The interchannel temporal mismatch analyzer 124 may generate the frequency-domain left signal ($L_{fr}(b)$) 230 and the frequency-domain right signal ($R_{fr}(b)$) 232 by performing a transform on the adjusted time-domain left signal ($L_t$) 290 and the adjusted time-domain right signal ($R_t$) 292, respectively.

The stereo-cues estimator 206 and the side-band signal generator 208 may each receive the interchannel temporal mismatch value 163, the strength value 150, or both, from the interchannel temporal mismatch analyzer 124. The stereo-cues estimator 206 and the side-band signal generator 208 may also receive the frequency-domain left signal ($L_{fr}(b)$) 230 from the transformer 202, the frequency-domain right signal ($R_{fr}(b)$) 232 from the transformer 204, or a combination thereof. The stereo-cues estimator 206 may generate the stereo-cues bitstream 162 based on the frequency-domain left signal ($L_{fr}(b)$) 230, the frequency-domain right signal ($R_{fr}(b)$) 232, the interchannel temporal mismatch value 163, the strength value 150, or a combination thereof. For example, the stereo-cues estimator 206 may generate the IPD mode indicator 116, the IPD values 161, or both, as described with reference to FIG. 4. The stereo-cues estimator 206 may alternatively be referred to as a "stereo-cues bitstream generator." The IPD values 161 may provide an estimate of the phase difference, in the frequency-domain, between the frequency-domain left signal ($L_{fr}(b)$) 230 and the frequency-domain right signal ($R_{fr}(b)$) 232. In a particular aspect, the stereo-cues bitstream 162 includes additional (or alternative) parameters, such as IID, etc. The stereo-cues bitstream 162 may be provided to the side-band signal generator 208 and to the side-band encoder 210.

The side-band signal generator 208 may generate a frequency-domain side-band signal ($S_{fr}(b)$) 234 based on the frequency-domain left signal ($L_{fr}(b)$) 230, the frequency-domain right signal ($R_{fr}(b)$) 232, the interchannel temporal mismatch value 163, the IPD values 161, or a combination thereof. In a particular aspect, the frequency-domain side-band signal 234 is estimated in frequency-domain bins/bands and the IPD values 161 correspond to a plurality of bands. For example, a first IPD value of the IPD values 161 may correspond to a first frequency band. The side-band signal generator 208 may generate a phase-adjusted frequency-domain left signal ($L_{fr}(b)$) 230 by performing a phase shift on the frequency-domain left signal ($L_{fr}(b)$) 230 in the first frequency band based on the first IPD value. The side-band signal generator 208 may generate a phase-adjusted frequency-domain right signal ($R_{fr}(b)$) 232 by performing a phase shift on the frequency-domain right signal ($R_{fr}(b)$) 232 in the first frequency band based on the first IPD value. This process may be repeated for other frequency bands/bins.

The phase-adjusted frequency-domain left signal ($L_{fr}(b)$) 230 may correspond to $c_1(b)*L_{fr}(b)$ and the phase-adjusted frequency-domain right signal ($R_{fr}(b)$) 232 may correspond to $c_2(b)*R_{fr}(b)$, where $L_{fr}(b)$ corresponds to the frequency-domain left signal ($L_{fr}(b)$) 230, $R_{fr}(b)$ corresponds to the frequency-domain right signal ($R_{fr}(b)$) 232, and $c_1(b)$ and $c_2(b)$ are complex values that are based on the IPD values 161. In a particular implementation, $c_1(b)=(\cos(-\gamma)-i*\sin(-\gamma))/2^{0.5}$ and $c_2(b)=(\cos(IPD(b)-\gamma)+i*\sin(IPD(b)-\gamma))/2^{0.5}$, where i is the imaginary number signifying the square root of −1 and IPD(b) is one of the IPD values 161 associated with a particular subband (b). In a particular aspect, the IPD mode indicator 116 indicates that the IPD values 161 have a particular resolution (e.g., 0). In this aspect, the phase-adjusted frequency-domain left signal ($L_{fr}(b)$) 230 corresponds to the frequency-domain left signal ($L_{fr}(b)$) 230, whereas the phase-adjusted frequency-domain right signal ($R_{fr}(b)$) 232 corresponds to the frequency-domain right signal ($R_{fr}(b)$) 232.

The side-band signal generator 208 may generate the frequency-domain side-band signal ($S_{fr}(b)$) 234 based on the phase-adjusted frequency-domain left signal ($L_{fr}(b)$) 230 and the phase-adjusted frequency-domain right signal ($R_{fr}(b)$) 232. The frequency-domain side-band signal ($S_{fr}(b)$) 234 may be expressed as (l(fr)−r(fr))/2, where l(fr) includes the phase-adjusted frequency-domain left signal ($L_{fr}(b)$) 230 and r(fr) includes the phase-adjusted frequency-domain right signal ($R_{fr}(b)$) 232. The frequency-domain side-band signal ($S_{fr}(b)$) 234 may be provided to the side-band encoder 210.

The mid-band signal generator 212 may receive the interchannel temporal mismatch value 163 from the interchannel temporal mismatch analyzer 124, the frequency-domain left signal ($L_{fr}(b)$) 230 from the transformer 202, the frequency-domain right signal ($R_{fr}(b)$) 232 from the transformer 204, the stereo-cues bitstream 162 from the stereo-cues estimator 206, or a combination thereof. The mid-band signal generator 212 may generate the phase-adjusted frequency-domain left signal ($L_{fr}(b)$) 230 and the phase-adjusted frequency-domain right signal ($R_{fr}(b)$) 232, as described with reference to the side-band signal generator 208. The mid-band signal generator 212 may generate a frequency-domain mid-band signal ($M_{fr}(b)$) 236 based on the phase-adjusted frequency-domain left signal ($L_{fr}(b)$) 230 and the phase-adjusted frequency-domain right signal ($R_{fr}(b)$) 232. The frequency-domain mid-band signal ($M_{fr}(b)$) 236 may be expressed as (l(t)+r(t)/2, where l(t) includes the phase-adjusted frequency-domain left signal ($L_{fr}(b)$) 230 and r(t) includes the phase-adjusted frequency-domain right signal ($R_{fr}(b)$) 232. The frequency-domain mid-band signal ($M_{fr}(b)$) 236 may be provided to the side-band encoder 210. The frequency-domain mid-band signal ($M_{fr}(b)$) 236 may be also provided to the mid-band encoder 214.

In a particular aspect, the mid-band signal generator 212 selects a frame core type 267, a frame coder type 269, or both, to be used to encode the frequency-domain mid-band signal ($M_{fr}(b)$) 236. For example, the mid-band signal generator 212 may select an algebraic code-excited linear prediction (ACELP) core type, a transform coded excitation (TCX) core type, or another core type as the frame core type 267. To illustrate, the mid-band signal generator 212 may, in response to determining that the speech/music classifier 129 indicates that the frequency-domain mid-band signal ($M_{fr}(b)$) 236 corresponds to speech, select the ACELP core type as the frame core type 267. Alternatively, the mid-band signal generator 212 may, in response to determining that the speech/music classifier 129 indicates that the frequency-domain mid-band signal ($M_{fr}(b)$) 236 corresponds to non-speech (e.g., music), select the TCX core type as the frame core type 267.

The LB analyzer 157 is configured to determine the LB parameters 159 of FIG. 1. The LB parameters 159 correspond to the time-domain left signal ($L_t$) 290, the time-domain right signal ($R_t$) 292, or both. In a particular example, the LB parameters 159 include a core sample rate. In a particular aspect, the LB analyzer 157 is configured to determine the core sample rate based on the frame core type 267. For example, the LB analyzer 157 is configured to select a first sample rate (e.g., 12.8 kHz) as the core sample rate in response to determining that the frame core type 267 corresponds to the ACELP core type. Alternatively, the LB analyzer 157 is configured to select a second sample rate (e.g., 16 kHz) as the core sample rate in response to determining that the frame core type 267 corresponds to a non-ACELP core type (e.g., the TCX core type). In an alternate aspect, the LB analyzer 157 is configured to determine the core sample rate based on a default value, a user input, a configuration setting, or a combination thereof.

In a particular aspect, the LB parameters 159 include a pitch value, a voice activity parameter, a voicing factor, or a combination thereof. The pitch value may be indicative of a differential pitch period or an absolute pitch period corresponding to the time-domain left signal ($L_t$) 290, the time-domain right signal ($R_t$) 292, or both. The voice activity parameter may be indicative of whether speech is detected in the time-domain left signal ($L_t$) 290, the time-domain right signal ($R_t$) 292, or both. The voicing factor (e.g., a value from 0.0 to 1.0) indicates a voiced/unvoiced nature (e.g., strongly voiced, weakly voiced, weakly unvoiced, or strongly unvoiced) of the time-domain left signal ($L_t$) 290, the time-domain right signal ($R_t$) 292, or both.

The BWE analyzer 153 is configured to determine the BWE parameters 155 based on the time-domain left signal ($L_t$) 290, the time-domain right signal ($R_t$) 292, or both. The BWE parameters 155 include a gain mapping parameter, a spectral mapping parameter, an interchannel BWE reference channel indicator, or a combination thereof. For example, the BWE analyzer 153 is configured to determine the gain mapping parameter based on a comparison of a high-band signal and a synthesized high-band signal. In a particular aspect, the high-band signal and the synthesized high-band signal correspond to the time-domain left signal ($L_t$) 290. In a particular aspect, the high-band signal and the synthesized high-band signal correspond to the time-domain right signal ($R_t$) 292. In a particular example, the BWE analyzer 153 is configured to determine the spectral mapping parameter based on a comparison of the high-band signal and the synthesized high-band signal. To illustrate, the BWE analyzer 153 is configured to generate a gain-adjusted synthesized signal by applying the gain parameter to the synthesized high-band signal, and to generate the spectral mapping parameter based on a comparison of the gain-adjusted synthesized signal and the high-band signal. The spectral mapping parameter is indicative of a spectral tilt.

The mid-band signal generator 212 may, in response to determining that the speech/music classifier 129 indicates that the frequency-domain mid-band signal ($M_{fr}(b)$) 236 corresponds to speech, select a general signal coding (GSC) coder type or a non-GSC coder type as the frame coder type 269. For example, the mid-band signal generator 212 may select the non-GSC coder type (e.g., modified discrete cosine transform (MDCT)) in response to determining that the frequency-domain mid-band signal ($M_{fr}(b)$) 236 corresponds to high spectral sparseness (e.g., higher than a sparseness threshold). Alternatively, the mid-band signal generator 212 may select the GSC coder type in response to determining that the frequency-domain mid-band signal ($M_{fr}(b)$) 236 corresponds to a non-sparse spectrum (e.g., lower than the sparseness threshold).

The mid-band signal generator 212 may provide the frequency-domain mid-band signal ($M_{fr}(b)$) 236 to the mid-band encoder 214 for encoding based on the frame core type 267, the frame coder type 269, or both. The frame core type 267, the frame coder type 269, or both, may be associated with a first frame of the frequency-domain mid-band signal ($M_{fr}(b)$) 236 that is to be encoded by the mid-band encoder 214. The frame core type 267 may be stored in a memory as a previous frame core type 268. The frame coder type 269 may be stored in the memory as a previous frame coder type 270. The stereo-cues estimator 206 may use the previous frame core type 268, the previous frame coder type 270, or both to determine the stereo-cues bitstream 162 with respect to a second frame of the frequency-domain mid-band signal ($M_{fr}(b)$) 236, as described with reference to FIG. 4. It should be understood that grouping of various components in the drawings is for ease of illustration and is non-limiting. For example, the speech/music classifier 129 may be included in any component along the mid-signal generation path. To illustrate, the speech/music classifier 129 may be included in the mid-band signal generator 212. The mid-band signal generator 212 may generate a speech/music decision parameter. The speech/music decision parameter may be stored in the memory as the speech/music decision parameter 171 of FIG. 1. The stereo-cues estimator 206 is configured to use the speech/music decision parameter 171, the LB parameters 159, the BWE parameters 155, or a combination thereof, to determine the stereo-cues bitstream 162 with respect to the second frame of the frequency-domain mid-band signal ($M_{fr}(b)$) 236, as described with reference to FIG. 4.

The side-band encoder 210 may generate the side-band bitstream 164 based on the stereo-cues bitstream 162, the frequency-domain side-band signal ($S_{fr}(b)$) 234, and the frequency-domain mid-band signal ($M_{fr}(b)$) 236. The mid-band encoder 214 may generate the mid-band bitstream 166 by encoding the frequency-domain mid-band signal ($M_{fr}(b)$) 236. In particular examples, the side-band encoder 210 and the mid-band encoder 214 may include ACELP encoders, TCX encoders, or both, to generate the side-band bitstream 164 and the mid-band bitstream 166, respectively. For lower bands, the frequency-domain side-band signal ($S_{fr}(b)$) 334 may be encoded using a transform-domain coding technique. For higher bands, the frequency-domain side-band signal ($S_{fr}(b)$) 234 may be expressed as a prediction from the previous frame's mid-band signal (either quantized or unquantized).

The mid-band encoder 214 may transform the frequency-domain mid-band signal ($M_{fr}(b)$) 236 to any other transform/time-domain before encoding. For example, the frequency-domain mid-band signal ($M_{fr}(b)$) 236 may be inverse-transformed back to the time-domain, or transformed to MDCT domain for coding.

FIG. 2 thus illustrates an example of the encoder 114 in which the core type and/or coder type of a previously encoded frame are used to determine an IPD mode, and thus determine a resolution of the IPD values in the stereo-cues bitstream 162. In an alternative aspect, the encoder 114 uses predicted core and/or coder types rather than values from previous frame. For example, FIG. 3 depicts an illustrative example of the encoder 114 in which the stereo-cues estimator 206 can determine the stereo-cues bitstream 162 based on a predicted core type 368, a predicted coder type 370, or both.

The encoder 114 includes a downmixer 320 couple to a pre-processor 318. The pre-processor 318 is coupled, via a multiplexer (MUX) 316, to the stereo-cues estimator 206. The downmixer 320 may generate an estimated time-domain mid-band signal ($M_t$) 396 by downmixing the time-domain left signal ($L_t$) 290 and the time-domain right signal ($R_t$) 292 based on the interchannel temporal mismatch value 163. For example, the downmixer 320 may generate the adjusted time-domain left signal ($L_t$) 290 by adjusting the time-domain left signal ($L_t$) 290 based on the interchannel temporal mismatch value 163, as described with reference to FIG. 2. The downmixer 320 may generate the estimated time-domain mid-band signal ($M_t$) 396 based on the adjusted time-domain left signal ($L_t$) 290 and the time-domain right signal ($R_t$) 292. The estimated time-domain mid-band signal ($M_t$) 396 may be expressed as (l(t)+r(t)/2, where l(t) includes the adjusted time-domain left signal ($L_t$) 290 and r(t) includes the time-domain right signal ($R_t$) 292. As another example, the downmixer 320 may generate the adjusted time-domain right signal ($R_t$) 292 by adjusting the time-domain right signal ($R_t$) 292 based on the interchannel temporal mismatch value 163, as described with reference to FIG. 2. The downmixer 320 may generate the estimated time-domain mid-band signal ($M_t$) 396 based on the time-domain left signal ($L_t$) 290 and the adjusted time-domain right signal ($R_t$) 292. The estimated time-domain mid-band signal ($M_t$) 396 may be expressed as (l(t)+r(t))/2, where l(t) includes the time-domain left signal ($L_t$) 290 and r(t) includes the adjusted time-domain right signal ($R_t$) 292.

Alternatively, the downmixer 320 may operate in the frequency domain rather than in the time domain. To illustrate, the downmixer 320 may generate an estimated frequency-domain mid-band signal $M_{fr}(b)$ 336 by downmixing the frequency-domain left signal ($L_{fr}(b)$) 229 and the frequency-domain right signal ($R_{fr}(b)$) 231 based on the interchannel temporal mismatch value 163. For example, the downmixer 320 may generate the frequency-domain left signal ($L_{fr}(b)$) 230 and the frequency-domain right signal ($R_{fr}(b)$) 232 based on the interchannel temporal mismatch value 163, as described with reference to FIG. 2. The downmixer 320 may generate the estimated frequency-domain mid-band signal $M_{fr}(b)$ 336 based on the frequency-domain left signal ($L_{fr}(b)$) 230 and the frequency-domain right signal ($R_{fr}(b)$) 232. The estimated frequency-domain mid-band signal $M_{fr}(b)$ 336 may be expressed as (l(t)+r(t)/2, where l(t) includes the frequency-domain left signal ($L_{fr}(b)$) 230 and r(t) includes the frequency-domain right signal ($R_{fr}(b)$) 232.

The downmixer 320 may provide the estimated time-domain mid-band signal ($M_t$) 396 (or the estimated frequency-domain mid-band signal $M_{fr}(b)$ 336) to the pre-processor 318. The pre-processor 318 may determine a predicted core type 368, a predicted coder type 370, or both, based on a mid-band signal, as described with reference to the mid-band signal generator 212. For example, the pre-processor 318 may determine the predicted core type 368, the predicted coder type 370, or both, based on a speech/music classification of the mid-band signal, a spectral sparseness of the mid-band signal, or both. In a particular aspect, the pre-processor 318 determines a predicted speech/music decision parameter based on a speech/music classification of the mid-band signal and determines the predicted core type 368, the predicted coder type 370, or both, based on the predicted speech/music decision parameter, a spectral sparseness of the mid-band signal, or both. The mid-band signal may include the estimated time-domain mid-band signal ($M_t$) 396 (or the estimated frequency-domain mid-band signal $M_{fr}$(b) 336).

The pre-processor 318 may provide the predicted core type 368, the predicted coder type 370, the predicted speech/music decision parameter, or a combination thereof, to the MUX 316. The MUX 316 may select between outputting, to the stereo-cues estimator 206, predicted coding information (e.g., the predicted core type 368, the predicted coder type 370, the predicted speech/music decision parameter, or a combination thereof) or previous coding information (e.g., the previous frame core type 268, the previous frame coder type 270, a previous frame speech/music decision parameter, or a combination thereof) associated with a previously encoded frame of the frequency-domain mid-band signal $M_{fr}$(b) 236. For example, the MUX 316 may select between the predicted coding information or the previous coding information based on a default value, a value corresponding to a user input, or both.

Providing the previous coding information (e.g., the previous frame core type 268, the previous frame coder type 270, the previous frame speech/music decision parameter, or a combination thereof) to the stereo-cues estimator 206, as described with reference to FIG. 2, may conserve resources (e.g., time, processing cycles, or both) that would be used to determine the predicted coding information (e.g., the predicted core type 368, the predicted coder type 370, the predicted speech/music decision parameter, or a combination thereof). Conversely, when there is high frame-to-frame variation in characteristics of the first audio signal 130 and/or the second audio signal 132, the predicted coding information (e.g., the predicted core type 368, the predicted coder type 370, the predicted speech/music decision parameter, or a combination thereof) may correspond more accurately with the core type, the coder type, the speech/music decision parameter, or a combination thereof, selected by the mid-band signal generator 212. Thus, dynamically switching between outputting the previous coding information or the predicted coding information to the stereo-cues estimator 206 (e.g., based on an input to the MUX 316) may enable balancing resource usage and accuracy.

Figure 4:
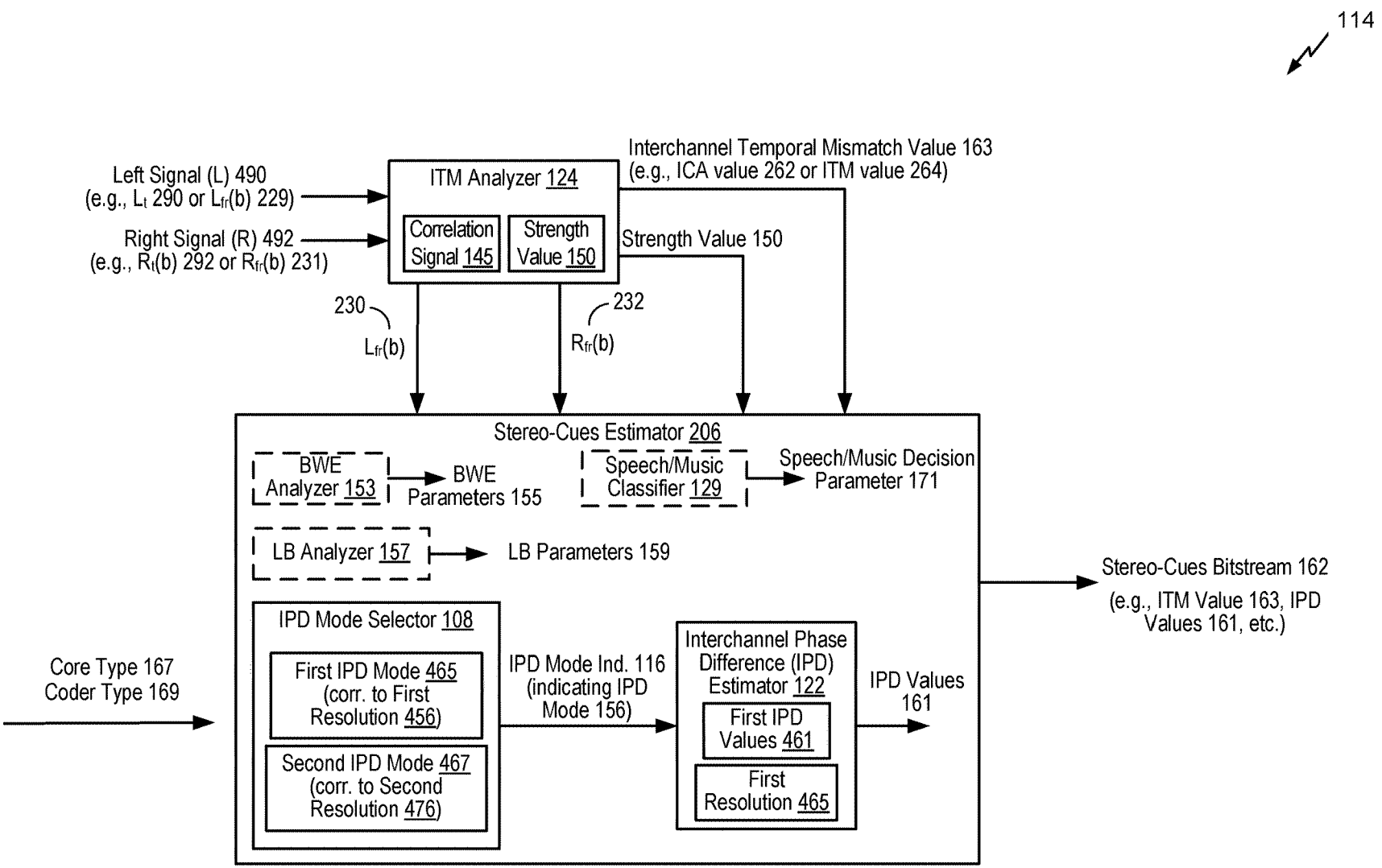
FIG. 4 is a of particular illustrative aspects of the encoder of FIG. 1.

Referring to FIG. 4, an illustrative example of the stereo-cues estimator 206 is shown. The stereo-cues estimator 206 may be coupled to the interchannel temporal mismatch analyzer 124, which may determine a correlation signal 145 based on a comparison of a first frame of a left signal (L) 490 and a plurality of frames of a right signal (R) 492. In a particular aspect, the left signal (L) 490 corresponds to the time-domain left signal ($L_t$) 290, whereas the right signal (R) 492 corresponds to the time-domain right signal ($R_t$) 292. In an alternative aspect, the left signal (L) 490 corresponds to the frequency-domain left signal ($L_{fr}$(b)) 229, whereas the right signal (R) 492 corresponds to the frequency-domain right signal ($R_{fr}$(b)) 231.

Each of the plurality of frames of the right signal (R) 492 may correspond to a particular interchannel temporal mismatch value. For example, a first frame of the right signal (R) 492 may correspond to the interchannel temporal mismatch value 163. The correlation signal 145 may indicate a correlation between the first frame of the left signal (L) 490 and each of the plurality of frames of the right signal (R) 492.

Alternatively, the interchannel temporal mismatch analyzer 124 may determine the correlation signal 145 based on a comparison of a first frame of the right signal (R) 492 and a plurality of frames of the left signal (L) 490. In this aspect, each of the plurality of frames of the left signal (L) 490 correspond to a particular interchannel temporal mismatch value. For example, a first frame of the left signal (L) 490 may correspond to the interchannel temporal mismatch value 163. The correlation signal 145 may indicate a correlation between the first frame of the right signal (R) 492 and each of the plurality of frames of the left signal (L) 490.

The interchannel temporal mismatch analyzer 124 may select the interchannel temporal mismatch value 163 based on determining that the correlation signal 145 indicates a highest correlation between the first frame of the left signal (L) 490 and the first frame of the right signal (R) 492. For example, the interchannel temporal mismatch analyzer 124 may select the interchannel temporal mismatch value 163 in response to determining that a peak of the correlation signal 145 corresponds to the first frame of the right signal (R) 492. The interchannel temporal mismatch analyzer 124 may determine a strength value 150 indicating a level of correlation between the first frame of the left signal (L) 490 and the first frame of the right signal (R) 492. For example, the strength value 150 may correspond to a height of the peak of the correlation signal 145. The interchannel temporal mismatch value 163 may correspond to the ICA value 262 when the left signal (L) 490 and the right signal (R) 492 are time-domain signals, such as the time-domain left signal ($L_t$) 290 and the time-domain right signal ($R_t$) 292, respectively. Alternatively, the interchannel temporal mismatch value 163 may correspond to the ITM value 264 when the left signal (L) 490 and the right signal (R) 492 are frequency-domain signals, such as the frequency-domain left signal ($L_{fr}$) 229 and the frequency-domain right signal ($R_{fr}$) 231, respectively. The interchannel temporal mismatch analyzer 124 may generate the frequency-domain left signal ($L_{fr}$(b)) 230 and the frequency-domain right signal ($R_{fr}$(b)) 232 based on the left signal (L) 490, the right signal (R) 492, and the interchannel temporal mismatch value 163, as described with reference to FIG. 2. The interchannel temporal mismatch analyzer 124 may provide the frequency-domain left signal ($L_{fr}$(b)) 230, the frequency-domain right signal ($R_{fr}$(b)) 232, the interchannel temporal mismatch value 163, the strength value 150, or a combination thereof, to the stereo-cues estimator 206.

The speech/music classifier 129 may generate the speech/music decision parameter 171 based on the frequency-domain left signal ($L_{fr}$) 230 (or the frequency-domain right signal ($R_{fr}$) 232) using various speech/music classification techniques. For example, the speech/music classifier 129 may determine linear prediction coefficients (LPCs) associated with the frequency-domain left signal ($L_{fr}$) 230 (or the frequency-domain right signal ($R_{fr}$) 232). The speech/music classifier 129 may generate a residual signal by inverse-filtering the frequency-domain left signal ($L_{fr}$) 230 (or the frequency-domain right signal ($R_{fr}$) 232) using the LPCs and may classify the frequency-domain left signal ($L_{fr}$) 230 (or the frequency-domain right signal ($R_{fr}$) 232) as speech or music based on determining whether residual energy of the residual signal satisfies a threshold. The speech/music decision parameter 171 may indicate whether the frequency-domain left signal ($L_{fr}$) 230 (or the frequency-domain right signal ($R_{fr}$) 232) is classified as speech or music. In a particular aspect, the stereo-cues estimator 206 receives the speech/music decision parameter 171 from the mid-band signal generator 212, as described with reference to FIG. 2, where the speech/music decision parameter 171 corresponds to a previous frame speech/music decision parameter. In another aspect, the stereo-cues estimator 206 receives the speech/music decision parameter 171 from the MUX 316, as described with reference to FIG. 3, where the speech/music decision parameter 171 corresponds to the previous frame speech/music decision parameter or a predicted speech/music decision parameter.

The LB analyzer 157 is configured to determine the LB parameters 159. For example, the LB analyzer 157 is configured to determine a core sample rate, a pitch value, a voice activity parameter, a voicing factor, or a combination thereof, as described with reference to FIG. 2. The BWE analyzer 153 is configured to determine the BWE parameters 155, as described with reference to FIG. 2.

The IPD mode selector 108 may select the IPD mode 156 from a plurality of IPD modes based on the interchannel temporal mismatch value 163, the strength value 150, the core type 167, the coder type 169, the speech/music decision parameter 171, the LB parameters 159, the BWE parameters 155, or a combination thereof. The core type 167 may correspond to the previous frame core type 268 of FIG. 2 or the predicted core type 368 of FIG. 3. The coder type 169 may correspond to the previous frame coder type 270 of FIG. 2 or the predicted coder type 370 of FIG. 3. The plurality of IPD modes may include a first IPD mode 465 corresponding to a first resolution 456, a second IPD mode 467 corresponding to a second resolution 476, one or more additional IPD modes, or a combination thereof. The first resolution 456 may be higher than the second resolution 476. For example, the first resolution 456 may correspond to a higher number of bits than a second number of bits corresponding to the second resolution 476.

Some illustrative non-limiting examples of IPD mode selections are described below. It should be understood that the IPD mode selector 108 may select the IPD mode 156 based on any combination of factors including, but not limited to, the interchannel temporal mismatch value 163, the strength value 150, the core type 167, the coder type 169, the LB parameters 159, the BWE parameters 155, and/or the speech/music decision parameter 171. In a particular aspect, the IPD mode selector 108 selects the first IPD mode 465 as the IPD mode 156 when the interchannel temporal mismatch value 163, the strength value 150, the core type 167, the LB parameters 159, the BWE parameters 155, the coder type 169, or the speech/music decision parameter 171 indicate that the IPD values 161 are likely to have a greater impact on audio quality.

In a particular aspect, the IPD mode selector 108 selects the first IPD mode 465 as the IPD mode 156 in response to a determination that the interchannel temporal mismatch value 163 satisfies (e.g., is equal to) a difference threshold (e.g., 0). The IPD mode selector 108 may determine that the IPD values 161 are likely to have a greater impact on audio quality in response to a determination that the interchannel temporal mismatch value 163 satisfies (e.g., is equal to) a difference threshold (e.g., 0). Alternatively, the IPD mode selector 108 may select the second IPD mode 467 as the IPD mode 156 in response to determining that the interchannel temporal mismatch value 163 fails to satisfy (e.g., is not equal to) the difference threshold (e.g., 0).

In a particular aspect, the IPD mode selector 108 selects the first IPD mode 465 as the IPD mode 156 in response to a determination that the interchannel temporal mismatch value 163 fails to satisfy (e.g., is not equal to) the difference threshold (e.g., 0) and that the strength value 150 satisfies (e.g., is greater than) a strength threshold. The IPD mode selector 108 may determine that the IPD values 161 are likely to have a greater impact on audio quality in response to determining that the interchannel temporal mismatch value 163 fails to satisfy (e.g., is not equal to) the difference threshold (e.g., 0) and that the strength value 150 satisfies (e.g., is greater than) a strength threshold. Alternatively, the IPD mode selector 108 may select the second IPD mode 467 as the IPD mode 156 in response to a determination that the interchannel temporal mismatch value 163 fails to satisfy (e.g., is not equal to) the difference threshold (e.g., 0) and that the strength value 150 fails to satisfy (e.g., is less than or equal to) the strength threshold.

In a particular aspect, the IPD mode selector 108 determines that the interchannel temporal mismatch value 163 satisfies the difference threshold in response to determining that the interchannel temporal mismatch value 163 is less than the difference threshold (e.g., a threshold value). In this aspect, the IPD mode selector 108 determines that the interchannel temporal mismatch value 163 fails to satisfy the difference threshold in response to determining that the interchannel temporal mismatch value 163 is greater than or equal to the difference threshold.

In a particular aspect, the IPD mode selector 108 selects the first IPD mode 465 as the IPD mode 156 in response to determining that the coder type 169 corresponds to a non-GSC coder type. The IPD mode selector 108 may determine that the IPD values 161 are likely to have a greater impact on audio quality in response to determining that the coder type 169 corresponds to a non-GSC coder type. Alternatively, the IPD mode selector 108 may select the second IPD mode 467 as the IPD mode 156 in response to determining that the coder type 169 corresponds to a GSC coder type.

In a particular aspect, the IPD mode selector 108 selects the first IPD mode 465 as the IPD mode 156 in response to determining that the core type 167 corresponds to a TCX core type or that the core type 167 corresponds to an ACELP core type and that the coder type 169 corresponds to a non-GSC coder type. The IPD mode selector 108 may determine that the IPD values 161 are likely to have a greater impact on audio quality in response to determining that the core type 167 corresponds to a TCX core type or that the core type 167 corresponds to an ACELP core type and that the coder type 169 corresponds to a non-GSC coder type. Alternatively, the IPD mode selector 108 may select the second IPD mode 467 as the IPD mode 156 in response to determining that the core type 167 corresponds to the ACELP core type and that the coder type 169 corresponds to a GSC coder type.

In a particular aspect, the IPD mode selector 108 selects the first IPD mode 465 as the IPD mode 156 in response to determining that the speech/music decision parameter 171 indicates that the frequency-domain left signal ($L_{fr}$) 230 (or the frequency-domain right signal ($R_{fr}$) 232) is classified as non-speech (e.g., music). The IPD mode selector 108 may determine that the IPD values 161 are likely to have a greater impact on audio quality in response to determining that the speech/music decision parameter 171 indicates that the frequency-domain left signal ($L_{fr}$) 230 (or the frequency-domain right signal ($R_{fr}$) 232) is classified as non-speech (e.g., music). Alternatively, the IPD mode selector 108 may select the second IPD mode 467 as the IPD mode 156 in response to determining that the speech/music decision parameter 171 indicates that the frequency-domain left signal ($L_{fr}$) 230 (or the frequency-domain right signal ($R_{fr}$) 232) is classified as speech.

In a particular aspect, the IPD mode selector 108 selects the first IPD mode 465 as the IPD mode 156 in response to determining that the LB parameters 159 include a core sample rate and that the core sample rate corresponds to a first core sample rate (e.g., 16 kHz). The IPD mode selector 108 may determine that the IPD values 161 are likely to have a greater impact on audio quality in response to determining that the core sample rate corresponds to the first core sample rate (e.g., 16 kHz). Alternatively, the IPD mode selector 108 may select the second IPD mode 467 as the IPD mode 156 in response to determining that the core sample rate corresponds to a second core sample rate (e.g., 12.8 kHz).

In a particular aspect, the IPD mode selector 108 selects the first IPD mode 465 as the IPD mode 156 in response to determining that the LB parameters 159 include a particular parameter and that a value of the particular parameter satisfies a first threshold. The particular parameter may include a pitch value, a voicing parameter, a voicing factor, a gain mapping parameter, a spectral mapping parameter, or an interchannel BWE reference channel indicator. The IPD mode selector 108 may determine that the IPD values 161 are likely to have a greater impact on audio quality in response to determining that the particular parameter satisfies the first threshold. Alternatively, the IPD mode selector 108 may select the second IPD mode 467 as the IPD mode 156 in response to determining that the particular parameter fails to satisfy the first threshold.

Table 1 below provides a summary of the above-described illustrative aspects of selecting the IPD mode 156. It is to be understood, however, that the described aspects are not to be considered limiting. In alternative implementations, the same set of conditions shown in a row of Table 1 may lead the IPD mode selector 108 to select a different IPD mode than the one shown in Table 1. Moreover, in alternative implementations, more, fewer, and/or different factors may be considered. Further, decision tables may include more or fewer rows in alternative implementations.

TABLE 1

| Input(s) | | | | |
|---|---|---|---|---|
| Interchannel Temporal Mismatch Value 163 | Coder Type 169 | Core Type 167 | Strength Value 150 | Selected Mode IPD Mode 156 |
| 0 | GSC | ACELP | Any strength | Low Res or Zero IPD |
| 0 | Non GSC | ACELP | Any strength | High Res |
| 0 | Coder Type not applicable | TCX | Any strength | High Res |
| Non Zero | Any coder type | Any core | High | Zero IPD |
| Non Zero | Any coder type | Any core | Low | Low Res IPD |

The IPD mode selector 108 may provide the IPD mode indicator 116 indicating the selected IPD mode 156 (e.g., the first IPD mode 465 or the second IPD mode 467) to the IPD estimator 122. In a particular aspect, the second resolution 476 associated with the second IPD mode 467 has a particular value (e.g., 0) indicating that the IPD values 161 are to be set to a particular value (e.g., 0), that each of the IPD values 161 is to be set to a particular value (e.g., zero), or that the IPD values 161 are to be absent from the stereo-cues bitstream 162. The first resolution 456 associated with the first IPD mode 465 may have another value (e.g., greater than 0) that is distinct from the particular value (e.g., 0). In this aspect, the IPD estimator 122, in response to determining that the selected IPD mode 156 corresponds to the second IPD mode 467, sets the IPD values 161 to the particular value (e.g., zero), sets each of the IPD values 161 to the particular value (e.g., zero), or refrains from including the IPD values 161 in the stereo-cues bitstream 162. Alternatively, the IPD estimator 122 may determine first IPD values 461 in response to determining that the selected IPD mode 156 corresponds to the first IPD mode 465, as described herein.

The IPD estimator 122 may determine first IPD values 461 based on the frequency-domain left signal ($L_{fr}(b)$) 230, the frequency-domain right signal ($R_{fr}(b)$) 232, the interchannel temporal mismatch value 163, or a combination thereof. The IPD estimator 122 may generate a first aligned signal and a second aligned signal by adjusting at least one of the left signal (L) 490 or the right signal (R) 492 based on the interchannel temporal mismatch value 163. The first aligned signal may be temporally aligned with the second aligned signal. For example, a first frame of the first aligned signal may correspond to the first frame of the left signal (L) 490 and a first frame of the second aligned signal may correspond to the first frame of the right signal (R) 492. The first frame of the first aligned signal may be aligned with the first frame of the second aligned signal.

The IPD estimator 122 may determine, based on the interchannel temporal mismatch value 163, that one of the left signal (L) 490 or the right signal (R) 492 corresponds to a temporally lagging channel. For example, the IPD estimator 122 may determine that the left signal (L) 490 corresponds to the temporally lagging channel in response to determining that the interchannel temporal mismatch value 163 fails to satisfy (e.g., is less than) a particular threshold (e.g., 0). The IPD estimator 122 may non-causally adjust the temporally lagging channel. For example, the IPD estimator 122 may generate an adjusted signal by non-causally adjusting the left signal (L) 490 based on the interchannel temporal mismatch value 163 in response to determining that the left signal (L) 490 corresponds to the temporally lagging channel. The first aligned signal may correspond to the adjusted signal, and the second aligned signal may correspond to the right signal (R) 492 (e.g., non-adjusted signal).

In a particular aspect, the IPD estimator 122 generates the first aligned signal (e.g., a first phase rotated frequency-domain signal) and the second aligned signal (e.g., a second phase rotated frequency-domain signal) by performing a phase rotation operation in the frequency domain. For example, the IPD estimator 122 may generate the first aligned signal by performing a first transform on the left signal (L) 490 (or the adjusted signal). In a particular aspect, the IPD estimator 122 generates the second aligned signal by performing a second transform on the right signal (R) 492. In an alternate aspect, the IPD estimator 122 designates the right signal (R) 492 as the second aligned signal.

The IPD estimator 122 may determine the first IPD values 461 based on the first frame of the left signal (L) 490 (or the first aligned signal) and the first frame of the right signal (R) 492 (or the second aligned signal). The IPD estimator 122 may determine a correlation signal associated with each of a plurality of frequency subbands. For example, a first correlation signal may be based on a first subband of the first frame of the left signal (L) 490 and a plurality of phase shifts applied to the first subband of the first frame of the right signal (R) 492. Each of the plurality of phase shifts may correspond to a particular IPD value. The IPD estimator 122 may determine that first correlation signal indicates that the first subband of the left signal (L) 490 has a highest correlation with the first subband of the first frame of the right signal (R) 492 when a particular phase shift is applied to the first subband of the first frame of the right signal (R) 492. The particular phase shift may correspond to a first IPD value. The IPD estimator 122 may add the first IPD value associated with the first subband to the first IPD values 461.

Similarly, the IPD estimator 122 may add one or more additional IPD values corresponding to one or more additional subbands to the first IPD values 461. In a particular aspect, each of the subbands associated with the first IPD values 461 is distinct. In an alternative aspect, some subbands associated with the first IPD values 461 overlap. The first IPD values 461 may be associated with a first resolution 456 (e.g., a highest available resolution). The frequency subbands considered by the IPD estimator 122 may be of the same size or may be of different sizes.

In a particular aspect, the IPD estimator 122 generates the IPD values 161 by adjusting the first IPD values 461 to have the resolution 165 corresponding to the IPD mode 156. In a particular aspect, the IPD estimator 122, in response to determining that the resolution 165 is greater than or equal to the first resolution 456, determines that the IPD values 161 are the same as the first IPD values 461. For example, the IPD estimator 122 may refrain from adjusting the first IPD values 461. Thus, when the IPD mode 156 corresponds to a resolution (e.g., a high resolution) that is sufficient to represent the first IPD values 461, the first IPD values 461 may be transmitted without adjustment. Alternatively, the IPD estimator 122 may, in response to determining that the resolution 165 is less than the first resolution 456, generate the IPD values 161 may reducing the resolution of the first IPD values 461. Thus, when the IPD mode 156 corresponds to a resolution (e.g., a low resolution) that is insufficient to represent the first IPD values 461, the first IPD values 461 may be adjusted to generate the IPD values 161 before transmission.

In a particular aspect, the resolution 165 indicates a number of bits to be used to represent absolute IPD values, as described with reference to FIG. 1. The IPD values 161 may include one or more of absolute values of the first IPD values 461. For example, the IPD estimator 122 may determine a first value of the IPD values 161 based on an absolute value of a first value of the first IPD values 461. The first value of the IPD values 161 may be associated with the same frequency band as the first value of the first IPD values 461.

In a particular aspect, the resolution 165 indicates a number of bits to be used to represent an amount of temporal variance of IPD values across frames, as described with reference to FIG. 1. The IPD estimator 122 may determine the IPD values 161 based on a comparison of the first IPD values 461 and second IPD values. The first IPD values 461 may be associated with a particular audio frame and the second IPD values may be associated with another audio frame. The IPD values 161 may indicate the amount of temporal variance between the first IPD values 461 and the second IPD values.

Some illustrative non-limiting examples of reducing a resolution of IPD values are described below. It should be understood that various other techniques may be used to reduce a resolution of IPD values.

In a particular aspect, the IPD estimator 122 determines that the target resolution 165 of IPD values is less than the first resolution 456 of determined IPD values. That is, the IPD estimator 122 may determine that there are fewer bits available to represent IPDs than the number of bits that are occupied by IPDs that have been determined. In response, the IPD estimator 122 may generate a group IPD value by averaging the first IPD values 461 and may set the IPD values 161 to indicate the group IPD value. The IPD values 161 may thus indicate a single IPD value having a resolution (e.g., 3 bits) that is lower than the first resolution 456 (e.g., 24 bits) of multiple IPD values (e.g., 8).

In a particular aspect, the IPD estimator 122, in response to determining that the resolution 165 is less than the first resolution 456, determines the IPD values 161 based on predictive quantization. For example, the IPD estimator 122 may use a vector quantizer to determine predicted IPD values based on IPD values (e.g., the IPD values 161) corresponding to a previously encoded frame. The IPD estimator 122 may determine correction IPD values based on a comparison of the predicted IPD values and the first IPD values 461. The IPD values 161 may indicate the correction IPD values. Each of the IPD values 161 (corresponding to a delta) may have a lower resolution than the first IPD values 461. The IPD values 161 may thus have a lower resolution than the first resolution 456.

In a particular aspect, the IPD estimator 122, in response to determining that the resolution 165 is less than the first resolution 456, uses fewer bits to represent some of the IPD values 161 than others. For example, the IPD estimator 122 may reduce a resolution of a subset of the first IPD values 461 to generate a corresponding subset of the IPD values 161. The subset of the first IPD values 461 having lowered resolution may, in a particular example, correspond to particular frequency bands (e.g., higher frequency bands or lower frequency bands).

In a particular aspect, the IPD estimator 122, in response to determining that the resolution 165 is less than the first resolution 456, uses fewer bits to represent some of the IPD values 161 than others. For example, the IPD estimator 122 may reduce a resolution of a subset of the first IPD values 461 to generate a corresponding subset of the IPD values 161. The subset of the first IPD values 461 may correspond to particular frequency bands (e.g., higher frequency bands).

In a particular aspect, the resolution 165 corresponds to a count of the IPD values 161. The IPD estimator 122 may select a subset of the first IPD values 461 based on the count. For example, a size of the subset may be less than or equal to the count. In a particular aspect, the IPD estimator 122, in response to determining that a number of IPD values included in the first IPD values 461 is greater than the count, selects IPD values corresponding to particular frequency bands (e.g., higher frequency bands) from the first IPD values 461. The IPD values 161 may include the selected subset of the first IPD values 461.

In a particular aspect, the IPD estimator 122, in response to determining that the resolution 165 is less than the first resolution 456, determines the IPD values 161 based on polynomial coefficients. For example, the IPD estimator 122 may determine a polynomial (e.g., a best-fitting polynomial) that approximates the first IPD values 461. The IPD estimator 122 may quantize the polynomial coefficients to generate the IPD values 161. The IPD values 161 may thus have a lower resolution than the first resolution 456.

In a particular aspect, the IPD estimator 122, in response to determining that the resolution 165 is less than the first resolution 456, generates the IPD values 161 to include a subset of the first IPD values 461. The subset of the first IPD values 461 may correspond to particular frequency bands (e.g., high priority frequency bands). The IPD estimator 122 may generate one or more additional IPD values by reducing a resolution of a second subset of the first IPD values 461. The IPD values 161 may include the additional IPD values. The second subset of the first IPD values 461 may correspond to second particular frequency bands (e.g., medium priority frequency bands). A third subset of the first IPD values 461 may correspond to third particular frequency bands (e.g., low priority frequency bands). The IPD values 161 may exclude IPD values corresponding to the third particular frequency bands. In a particular aspect, frequency bands that have a higher impact on audio quality, such as lower frequency bands, have higher priority. In some examples, which frequency bands are higher priority may depend on the type of audio content included in the frame (e.g., based on the speech/music decision parameter 171). To illustrate, lower frequency bands may be prioritized for speech frames but may not be as prioritized for music frame, because speech data may be predominantly located in lower frequency ranges but music data may be more dispersed across frequency ranges.

The stereo-cues estimator 206 may generate the stereo-cues bitstream 162 indicating the interchannel temporal mismatch value 163, the IPD values 161, the IPD mode indicator 116, or a combination thereof. The IPD values 161 may have a particular resolution that is greater than or equal to the first resolution 456. The particular resolution (e.g., 3 bits) may correspond to the resolution 165 (e.g., low resolution) of FIG. 1 associated with the IPD mode 156.

The IPD estimator 122 may thus dynamically adjust a resolution of the IPD values 161 based on the interchannel temporal mismatch value 163, the strength value 150, the core type 167, the coder type 169, the speech/music decision parameter 171, or a combination thereof. The IPD values 161 may have a higher resolution when the IPD values 161 are predicted to have a greater impact on audio quality, and may have a lower resolution when the IPD values 161 are predicted to have less impact on audio quality.

Figure 5:
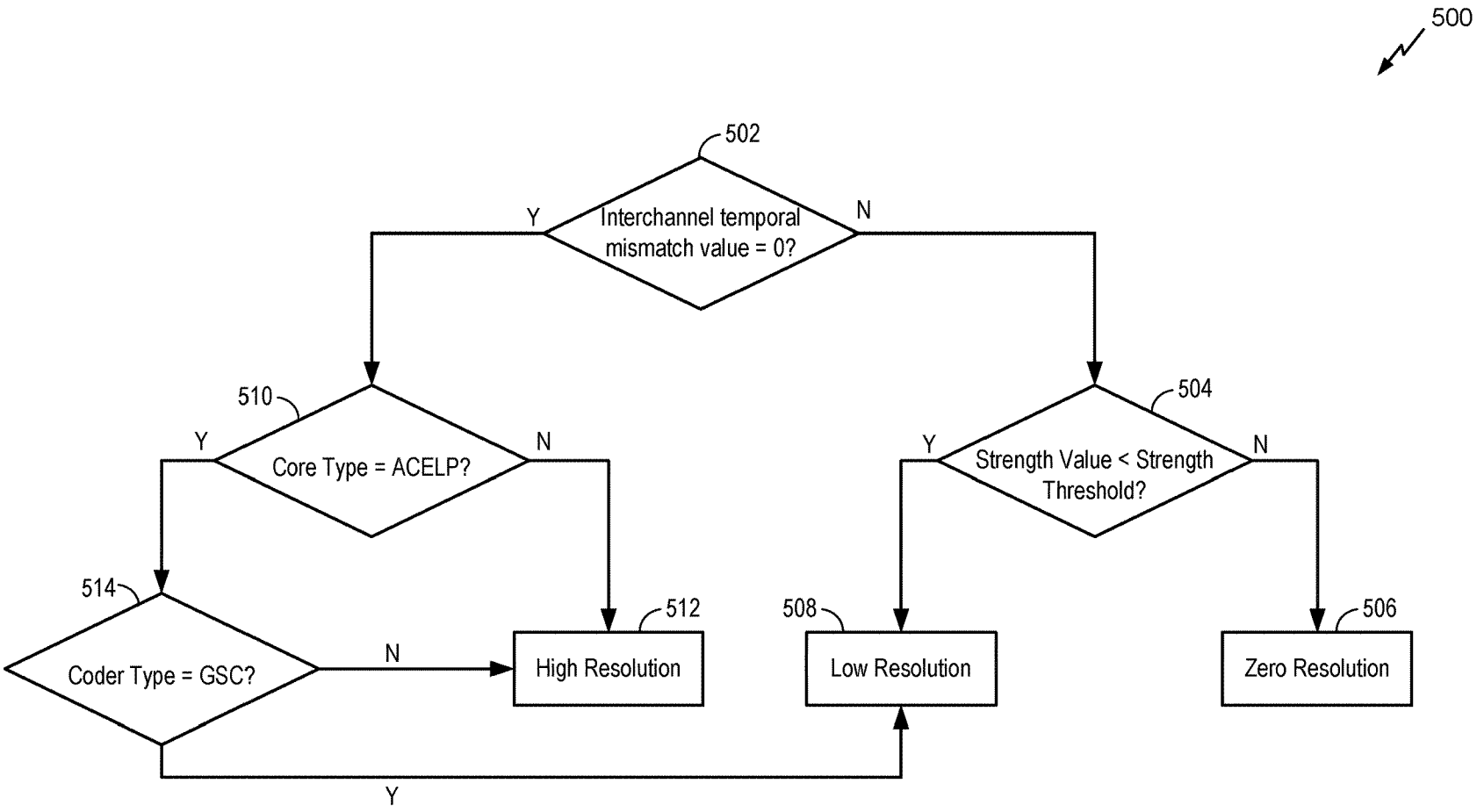
FIG. 5 is a flow chart illustrating a particular method of encoding interchannel phase differences.

Referring to FIG. 5, a method of operation is shown and generally designated 500. The method 500 may be performed by the IPD mode selector 108, the encoder 114, the first device 104, the system 100 of FIG. 1, or a combination thereof.

The method 500 includes determining whether an interchannel temporal mismatch value is equal to 0, at 502. For example, the IPD mode selector 108 of FIG. 1 may determine whether the interchannel temporal mismatch value 163 of FIG. 1 is equal to 0.

The method 500 also includes, in response to determining that the interchannel temporal mismatch is not equal to 0, determining whether a strength value is less than a strength threshold, at 504. For example, the IPD mode selector 108 of FIG. 1 may, in response to determining that the interchannel temporal mismatch value 163 of FIG. 1 is not equal to 0, determine whether the strength value 150 of FIG. 1 is less than a strength threshold.

The method 500 further includes, in response to determining that the strength value is greater than or equal to the strength threshold, selecting "zero resolution," at 506. For example, the IPD mode selector 108 of FIG. 1 may, in response to determining that the strength value 150 of FIG. 1 is greater than or equal to the strength threshold, select a first IPD mode as the IPD mode 156 of FIG. 1, where the first IPD mode corresponds to using zero bits of the stereo-cues bitstream 162 to represent IPD values.

In a particular aspect, the IPD mode selector 108 of FIG. 1 selects the first IPD mode as the IPD mode 156 in response to determining that the speech/music decision parameter 171 has a particular value (e.g., 1). For example, the IPD mode selector 108 selects the IPD mode 156 based on the following pseudo code:

```
hStereoDft→gainIPD_sm =0.5f * hStereoDft→gainIPD_sm + 0.5 *
    (gainIPD/hStereoDft→ipd_band_max); /* to decide on
    use of no IPD */
```

-continued

```
hStereoDft→no_ipd_flag = 0; /* Set flag initially to
zero – subband IPD */
if ( (hStereoDft→gainIPD_sm >= 0.75f || (hStereoDft→
    prev_no_ipd_flag && sp_aud_decision0)))
{
    hStereoDft → no_ipd_flag = 1 ; /* Set the flag */
}
```

where "hStereoDft→no_ipd_flag" corresponds to the IPD mode 156, a first value (e.g., 1) indicates a first IPD mode (e.g., a zero resolution mode or a low resolution mode), a second value (e.g., 0) indicates a second IPD mode (e.g., a high resolution mode), "hStereoDft→gainIPD_sm" corresponds to the strength value 150, and "sp_aud_decision0" corresponds to the speech/music decision parameter 171. The IPD mode selector 108 initializes the IPD mode 156 to a second IPD mode (e.g., 0) that corresponds to a high resolution (e.g., "hStereoDft→no_ipd_flag=0"). The IPD mode selector 108 sets the IPD mode 156 to the first IPD mode corresponding to zero resolution based at least in part on the speech/music decision parameter 171 (e.g., "sp_aud_decision0"). In a particular aspect, the IPD mode selector 108 is configured to select the first IPD mode as the IPD mode 156 in response to determining that the strength value 150 satisfies (e.g., is greater than or equal to) a threshold (e.g., 0.75 f), the speech/music decision parameter 171 has a particular value (e.g., 1), the core type 167 has a particular value, the coder type 169 has a particular value, one or more parameters (e.g., core sample rate, pitch value, voicing activity parameter, or voicing factor) of the LB parameters 159 have a particular value, one or more parameters (e.g., a gain mapping parameter, a spectral mapping parameter, or an interchannel reference channel indicator) of the BWE parameters 155 have a particular value, or a combination thereof.

The method 500 also includes, in response to determining that the strength value is less than the strength threshold, at 504, selecting a low resolution, at 508. For example, the IPD mode selector 108 of FIG. 1 may, in response to determining that the strength value 150 of FIG. 1 is less than the strength threshold, select a second IPD mode as the IPD mode 156 of FIG. 1, where the second IPD mode corresponds to using a low resolution (e.g., 3 bits) to represent IPD values in the stereo-cues bitstream 162. In a particular aspect, the IPD mode selector 108 is configured to select the second IPD mode as the IPD mode 156 in response to determining that the strength value 150 is less than the strength threshold, the speech/music decision parameter 171 has a particular value (e.g., 1), one or more of the LB parameters 159 have a particular value, one or more of the BWE parameters 155 have a particular value, or a combination thereof.

The method 500 further includes, in response to determining that the interchannel temporal mismatch is equal to 0, at 502, determining whether a core type corresponds to an ACELP core type, at 510. For example, the IPD mode selector 108 of FIG. 1 may, in response to determining that the interchannel temporal mismatch value 163 of FIG. 1 is equal to 0, determine whether the core type 167 of FIG. 1 corresponds to an ACELP core type.

The method 500 also includes, in response to determining that the core type does not correspond to an ACELP core type, at 510, selecting a high resolution, at 512. For example, the IPD mode selector 108 of FIG. 1 may, in response to determining that the core type 167 of FIG. 1 does not correspond to an ACELP core type, select a third IPD mode as the IPD mode 156 of FIG. 1. The third IPD mode may be associated with a high resolution (e.g., 16 bits).

The method 500 further includes, in response to determining that the core type corresponds to an ACELP core type, at 510, determining whether a coder type corresponds to a GSC coder type, at 514. For example, the IPD mode selector 108 of FIG. 1 may, in response to determining that the core type 167 of FIG. 1 corresponds to an ACELP core type, determine whether the coder type 169 of FIG. 1 corresponds to a GSC coder type.

The method 500 also includes, in response to determining that the coder type corresponds to a GSC coder type, at 514, proceeding to 508. For example, the IPD mode selector 108 of FIG. 1 may, in response to determining that the coder type 169 of FIG. 1 corresponds to a GSC coder type, select the second IPD mode as the IPD mode 156 of FIG. 1.

The method 500 further includes, in response to determining that the coder type does not correspond to a GSC coder type, at 514, proceeding to 512. For example, the IPD mode selector 108 of FIG. 1 may, in response to determining that the coder type 169 of FIG. 1 does not correspond to a GSC coder type, select the third IPD mode as the IPD mode 156 of FIG. 1.

The method 500 corresponds to an illustrative example of determining the IPD mode 156. It should be understood that the sequence of operations illustrated in method 500 is for ease of illustration. In some implementations, the IPD mode 156 may be selected based on a different sequence of operations that includes more, fewer, and/or different operations than shown in FIG. 5. The IPD mode 156 may be selected based on any combination of the interchannel temporal mismatch value 163, the strength value 150, the core type 167, the coder type 169, or the speech/music decision parameter 171.

Figure 6:
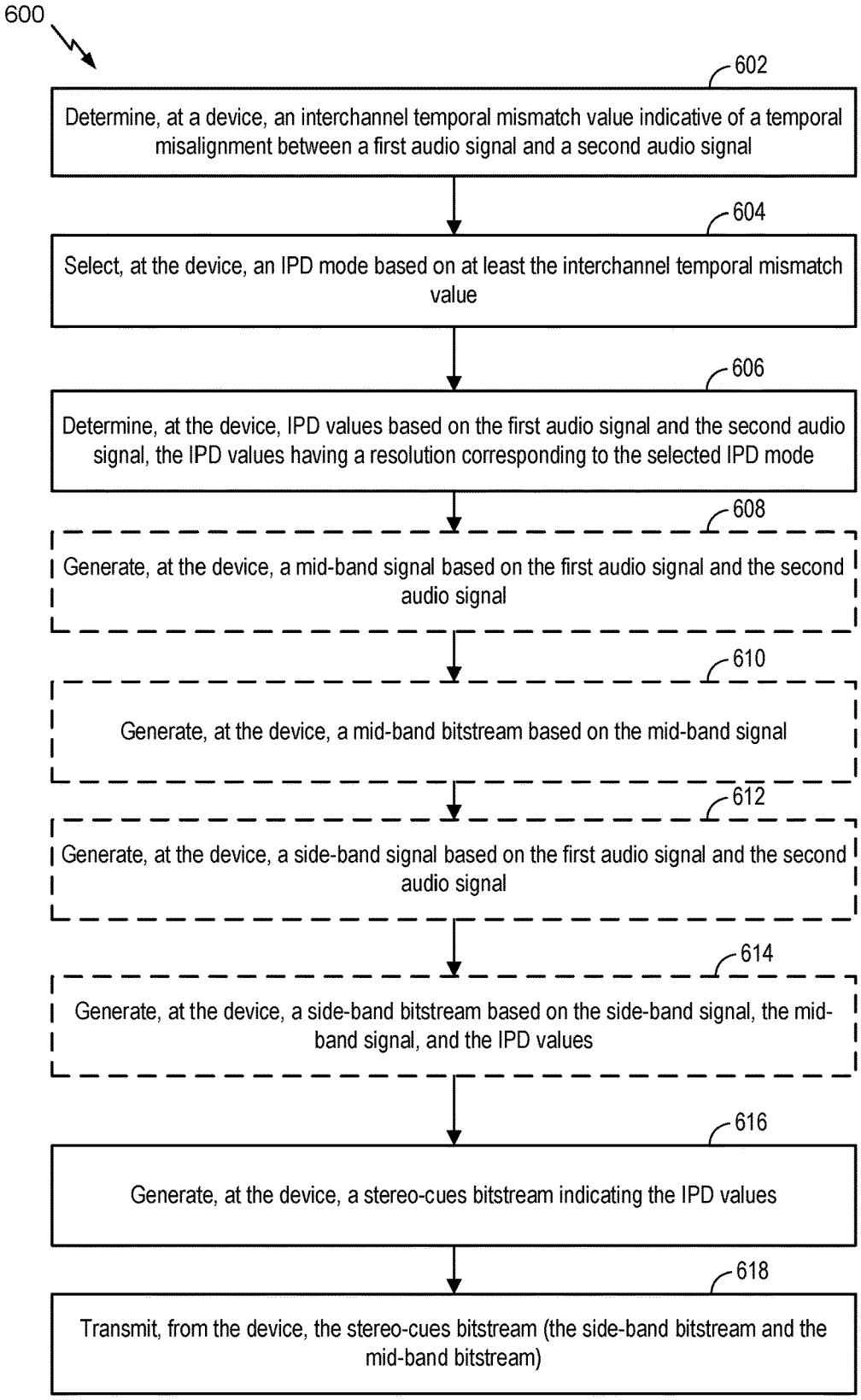
FIG. 6 is a flow chart illustrating another particular method of encoding interchannel phase differences.

Referring to FIG. 6, a method of operation is shown and generally designated 600. The method 600 may be performed by the IPD estimator 122, the IPD mode selector 108, the interchannel temporal mismatch analyzer 124, the encoder 114, the transmitter 110, the system 100 of FIG. 1, the stereo-cues estimator 206, the side-band encoder 210, the mid-band encoder 214 of FIG. 2, or a combination thereof.

The method 600 includes determining, at a device, an interchannel temporal mismatch value indicative of a temporal misalignment between a first audio signal and a second audio signal, at 602. For example, the interchannel temporal mismatch analyzer 124 may determine the interchannel temporal mismatch value 163, as described with reference to FIGS. 1 and 4. The interchannel temporal mismatch value 163 may be indicative of a temporal misalignment (e.g., a temporal delay) between the first audio signal 130 and the second audio signal 132.

The method 600 also includes selecting, at the device, an IPD mode based on at least the interchannel temporal mismatch value, at 604. For example, the IPD mode selector 108 may determine the IPD mode 156 based on at least the interchannel temporal mismatch value 163, as described with reference to FIGS. 1 and 4.

The method 600 further includes determining, at the device, IPD values based on the first audio signal and the second audio signal, at 606. For example, the IPD estimator 122 may determine the IPD values 161 based on the first audio signal 130 and the second audio signal 132, as described with reference to FIGS. 1 and 4. The IPD values 161 may have the resolution 165 corresponding to the selected IPD mode 156.

The method 600 also includes generating, at the device, a mid-band signal based on the first audio signal and the second audio signal, at 608. For example, the mid-band signal generator 212 may generate the frequency-domain mid-band signal ($M_{fr}(b)$) 236 based on the first audio signal 130 and the second audio signal 132, as described with reference to FIG. 2.

The method 600 further includes generating, at the device, a mid-band bitstream based on the mid-band signal, at 610. For example, the mid-band encoder 214 may generate the mid-band bitstream 166 based on the frequency-domain mid-band signal ($M_{fr}(b)$) 236, as described with reference to FIG. 2.

The method 600 also includes generating, at the device, a side-band signal based on the first audio signal and the second audio signal, at 612. For example, the side-band signal generator 208 may generate the frequency-domain side-band signal ($S_{fr}(b)$) 234 based on the first audio signal 130 and the second audio signal 132, as described with reference to FIG. 2.

The method 600 further includes generating, at the device, a side-band bitstream based on the side-band signal, at 614. For example, the side-band encoder 210 may generate the side-band bitstream 164 based on the frequency-domain side-band signal ($S_{fr}(b)$) 234, as described with reference to FIG. 2.

The method 600 also includes generating, at the device, a stereo-cues bitstream indicating the IPD values, at 616. For example, the stereo-cues estimator 206 may generate the stereo-cues bitstream 162 indicating the IPD values 161, as described with reference to FIGS. 2-4.

The method 600 further includes transmitting, from the device, the side-band bitstream, at 618. For example, the transmitter 110 of FIG. 1 may transmit the side-band bitstream 164. The transmitter 110 may additionally transmit at least one of the mid-band bitstream 166 or the stereo-cues bitstream 162.

The method 600 may thus enable dynamically adjusting a resolution of the IPD values 161 based at least in part on the interchannel temporal mismatch value 163. A higher number of bits may be used to encode the IPD values 161 when the IPD values 161 are likely to have a greater impact on audio quality.

Figure 7:
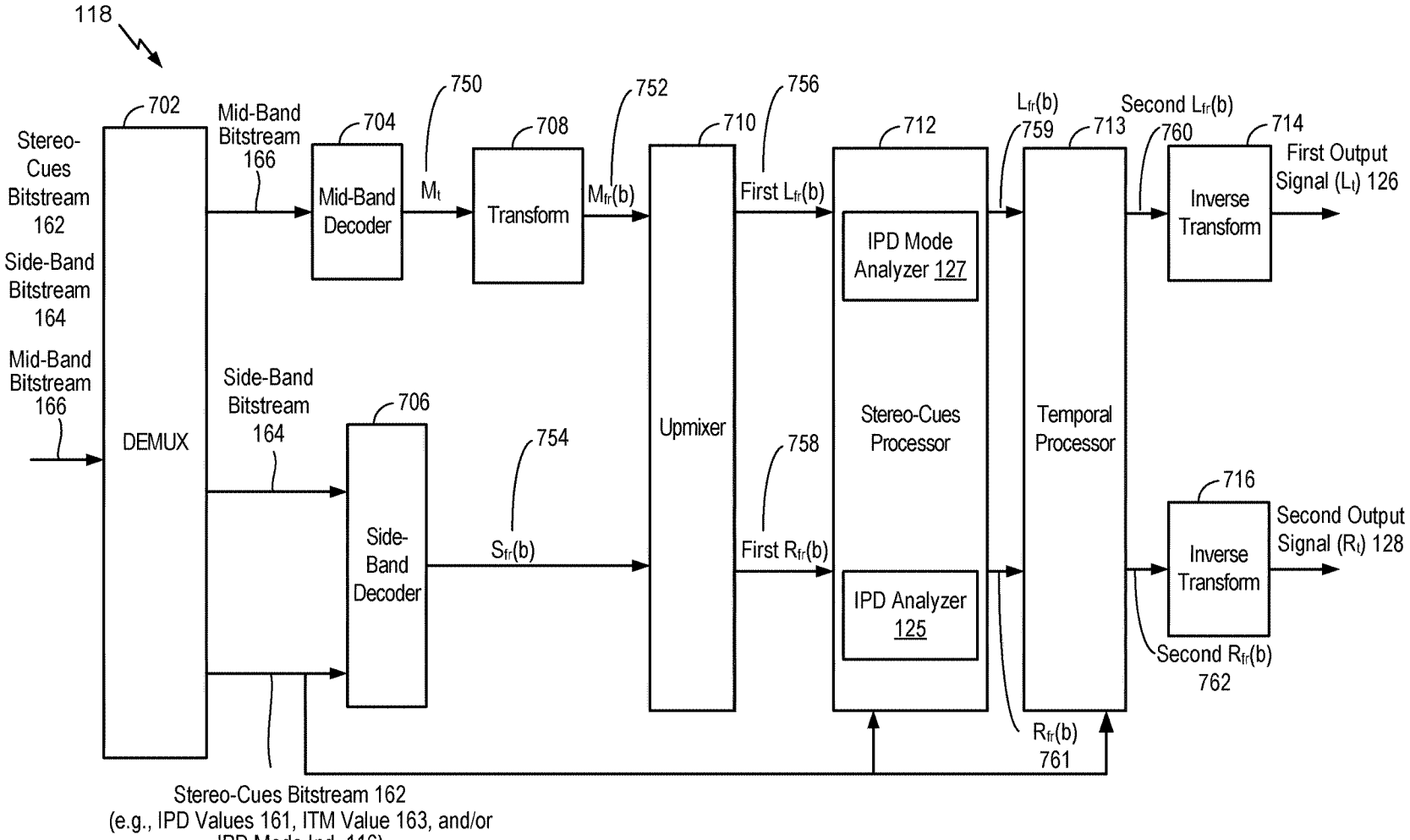
FIG. 7 is a diagram of particular illustrative aspects of the decoder of FIG. 1.

Referring to FIG. 7, a diagram illustrating a particular implementation of the decoder 118 is shown. An encoded audio signal is provided to a demultiplexer (DEMUX) 702 of the decoder 118. The encoded audio signal may include the stereo-cues bitstream 162, the side-band bitstream 164, and the mid-band bitstream 166. The demultiplexer 702 may be configured to extract the mid-band bitstream 166 from the encoded audio signal and provide the mid-band bitstream 166 to a mid-band decoder 704. The demultiplexer 702 may also be configured to extract the side-band bitstream 164 and the stereo-cues bitstream 162 from the encoded audio signal. The side-band bitstream 164 and the stereo-cues bitstream 162 may be provided to a side-band decoder 706.

The mid-band decoder 704 may be configured to decode the mid-band bitstream 166 to generate a mid-band signal 750. If the mid-band signal 750 is a time-domain signal, a transform 708 may be applied to the mid-band signal 750 to generate a frequency-domain mid-band signal ($M_{fr}(b)$) 752. The frequency-domain mid-band signal 752 may be provided to an upmixer 710. However, if the mid-band signal 750 is a frequency-domain signal, the mid-band signal 750 may be provided directly to the upmixer 710 and the transform 708 may be bypassed or may not be present in the decoder 118.

The side-band decoder 706 may generate a frequency-domain side-band signal ($S_{fr}(b)$) 754 based on the side-band bitstream 164 and the stereo-cues bitstream 162. For example, one or more parameters (e.g., an error parameter) may be decoded for the low-bands and the high-bands. The frequency-domain side-band signal 754 may also be provided to the upmixer 710.

The upmixer 710 may perform an upmix operation based on the frequency-domain mid-band signal 752 and the frequency-domain side-band signal 754. For example, the upmixer 710 may generate a first upmixed signal ($L_{fr}(b)$) 756 and a second upmixed signal ($R_{fr}(b)$) 758 based on the frequency-domain mid-band signal 752 and the frequency-domain side-band signal 754. Thus, in the described example, the first upmixed signal 756 may be a left-channel signal, and the second upmixed signal 758 may be a right-channel signal. The first upmixed signal 756 may be expressed as $M_{fr}(b)+S_{fr}(b)$, and the second upmixed signal 758 may be expressed as $M_{fr}(b)-S_{fr}(b)$. The upmixed signals 756, 758 may be provided to a stereo-cue processor 712.

The stereo-cues processor 712 may include the IPD mode analyzer 127, the IPD analyzer 125, or both, as further described with reference to FIG. 8. The stereo-cues processor 712 may apply the stereo-cues bitstream 162 to the upmixed signals 756, 758 to generate signals 759, 761. For example, the stereo-cues bitstream 162 may be applied to the upmixed left and right channels in the frequency-domain. To illustrate, the stereo-cues processor 712 may generate the signal 759 (e.g., a phase-rotated frequency-domain output signal) by phase-rotating the upmixed signal 756 based on the IPD values 161. The stereo-cues processor 712 may generate the signal 761 (e.g., a phase-rotated frequency-domain output signal) by phase-rotating the upmixed signal 758 based on the IPD values 161. When available, the IPD (phase differences) may be spread on the left and right channels to maintain the interchannel phase differences, as further described with reference to FIG. 8. The signals 759, 761 may be provided to a temporal processor 713.

The temporal processor 713 may apply the interchannel temporal mismatch value 163 to the signals 759, 761 to generate signals 760, 762. For example, the temporal processor 713 may perform a reverse temporal adjustment to the signal 759 (or the signal 761) to undo the temporal adjustment performed at the encoder 114. The temporal processor 713 may generate the signal 760 by shifting the signal 759 based on the ITM value 264 (e.g., a negative of the ITM value 264) of FIG. 2. For example, the temporal processor 713 may generate the signal 760 by performing a causal shift operation on the signal 759 based on the ITM value 264 (e.g., a negative of the ITM value 264). The causal shift operation may "pull forward" the signal 759 such that the signal 760 is aligned with the signal 761. The signal 762 may correspond to the signal 761. In an alternative aspect, the temporal processor 713 generates the signal 762 by shifting the signal 761 based on the ITM value 264 (e.g., a negative of the ITM value 264). For example, the temporal processor 713 may generate the signal 762 by performing a causal shift operation on the signal 761 based on the ITM value 264 (e.g., a negative of the ITM value 264). The causal shift operation may pull forward (e.g., temporally shift) the signal 761 such that the signal 762 is aligned with the signal 759. The signal 760 may correspond to the signal 759.

An inverse transform 714 may be applied to the signal 760 to generate a first time-domain signal (e.g., the first output signal ($L_t$) 126), and an inverse transform 716 may be applied to the signal 762 to generate a second time-domain signal (e.g., the second output signal ($R_t$) 128). Non-limiting examples of the inverse transforms 714, 716 include Inverse Discrete Cosine Transform (IDCT) operations, Inverse Fast Fourier Transform (IFFT) operations, etc.

In an alternative aspect, temporal adjustment is performed in the time-domain subsequent to the inverse transforms 714, 716. For example, the inverse transform 714 may be applied to the signal 759 to generate a first time-domain signal and the inverse transform 716 may be applied to the signal 761 to generate a second time-domain signal. The first time-domain signal or the second time domain signal may be shifted based on the interchannel temporal mismatch value 163 to generate the first output signal ($L_t$) 126 and the second output signal ($R_t$) 128. For example, the first output signal ($L_t$) 126 (e.g., a first shifted time-domain output signal) may be generated by performing a causal shift operation on the first time-domain signal based on the ICA value 262 (e.g., a negative of the ICA value 262) of FIG. 2. The second output signal ($R_t$) 128 may correspond to the second time-domain signal. As another example, the second output signal ($R_t$) 128 (e.g., a second shifted time-domain output signal) may be generated by performing a causal shift operation on the second time-domain signal based on the ICA value 262 (e.g., a negative of the ICA value 262) of FIG. 2. The first output signal ($L_t$) 126 may correspond to the first time-domain signal.

Performing a causal shift operation on a first signal (e.g., the signal 759, the signal 761, the first time-domain signal, or the second time-domain signal) may correspond to delaying (e.g., pulling forward) the first signal in time at the decoder 118. The first signal (e.g., the signal 759, the signal 761, the first time-domain signal, or the second time-domain signal) may be delayed at the decoder 118 to compensate for advancing a target signal (e.g., frequency-domain left signal ($L_{fr}(b)$) 229, the frequency-domain right signal ($R_{fr}(b)$) 231, the time-domain left signal ($L_t$) 290, or time-domain right signal ($R_t$) 292) at the encoder 114 of FIG. 1. For example, at the encoder 114, the target signal (e.g., frequency-domain left signal ($L_{fr}(b)$) 229, the frequency-domain right signal ($R_{fr}(b)$) 231, the time-domain left signal ($L_t$) 290, or time-domain right signal ($R_t$) 292 of FIG. 2) is advanced by temporally shifting the target signal based on the ITM value 163, as described with reference to FIG. 3. At the decoder 118, a first output signal (e.g., the signal 759, the signal 761, the first time-domain signal, or the second time-domain signal) corresponding to a reconstructed version of the target signal is delayed by temporally shifting the output signal based on a negative value of the ITM value 163.

In a particular aspect, at the encoder 114 of FIG. 1, a delayed signal is aligned with a reference signal by aligning a second frame of the delayed signal with a first frame of the reference signal, where a first frame of the delayed signal is received at the encoder 114 concurrently with the first frame of the reference signal, where the second frame of the delayed signal is received subsequent to the first frame of the delayed signal, and where the ITM value 163 indicates a number of frames between the first frame of the delayed signal and the second frame of the delayed signal. The decoder 118 causally shifts (e.g., pulls forward) a first output signal by aligning a first frame of the first output signal with a first frame of the second output signal, where the first frame of the first output signal corresponds to a reconstructed version of the first frame of the delayed signal, and where the first frame of the second output signal corresponds to a reconstructed version of the first frame of the reference signal. The second device 106 outputs the first frame of the first output signal concurrently with outputting the first frame of the second output signal. It should be understood that frame-level shifting is described for ease of explanation, in some aspects sample-level causal shifting is performed on the first output signal. One of the first output signal 126 or the second output signal 128 corresponds to the causally-shifted first output signal, and the other of the first output signal 126 or the second output signal 128 corresponds to the second output signal. The second device 106 thus preserves (at least partially) a temporal misalignment (e.g., a stereo effect) in the first output signal 126 relative to the second output signal 128 that corresponds to a temporal misalignment (if any) between the first audio signal 130 relative to the second audio signal 132.

According to one implementation, the first output signal ($L_t$) 126 corresponds to a reconstructed version of the phase-adjusted first audio signal 130, whereas the second output signal ($R_t$) 128 corresponds to a reconstructed version of the phase-adjusted second audio signal 132. According to one implementation, one or more operations described herein as performed at the upmixer 710 are performed at the stereo-cues processor 712. According to another implementation, one or more operations described herein as performed at the stereo-cues processor 712 are performed at the upmixer 710. According to yet another implementation, the upmixer 710 and the stereo-cues processor 712 are implemented within a single processing element (e.g., a single processor).

Figure 8:
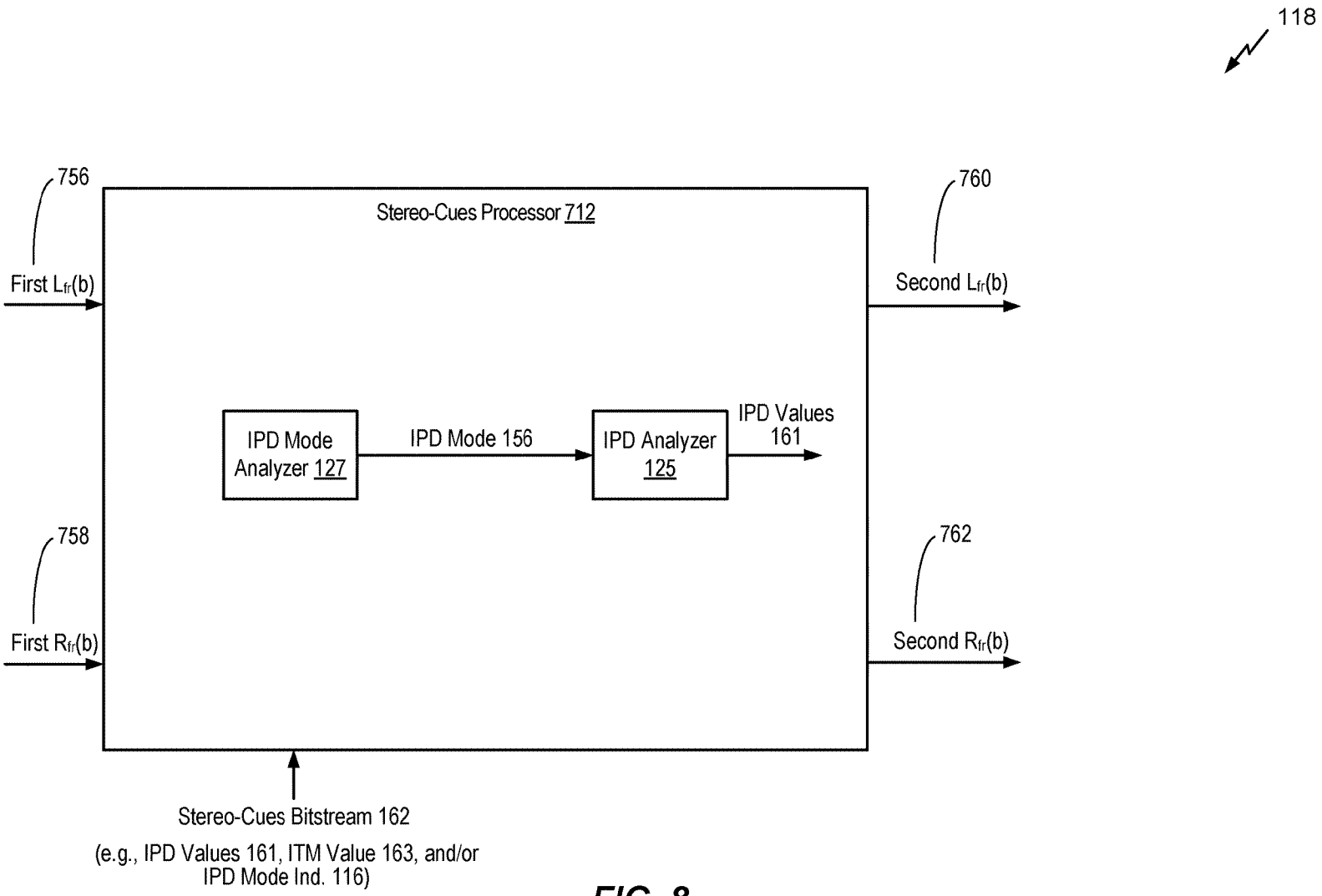
FIG. 8 is a diagram of particular illustrative aspects of the decoder of FIG. 1.

Referring to FIG. 8, a diagram illustrating a particular implementation of the stereo-cues processor 712 of the decoder 118 is shown. The stereo-cues processor 712 may include the IPD mode analyzer 127 coupled to the IPD analyzer 125.

The IPD mode analyzer 127 may determine that the stereo-cues bitstream 162 includes the IPD mode indicator 116. The IPD mode analyzer 127 may determine that the IPD mode indicator 116 indicates the IPD mode 156. In an alternative aspect, the IPD mode analyzer 127, in response to determining that the IPD mode indicator 116 is not included in the stereo-cues bitstream 162, determines the IPD mode 156 based on the core type 167, the coder type 169, the interchannel temporal mismatch value 163, the strength value 150, the speech/music decision parameter 171, the LB parameters 159, the BWE parameters 155, or a combination thereof, as described with reference to FIG. 4. The stereo-cues bitstream 162 may indicate the core type 167, the coder type 169, the interchannel temporal mismatch value 163, the strength value 150, the speech/music decision parameter 171, the LB parameters 159, the BWE parameters 155, or a combination thereof. In a particular aspect, the core type 167, the coder type 169, the speech/music decision parameter 171, the LB parameters 159, the BWE parameters 155, or a combination thereof, are indicated in the stereo-cues bitstream for a previous frame.

In a particular aspect, the IPD mode analyzer 127 determines, based on the ITM value 163, whether to use the IPD values 161 received from the encoder 114. For example, the IPD mode analyzer 127 determines whether to use the IPD values 161 based on the following pseudo code:

```
c = (1+g+STEREO_DFT_FLT_MIN)/
(1−g+STEREO_DFT_FLT_MIN);
if ( b < hStereoDft→res_pred_band_min &&
hStereoDft→res_cod_mode[k+k_offset]
    && fabs (hStereoDft→itd[k+k_offset]) >80.0f)
{
    alpha = 0;
    beta = (float)(atan2(sin(alpha), (cos(alpha) + 2*c))); /* beta
        applied in both directions is limited [−pi, pi]*/
}
```

-continued

```
else
{
    alpha = pIpd[b];
    beta = (float)(atan2(sin(alpha), (cos(alpha) + 2*c))); /* beta
        applied in both directions is limited [−pi, pi]*/
}
```

where "hStereoDft→res_cod_mode[k+k_offset]" indicates whether the side-band bitstream 164 has been provided by the encoder 114, "hStereoDft→itd[k+k_offset]" corresponds to the ITM value 163, and "pIpd[b]" corresponds to the IPD values 161. The IPD mode analyzer 127 determines that the IPD values 161 are not to be used in response to determining that the side-band bitstream 164 has been provided by the encoder 114 and that the ITM value 163 (e.g., an absolute value of the ITM value 163) is greater than a threshold (e.g., 80.00. For example, the IPD mode analyzer 127 based at least in part on determining that the side-band bitstream 164 has been provided by the encoder 114 and that the ITM value 163 (e.g., an absolute value of the ITM value 163) is greater than the threshold (e.g., 80.00, provides a first IPD mode as the IPD mode 156 (e.g., "alpha=0") to the IPD analyzer 125. The first IPD mode corresponds to zero resolution. Setting the IPD mode 156 to correspond to zero resolution improves audio quality of an output signal (e.g., the first output signal 126, the second output signal 128, or both) when the ITM value 163 indicates a large shift (e.g., absolute value of the ITM value 163 is greater than the threshold) and residual coding is used in lower frequency bands. Using residual coding corresponds to the encoder 114 providing the side-band bitstream 164 to the decoder 118 and the decoder 118 using the side-band bitstream 164 to generate the output signal (e.g., the first output signal 126, the second output signal 128, or both). In a particular aspect, the encoder 114 and the decoder 118 are configured to use residual coding (in addition to residual prediction) for higher bitrates (e.g., greater than 20 kilobits per second (kbps)).

Alternatively, the IPD mode analyzer 127, in response to determining that the side-band bitstream 164 has not been provided by the encoder 114 or that the ITM value 163 (e.g., an absolute value of the ITM value 163) is less than or equal to the threshold (e.g., 80.00, determines that the IPD values 161 are to be used (e.g., "alpha=pIpd[b]"). For example, the IPD mode analyzer 127 provides the IPD mode 156 (that is determined based on the stereo-cues bitstream 162) to the IPD analyzer 125. Setting the IPD mode 156 to correspond to zero resolution has less impact on improving audio quality of the output signal (e.g., the first output signal 126, the second output signal 128, or both) when residual coding is not used or when the ITM value 163 indicates a smaller shift (e.g., absolute value of the ITM value 163 is less than or equal to the threshold).

In a particular example, the encoder 114, the decoder 118, or both, are configured to use residual prediction (and not residual coding) for lower bitrates (e.g., less than or equal to 20 kbps). For example, the encoder 114 is configured to refrain from providing the side-band bitstream 164 to the decoder 118 for lower bitrates, and the decoder 118 is configured to generate the output signal (e.g., the first output signal 126, the second output signal 128, or both) independently of the side-band bitstream 164 for lower bitrates. The decoder 118 is configured to generate the output signal based on the IPD mode 156 (that is determined based on the stereo-cues bitstream 162) when the output signal is generated independently of the side-band bitstream 164 or when the ITM value 163 indicates a smaller shift.

The IPD analyzer 125 may determine that the IPD values 161 have the resolution 165 (e.g., a first number of bits, such as 0 bits, 3 bits, 16 bits, etc.) corresponding to the IPD mode 156. The IPD analyzer 125 may extract the IPD values 161, if present, from the stereo-cues bitstream 162 based on the resolution 165. For example, the IPD analyzer 125 may determine the IPD values 161 represented by the first number of bits of the stereo-cues bitstream 162. In some examples, the IPD mode 156 may also not only notify the stereo-cues processor 712 of the number of bits being used to represent the IPD values 161, but may also notify the stereo-cues processor 712 which specific bits (e.g., which bit locations) of the stereo-cues bitstream 162 are being used to represent the IPD values 161.

In a particular aspect, the IPD analyzer 125 determines that the resolution 165, the IPD mode 156, or both, indicate that the IPD values 161 are set to a particular value (e.g., zero), that each of the IPD values 161 is set to a particular value (e.g., zero), or that the IPD values 161 are absent from the stereo-cues bitstream 162. For example, the IPD analyzer 125 may determine that the IPD values 161 are set to zero or are absent from the stereo-cues bitstream 162 in response to determining that the resolution 165 indicates a particular resolution (e.g., 0), that the IPD mode 156 indicates a particular IPD mode (e.g., the second IPD mode 467 of FIG. 4) associated with the particular resolution (e.g., 0), or both. When the IPD values 161 are absent from the stereo-cues bitstream 162 or the resolution 165 indicates the particular resolution (e.g., zero), the stereo-cues processor 712 may generate the signals 760, 762 without performing phase adjustments to the first upmixed signal ($L_{fr}$) 756 and the second upmixed signal ($R_{fr}$) 758.

When the IPD values 161 are present in the stereo-cues bitstream 162, the stereo-cues processor 712 may generate the signal 760 and the signal 762 by performing phase adjustments to the first upmixed signal ($L_{fr}$) 756 and the second upmixed signal ($R_{fr}$) 758 based on the IPD values 161. For example, the stereo-cues processor 712 may perform a reverse phase adjustment to undo the phase adjustment performed at the encoder 114.

The decoder 118 may thus be configured to handle dynamic frame-level adjustments to the number of bits being used to represent a stereo-cues parameter. An audio quality of output signals may be improved when a higher number of bits are used to represent a stereo-cues parameter that has a greater impact on the audio quality.

Figure 9:
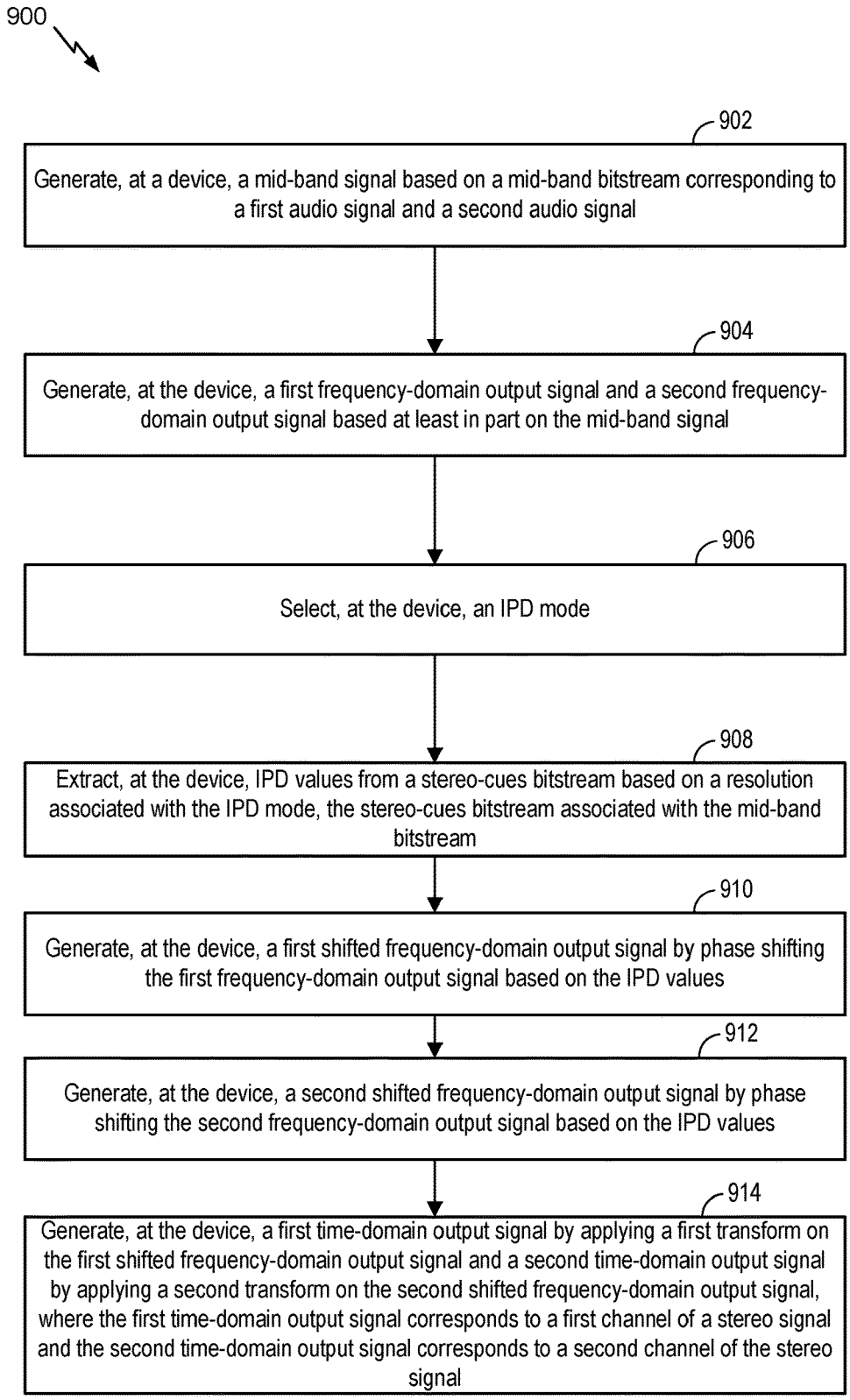
FIG. 9 is a flow chart illustrating a particular method of decoding interchannel phase differences.

Referring to FIG. 9, a method of operation is shown and generally designated 900. The method 900 may be performed by the decoder 118, the IPD mode analyzer 127, the IPD analyzer 125 of FIG. 1, the mid-band decoder 704, the side-band decoder 706, the stereo-cues processor 712 of FIG. 7, or a combination thereof.

The method 900 includes generating, at a device, a mid-band signal based on a mid-band bitstream corresponding to a first audio signal and a second audio signal, at 902. For example, the mid-band decoder 704 may generate the frequency-domain mid-band signal ($M_{fr}(b)$) 752 based on the mid-band bitstream 166 corresponding to the first audio signal 130 and the second audio signal 132, as described with reference to FIG. 7.

The method 900 also includes generating, at the device, a first frequency-domain output signal and a second frequency-domain output signal based at least in part on the mid-band signal, at 904. For example, the upmixer 710 may generate the upmixed signals 756, 758 based at least in part on the frequency-domain mid-band signal ($M_{fr}(b)$) 752, as described with reference to FIG. 7.

The method further includes selecting, at the device, an IPD mode, at 906. For example, the IPD mode analyzer 127 may select the IPD mode 156 based on the IPD mode indicator 116, as described with reference to FIG. 8.

The method also includes extracting, at the device, IPD values from a stereo-cues bitstream based on a resolution associated with the IPD mode, at 908. For example, the IPD analyzer 125 may extract the IPD values 161 from the stereo-cues bitstream 162 based on the resolution 165 associated with the IPD mode 156, as described with reference to FIG. 8. The stereo-cues bitstream 162 may be associated with (e.g., may include) the mid-band bitstream 166.

The method further includes generating, at the device, a first shifted frequency-domain output signal by phase shifting the first frequency-domain output signal based on the IPD values, at 910. For example, the stereo-cues processor 712 of the second device 106 may generate the signal 760 by phase shifting the first upmixed signal ($L_{fr}(b)$) 756 (or the adjusted first upmixed signal ($L_{fr}$) 756) based on the IPD values 161, as described with reference to FIG. 8.

The method further includes generating, at the device, a second shifted frequency-domain output signal by phase shifting the second frequency-domain output signal based on the IPD values, at 912. For example, the stereo-cues processor 712 of the second device 106 may generate the signal 762 by phase shifting the second upmixed signal ($R_{fr}(b)$) 758 (or the adjusted second upmixed signal ($R_{fr}$) 758) based on the IPD values 161, as described with reference to FIG. 8.

The method also includes generating, at the device, a first time-domain output signal by applying a first transform on the first shifted frequency-domain output signal and a second time-domain output signal by applying a second transform on the second shifted frequency-domain output signal, at 914. For example, the decoder 118 may generate the first output signal 126 by applying the inverse transform 714 to the signal 760 and may generate the second output signal 128 by applying the inverse transform 716 to the signal 762, as described with reference to FIG. 7. The first output signal 126 may correspond to a first channel (e.g., right channel or left channel) of a stereo signal and the second output signal 128 may correspond to a second channel (e.g., left channel or right channel) of the stereo signal.

The method 900 may thus enable the decoder 118 to handle dynamic frame-level adjustments to the number of bits being used to represent a stereo-cues parameter. An audio quality of output signals may be improved when a higher number of bits are used to represent a stereo-cues parameter that has a greater impact on the audio quality.

Figure 10:
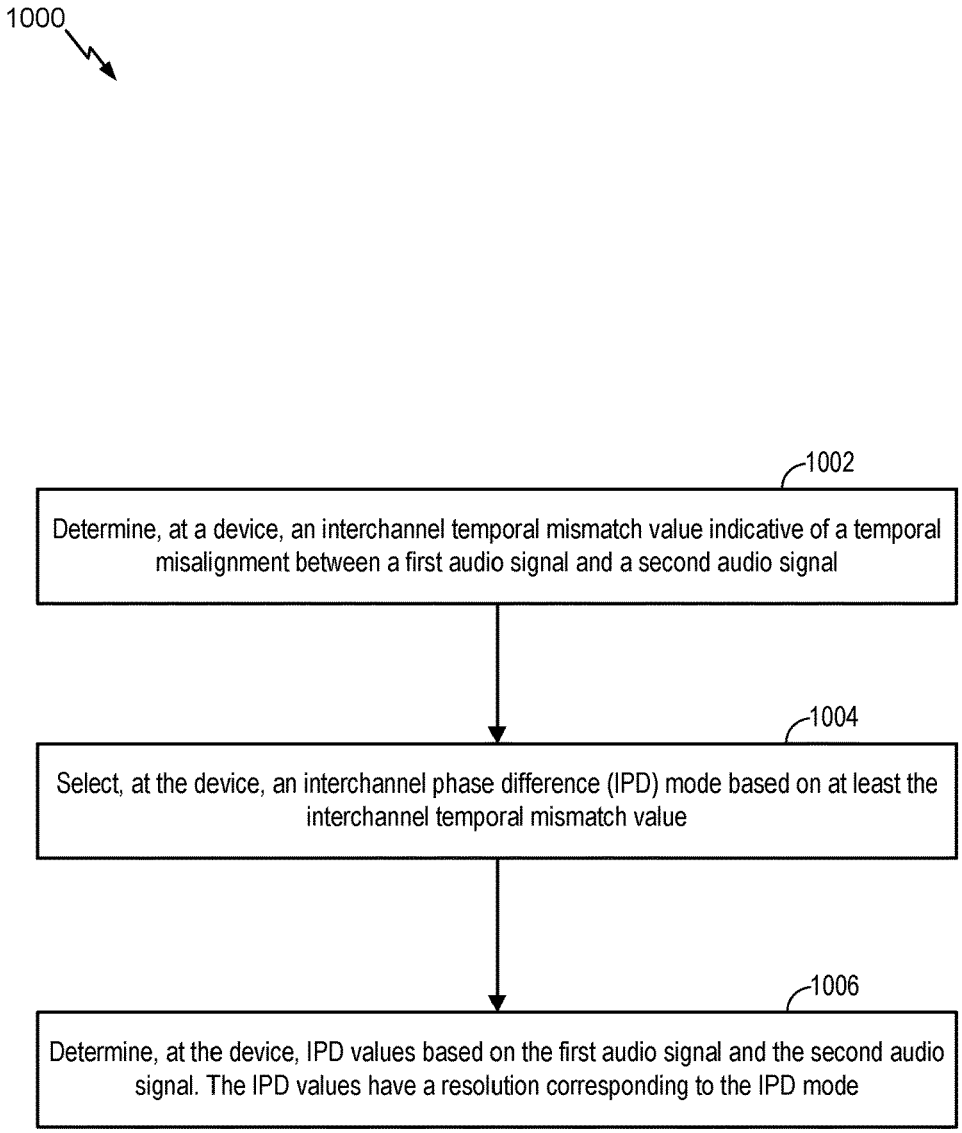
FIG. 10 is a flow chart illustrating a particular method of determining interchannel phase difference values.

Referring to FIG. 10, a method of operation is shown and generally designated 1000. The method 1000 may be performed by the encoder 114, the IPD mode selector 108, the IPD estimator 122, the ITM analyzer 124 of FIG. 1, or a combination thereof.

The method 1000 includes determining, at a device, an interchannel temporal mismatch value indicative of a temporal misalignment between a first audio signal and a second audio signal, at 1002. For example, as described with reference to FIGS. 1-2, the ITM analyzer 124 may determine the ITM value 163 indicative of a temporal misalignment between the first audio signal 130 and the second audio signal 132.

The method 1000 includes selecting, at the device, an interchannel phase difference (IPD) mode based on at least the interchannel temporal mismatch value, at 1004. For example, as described with reference to FIG. 4, the IPD mode selector 108 may select the IPD mode 156 based at least in part on the ITM value 163.

The method 1000 also includes determining, at the device, IPD values based on the first audio signal and the second audio signal, at 1006. For example, as described with reference to FIG. 4, the IPD estimator 122 may determine the IPD values 161 based on the first audio signal 130 and the second audio signal 132.

The method 1000 may thus enable the encoder 114 to handle dynamic frame-level adjustments to the number of bits being used to represent a stereo-cues parameter. An audio quality of output signals may be improved when a higher number of bits are used to represent a stereo-cues parameter that has a greater impact on the audio quality.

Figure 11:
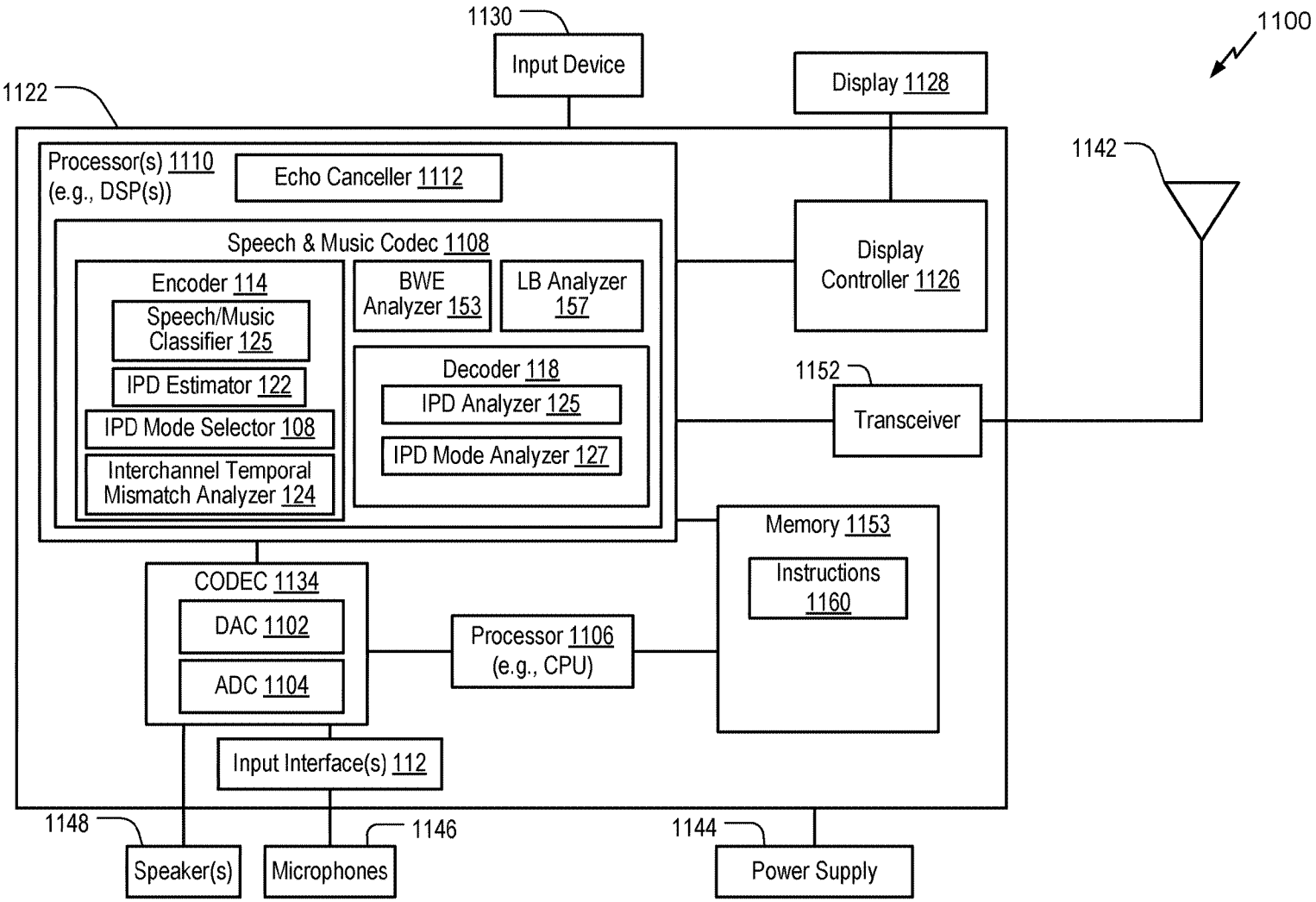
FIG. 11 is a block diagram of a device operable to encode and decode interchannel phase differences between audio signals in accordance with the systems, devices, and methods of FIGS. 1-10.

Referring to FIG. 11, a block diagram of a particular illustrative example of a device (e.g., a wireless communication device) is depicted and generally designated 1100. In various embodiments, the device 1100 may have fewer or more components than illustrated in FIG. 11. In an illustrative embodiment, the device 1100 may correspond to the first device 104 or the second device 106 of FIG. 1. In an illustrative embodiment, the device 1100 may perform one or more operations described with reference to systems and methods of FIGS. 1-10.

In a particular embodiment, the device 1100 includes a processor 1106 (e.g., a central processing unit (CPU)). The device 1100 may include one or more additional processors 1110 (e.g., one or more digital signal processors (DSPs)). The processors 1110 may include a media (e.g., speech and music) coder-decoder (CODEC) 1108, and an echo canceller 1112. The media CODEC 1108 may include the decoder 118, the encoder 114, or both, of FIG. 1. The encoder 114 may include the speech/music classifier 129, the IPD estimator 122, the IPD mode selector 108, the interchannel temporal mismatch analyzer 124, or a combination thereof. The decoder 118 may include the IPD analyzer 125, the IPD mode analyzer 127, or both.

The device 1100 may include a memory 1153 and a CODEC 1134. Although the media CODEC 1108 is illustrated as a component of the processors 1110 (e.g., dedicated circuitry and/or executable programming code), in other embodiments one or more components of the media CODEC 1108, such as the decoder 118, the encoder 114, or both, may be included in the processor 1106, the CODEC 1134, another processing component, or a combination thereof. In a particular aspect, the processors 1110, the processor 1106, the CODEC 1134, or another processing component performs one or more operations described herein as performed by the encoder 114, the decoder 118, or both. In a particular aspect, operations described herein as performed by the encoder 114 are performed by one or more processors included in the encoder 114. In a particular aspect, operations described herein as performed by the decoder 118 are performed by one or more processors included in the decoder 118.

The device 1100 may include a transceiver 1152 coupled to an antenna 1142. The transceiver 1152 may include the transmitter 110, the receiver 170 of FIG. 1, or both. The device 1100 may include a display 1128 coupled to a display controller 1126. One or more speakers 1148 may be coupled to the CODEC 1134. One or more microphones 1146 may be coupled, via the input interface(s) 112, to the CODEC 1134. In a particular implementation, the speakers 1148 include the first loudspeaker 142, the second loudspeaker 144 of FIG. 1, or a combination thereof. In a particular implementation, the microphones 1146 include the first microphone 146, the second microphone 148 of FIG. 1, or a combination thereof. The CODEC 1134 may include a digital-to-analog converter (DAC) 1102 and an analog-to-digital converter (ADC) 1104.

The memory 1153 may include instructions 1160 executable by the processor 1106, the processors 1110, the CODEC 1134, another processing unit of the device 1100, or a combination thereof, to perform one or more operations described with reference to FIGS. 1-10.

One or more components of the device 1100 may be implemented via dedicated hardware (e.g., circuitry), by a processor executing instructions to perform one or more tasks, or a combination thereof. As an example, the memory 1153 or one or more components of the processor 1106, the processors 1110, and/or the CODEC 1134 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 1160) that, when executed by a computer (e.g., a processor in the CODEC 1134, the processor 1106, and/or the processors 1110), may cause the computer to perform one or more operations described with reference to FIGS. 1-10. As an example, the memory 1153 or the one or more components of the processor 1106, the processors 1110, and/or the CODEC 1134 may be a non-transitory computer-readable medium that includes instructions (e.g., the instructions 1160) that, when executed by a computer (e.g., a processor in the CODEC 1134, the processor 1106, and/or the processors 1110), cause the computer perform one or more operations described with reference to FIGS. 1-10.

In a particular embodiment, the device 1100 may be included in a system-in-package or system-on-chip device (e.g., a mobile station modem (MSM)) 1122. In a particular embodiment, the processor 1106, the processors 1110, the display controller 1126, the memory 1153, the CODEC 1134, and the transceiver 1152 are included in a system-in-package or the system-on-chip device 1122. In a particular embodiment, an input device 1130, such as a touchscreen and/or keypad, and a power supply 1144 are coupled to the system-on-chip device 1122. Moreover, in a particular embodiment, as illustrated in FIG. 11, the display 1128, the input device 1130, the speakers 1148, the microphones 1146, the antenna 1142, and the power supply 1144 are external to the system-on-chip device 1122. However, each of the display 1128, the input device 1130, the speakers 1148, the microphones 1146, the antenna 1142, and the power supply 1144 can be coupled to a component of the system-on-chip device 1122, such as an interface or a controller.

The device 1100 may include a wireless telephone, a mobile communication device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

In a particular implementation, one or more components of the systems and devices disclosed herein are integrated into a decoding system or apparatus (e.g., an electronic device, a CODEC, or a processor therein), into an encoding system or apparatus, or both. In a particular implementation, one or more components of the systems and devices disclosed herein are integrated into a mobile device, a wireless telephone, a tablet computer, a desktop computer, a laptop computer, a set top box, a music player, a video player, an entertainment unit, a television, a game console, a navigation device, a communication device, a PDA, a fixed location data unit, a personal media player, or another type of device.

It should be noted that various functions performed by the one or more components of the systems and devices disclosed herein are described as being performed by certain components or modules. This division of components and modules is for illustration only. In an alternate implementation, a function performed by a particular component or module is divided amongst multiple components or modules. Moreover, in an alternate implementation, two or more components or modules are integrated into a single component or module. Each component or module may be implemented using hardware (e.g., a field-programmable gate array (FPGA) device, an application-specific integrated circuit (ASIC), a DSP, a controller, etc.), software (e.g., instructions executable by a processor), or any combination thereof.

In conjunction with described implementations, an apparatus for processing audio signals includes means for determining an interchannel temporal mismatch value indicative of a temporal misalignment between a first audio signal and a second audio signal. The means for determining the interchannel temporal mismatch value include the interchannel temporal mismatch analyzer 124, the encoder 114, the first device 104, the system 100 of FIG. 1, the media CODEC 1108, the processors 1110, the device 1100, one or more devices configured to determine an interchannel temporal mismatch value (e.g., a processor executing instructions that are stored at a computer-readable storage device), or a combination thereof.

The apparatus also includes means for selecting an IPD mode based on at least the interchannel temporal mismatch value. For example, the means for selecting the IPD mode may include the IPD mode selector 108, the encoder 114, the first device 104, the system 100 of FIG. 1, the stereo-cues estimator 206 of FIG. 2, the media CODEC 1108, the processors 1110, the device 1100, one or more devices configured to select an IPD mode (e.g., a processor executing instructions that are stored at a computer-readable storage device), or a combination thereof.

The apparatus also includes means for determining IPD values based on the first audio signal and the second audio signal. For example, the means for determining the IPD values may include the IPD estimator 122, the encoder 114, the first device 104, the system 100 of FIG. 1, the stereo-cues estimator 206 of FIG. 2, the media CODEC 1108, the processors 1110, the device 1100, one or more devices configured to determine IPD values (e.g., a processor executing instructions that are stored at a computer-readable storage device), or a combination thereof. The IPD values 161 have a resolution corresponding to the IPD mode 156 (e.g., the selected IPD mode).

Also, in conjunction with described implementations, an apparatus for processing audio signals includes means for determining an IPD mode. For example, the means for determining the IPD mode include the IPD mode analyzer 127, the decoder 118, the second device 106, the system 100 of FIG. 1, the stereo-cues processor 712 of FIG. 7, the media CODEC 1108, the processors 1110, the device 1100, one or more devices configured to determine an IPD mode (e.g., a processor executing instructions that are stored at a computer-readable storage device), or a combination thereof.

The apparatus also includes means for extracting IPD values from a stereo-cues bitstream based on a resolution associated with the IPD mode. For example, the means for extracting the IPD values include the IPD analyzer 125, the decoder 118, the second device 106, the system 100 of FIG. 1, the stereo-cues processor 712 of FIG. 7, the media CODEC 1108, the processors 1110, the device 1100, one or more devices configured to extract IPD values (e.g., a processor executing instructions that are stored at a computer-readable storage device), or a combination thereof. The stereo-cues bitstream 162 is associated with a mid-band bitstream 166 corresponding to the first audio signal 130 and the second audio signal 132.

Also, in conjunction with described implementations, an apparatus includes means for receiving a stereo-cues bitstream associated with a mid-band bitstream corresponding to a first audio signal and a second audio signal. For example, the means for receiving may include the receiver 170 of FIG. 1, the second device 106, the system 100 of FIG. 1, the demultiplexer 702 of FIG. 7, the transceiver 1152, the media CODEC 1108, the processors 1110, the device 1100, one or more devices configured to receive a stereo-cues bitstream (e.g., a processor executing instructions that are stored at a computer-readable storage device), or a combination thereof. The stereo-cues bitstream may indicate an interchannel temporal mismatch value, IPD values, or a combination thereof.

The apparatus also includes means for determining an IPD mode based on the interchannel temporal mismatch value. For example, the means for determining the IPD mode may include the IPD mode analyzer 127, the decoder 118, the second device 106, the system 100 of FIG. 1, the stereo-cues processor 712 of FIG. 7, the media CODEC 1108, the processors 1110, the device 1100, one or more devices configured to determine an IPD mode (e.g., a processor executing instructions that are stored at a computer-readable storage device), or a combination thereof.

The apparatus further includes means for determining the IPD values based at least in part on a resolution associated with the IPD mode. For example, the means for determining IPD values may include the IPD analyzer 125, the decoder 118, the second device 106, the system 100 of FIG. 1, the stereo-cues processor 712 of FIG. 7, the media CODEC 1108, the processors 1110, the device 1100, one or more devices configured to determine IPD values (e.g., a processor executing instructions that are stored at a computer-readable storage device), or a combination thereof.

Further, in conjunction with described implementations, an apparatus includes means for determining an interchannel temporal mismatch value indicative of a temporal misalignment between a first audio signal and a second audio signal. For example, the means for determining an interchannel temporal mismatch value may include the interchannel temporal mismatch analyzer 124, the encoder 114, the first device 104, the system 100 of FIG. 1, the media CODEC 1108, the processors 1110, the device 1100, one or more devices configured to determine an interchannel temporal mismatch value (e.g., a processor executing instructions that are stored at a computer-readable storage device), or a combination thereof.

The apparatus also includes means for selecting an IPD mode based on at least the interchannel temporal mismatch value. For example, the means for selecting may include the IPD mode selector 108, the encoder 114, the first device 104, the system 100 of FIG. 1, the stereo-cues estimator 206 of FIG. 2, the media CODEC 1108, the processors 1110, the device 1100, one or more devices configured to select an IPD mode (e.g., a processor executing instructions that are stored at a computer-readable storage device), or a combination thereof.

The apparatus further includes means for determining IPD values based on the first audio signal and the second audio signal. For example, the means for determining IPD values may include the IPD estimator 122, the encoder 114, the first device 104, the system 100 of FIG. 1, the stereo-cues estimator 206 of FIG. 2, the media CODEC 1108, the processors 1110, the device 1100, one or more devices configured to determine IPD values (e.g., a processor executing instructions that are stored at a computer-readable storage device), or a combination thereof. The IPD values may have a resolution corresponding to the selected IPD mode.

Also, in conjunction with described implementations, an apparatus includes means for selecting an IPD mode associated with a first frame of a frequency-domain mid-band signal based at least in part on a coder type associated with a previous frame of the frequency-domain mid-band signal. For example, the means for selecting may include the IPD mode selector 108, the encoder 114, the first device 104, the system 100 of FIG. 1, the stereo-cues estimator 206 of FIG. 2, the media CODEC 1108, the processors 1110, the device 1100, one or more devices configured to select an IPD mode (e.g., a processor executing instructions that are stored at a computer-readable storage device), or a combination thereof.

The apparatus also includes means for determining IPD values based on a first audio signal and a second audio signal. For example, the means for determining IPD values may include the IPD estimator 122, the encoder 114, the first device 104, the system 100 of FIG. 1, the stereo-cues estimator 206 of FIG. 2, the media CODEC 1108, the processors 1110, the device 1100, one or more devices configured to determine IPD values (e.g., a processor executing instructions that are stored at a computer-readable storage device), or a combination thereof. The IPD values may have a resolution corresponding to the selected IPD mode. The IPD values may have a resolution corresponding to the selected IPD mode.

The apparatus further includes means for generating the first frame of the frequency-domain mid-band signal based on the first audio signal, the second audio signal, and the IPD values. For example, the means for generating the first frame of the frequency-domain mid-band signal may include the encoder 114, the first device 104, the system 100 of FIG. 1, the mid-band signal generator 212 of FIG. 2, the media CODEC 1108, the processors 1110, the device 1100, one or more devices configured to generate a frame of a frequency-domain mid-band signal (e.g., a processor executing instructions that are stored at a computer-readable storage device), or a combination thereof.

Further, in conjunction with described implementations, an apparatus includes means for generating an estimated mid-band signal based on a first audio signal and a second audio signal. For example, the means for generating the estimated mid-band signal may include the encoder 114, the first device 104, the system 100 of FIG. 1, the downmixer 320 of FIG. 3, the media CODEC 1108, the processors 1110, the device 1100, one or more devices configured to generate an estimated mid-band signal (e.g., a processor executing instructions that are stored at a computer-readable storage device), or a combination thereof.

The apparatus also includes means for determining a predicted coder type based on the estimated mid-band signal. For example, the means for determining a predicted coder type may include the encoder 114, the first device 104, the system 100 of FIG. 1, the pre-processor 318 of FIG. 3, the media CODEC 1108, the processors 1110, the device 1100, one or more devices configured to determine a predicted coder type (e.g., a processor executing instructions that are stored at a computer-readable storage device), or a combination thereof.

The apparatus further includes means for selecting an IPD mode based at least in part on the predicted coder type. For example, the means for selecting may include the IPD mode selector 108, the encoder 114, the first device 104, the system 100 of FIG. 1, the stereo-cues estimator 206 of FIG. 2, the media CODEC 1108, the processors 1110, the device 1100, one or more devices configured to select an IPD mode (e.g., a processor executing instructions that are stored at a computer-readable storage device), or a combination thereof.

The apparatus also includes means for determining IPD values based on the first audio signal and the second audio signal. For example, the means for determining IPD values may include the IPD estimator 122, the encoder 114, the first device 104, the system 100 of FIG. 1, the stereo-cues estimator 206 of FIG. 2, the media CODEC 1108, the processors 1110, the device 1100, one or more devices configured to determine IPD values (e.g., a processor executing instructions that are stored at a computer-readable storage device), or a combination thereof. The IPD values may have a resolution corresponding to the selected IPD mode.

Also, in conjunction with described implementations, an apparatus includes means for selecting an IPD mode associated with a first frame of a frequency-domain mid-band signal based at least in part on a core type associated with a previous frame of the frequency-domain mid-band signal. For example, the means for selecting may include the IPD mode selector 108, the encoder 114, the first device 104, the system 100 of FIG. 1, the stereo-cues estimator 206 of FIG. 2, the media CODEC 1108, the processors 1110, the device 1100, one or more devices configured to select an IPD mode (e.g., a processor executing instructions that are stored at a computer-readable storage device), or a combination thereof.

The apparatus also includes means for determining IPD values based on a first audio signal and a second audio signal. For example, the means for determining IPD values may include the IPD estimator 122, the encoder 114, the first device 104, the system 100 of FIG. 1, the stereo-cues estimator 206 of FIG. 2, the media CODEC 1108, the processors 1110, the device 1100, one or more devices configured to determine IPD values (e.g., a processor executing instructions that are stored at a computer-readable storage device), or a combination thereof. The IPD values may have a resolution corresponding to the selected IPD mode.

The apparatus further includes means for generating the first frame of the frequency-domain mid-band signal based on the first audio signal, the second audio signal, and the IPD values. For example, the means for generating the first frame of the frequency-domain mid-band signal may include the encoder 114, the first device 104, the system 100 of FIG. 1, the mid-band signal generator 212 of FIG. 2, the media CODEC 1108, the processors 1110, the device 1100, one or more devices configured to generate a frame of a frequency-domain mid-band signal (e.g., a processor executing instructions that are stored at a computer-readable storage device), or a combination thereof.

Further, in conjunction with described implementations, an apparatus includes means for generating an estimated mid-band signal based on a first audio signal and a second audio signal. For example, the means for generating the estimated mid-band signal may include the encoder 114, the first device 104, the system 100 of FIG. 1, the downmixer 320 of FIG. 3, the media CODEC 1108, the processors 1110, the device 1100, one or more devices configured to generate an estimated mid-band signal (e.g., a processor executing instructions that are stored at a computer-readable storage device), or a combination thereof.

The apparatus also includes means for determining a predicted core type based on the estimated mid-band signal. For example, the means for determining a predicted core type may include the encoder 114, the first device 104, the system 100 of FIG. 1, the pre-processor 318 of FIG. 3, the media CODEC 1108, the processors 1110, the device 1100, one or more devices configured to determine a predicted core type (e.g., a processor executing instructions that are stored at a computer-readable storage device), or a combination thereof.

The apparatus further includes means for selecting an IPD mode based on the predicted core type. For example, the means for selecting may include the IPD mode selector 108, the encoder 114, the first device 104, the system 100 of FIG. 1, the stereo-cues estimator 206 of FIG. 2, the media CODEC 1108, the processors 1110, the device 1100, one or more devices configured to select an IPD mode (e.g., a processor executing instructions that are stored at a computer-readable storage device), or a combination thereof.

The apparatus also includes means for determining IPD values based on the first audio signal and the second audio signal. For example, the means for determining IPD values may include the IPD estimator 122, the encoder 114, the first device 104, the system 100 of FIG. 1, the stereo-cues estimator 206 of FIG. 2, the media CODEC 1108, the processors 1110, the device 1100, one or more devices configured to determine IPD values (e.g., a processor executing instructions that are stored at a computer-readable storage device), or a combination thereof. The IPD values having a resolution corresponding to the selected IPD mode.

Also, in conjunction with described implementations, an apparatus includes means for determining a speech/music decision parameter based on a first audio signal, a second audio signal, or both. For example, the means for determining a speech/music decision parameter may include the speech/music classifier 129, the encoder 114, the first device 104, the system 100 of FIG. 1, the stereo-cues estimator 206 of FIG. 2, the media CODEC 1108, the processors 1110, the device 1100, one or more devices configured to determine a speech/music decision parameter (e.g., a processor executing instructions that are stored at a computer-readable storage device), or a combination thereof.

The apparatus also includes means for selecting an IPD mode based at least in part on the speech/music decision parameter. For example, the means for selecting may include the IPD mode selector 108, the encoder 114, the first device 104, the system 100 of FIG. 1, the stereo-cues estimator 206 of FIG. 2, the media CODEC 1108, the processors 1110, the device 1100, one or more devices configured to select an IPD mode (e.g., a processor executing instructions that are stored at a computer-readable storage device), or a combination thereof.

The apparatus further includes means for determining IPD values based on the first audio signal and the second audio signal. For example, the means for determining IPD values may include the IPD estimator 122, the encoder 114, the first device 104, the system 100 of FIG. 1, the stereo-cues estimator 206 of FIG. 2, the media CODEC 1108, the processors 1110, the device 1100, one or more devices configured to determine IPD values (e.g., a processor executing instructions that are stored at a computer-readable storage device), or a combination thereof. The IPD values have a resolution corresponding to the selected IPD mode.

Further, in conjunction with described implementations, an apparatus includes means for determining an IPD mode based on an IPD mode indicator. For example, the means for determining an IPD mode may include the IPD mode analyzer 127, the decoder 118, the second device 106, the system 100 of FIG. 1, the stereo-cues processor 712 of FIG. 7, the media CODEC 1108, the processors 1110, the device 1100, one or more devices configured to determine an IPD mode (e.g., a processor executing instructions that are stored at a computer-readable storage device), or a combination thereof.

The apparatus also includes means for extracting IPD values from a stereo-cues bitstream based on a resolution associated with the IPD mode, the stereo-cues bitstream associated with a mid-band bitstream corresponding to a first audio signal and a second audio signal. For example, the means for extracting IPD values may include the IPD analyzer 125, the decoder 118, the second device 106, the system 100 of FIG. 1, the stereo-cues processor 712 of FIG. 7, the media CODEC 1108, the processors 1110, the device 1100, one or more devices configured to extract IPD values (e.g., a processor executing instructions that are stored at a computer-readable storage device), or a combination thereof.

Figure 12:
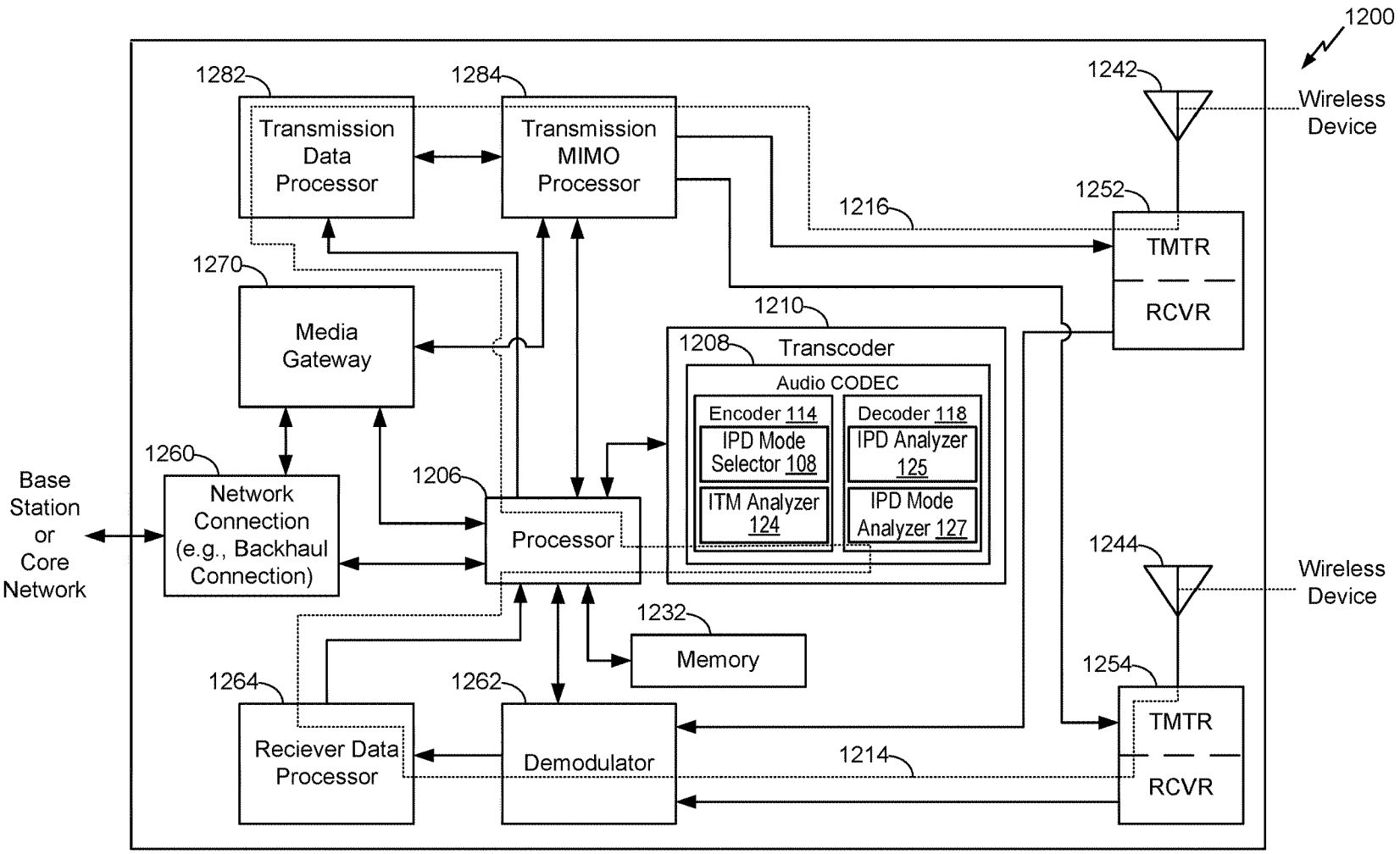
FIG. 12 is a block diagram of a base station operable to encode and decode interchannel phase differences between audio signals in accordance with the systems, devices, and methods of FIGS. 1-11.

Referring to FIG. 12, a block diagram of a particular illustrative example of a base station 1200 is depicted. In various implementations, the base station 1200 may have more components or fewer components than illustrated in FIG. 12. In an illustrative example, the base station 1200 may include the first device 104, the second device 106 of FIG. 1, or both. In an illustrative example, the base station 1200 may perform one or more operations described with reference to FIGS. 1-11.

The base station 1200 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1×, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the first device 104 or the second device 106 of FIG. 1.

Various functions may be performed by one or more components of the base station 1200 (and/or in other components not shown), such as sending and receiving messages and data (e.g., audio data). In a particular example, the base station 1200 includes a processor 1206 (e.g., a CPU). The base station 1200 may include a transcoder 1210. The transcoder 1210 may include an audio CODEC 1208. For example, the transcoder 1210 may include one or more components (e.g., circuitry) configured to perform operations of the audio CODEC 1208. As another example, the transcoder 1210 may be configured to execute one or more computer-readable instructions to perform the operations of the audio CODEC 1208. Although the audio CODEC 1208 is illustrated as a component of the transcoder 1210, in other examples one or more components of the audio CODEC 1208 may be included in the processor 1206, another processing component, or a combination thereof. For example, the decoder 118 (e.g., a vocoder decoder) may be included in a receiver data processor 1264. As another example, the encoder 114 (e.g., a vocoder encoder) may be included in a transmission data processor 1282.

The transcoder 1210 may function to transcode messages and data between two or more networks. The transcoder 1210 may be configured to convert message and audio data from a first format (e.g., a digital format) to a second format. To illustrate, the decoder 118 may decode encoded signals having a first format and the encoder 114 may encode the decoded signals into encoded signals having a second format. Additionally or alternatively, the transcoder 1210 may be configured to perform data rate adaptation. For example, the transcoder 1210 may downconvert a data rate or upconvert the data rate without changing a format the audio data. To illustrate, the transcoder 1210 may downconvert 64 kbit/s signals into 16 kbit/s signals.

The audio CODEC 1208 may include the encoder 114 and the decoder 118. The encoder 114 may include the IPD mode selector 108, the ITM analyzer 124, or both. The decoder 118 may include the IPD analyzer 125, the IPD mode analyzer 127, or both.

The base station 1200 may include a memory 1232. The memory 1232, such as a computer-readable storage device, may include instructions. The instructions may include one or more instructions that are executable by the processor 1206, the transcoder 1210, or a combination thereof, to perform one or more operations described with reference to FIGS. 1-11. The base station 1200 may include multiple transmitters and receivers (e.g., transceivers), such as a first transceiver 1252 and a second transceiver 1254, coupled to an array of antennas. The array of antennas may include a first antenna 1242 and a second antenna 1244. The array of antennas may be configured to wirelessly communicate with one or more wireless devices, such as the first device 104 or the second device 106 of FIG. 1. For example, the second antenna 1244 may receive a data stream 1214 (e.g., a bit stream) from a wireless device. The data stream 1214 may include messages, data (e.g., encoded speech data), or a combination thereof.

The base station 1200 may include a network connection 1260, such as backhaul connection. The network connection 1260 may be configured to communicate with a core network or one or more base stations of the wireless communication network. For example, the base station 1200 may receive a second data stream (e.g., messages or audio data) from a core network via the network connection 1260. The base station 1200 may process the second data stream to generate messages or audio data and provide the messages or the audio data to one or more wireless device via one or more antennas of the array of antennas or to another base station via the network connection 1260. In a particular implementation, the network connection 1260 includes or corresponds to a wide area network (WAN) connection, as an illustrative, non-limiting example. In a particular implementation, the core network includes or corresponds to a Public Switched Telephone Network (PSTN), a packet backbone network, or both.

The base station 1200 may include a media gateway 1270 that is coupled to the network connection 1260 and the processor 1206. The media gateway 1270 may be configured to convert between media streams of different telecommunications technologies. For example, the media gateway 1270 may convert between different transmission protocols, different coding schemes, or both. To illustrate, the media gateway 1270 may convert from PCM signals to Real-Time Transport Protocol (RTP) signals, as an illustrative, non-limiting example. The media gateway 1270 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 1270 may include a transcoder, such as the transcoder 610, and may be configured to transcode data when codecs are incompatible. For example, the media gateway 1270 may transcode between an Adaptive Multi-Rate (AMR) codec and a G.711 codec, as an illustrative, non-limiting example. The media gateway 1270 may include a router and a plurality of physical interfaces. In a particular implementation, the media gateway 1270 includes a controller (not shown). In a particular implementation, the media gateway controller is external to the media gateway 1270, external to the base station 1200, or both. The media gateway controller may control and coordinate operations of multiple media gateways. The media gateway 1270 may receive control signals from the media gateway controller and may function to bridge between different transmission technologies and may add service to end-user capabilities and connections.

The base station 1200 may include a demodulator 1262 that is coupled to the transceivers 1252, 1254, the receiver data processor 1264, and the processor 1206, and the receiver data processor 1264 may be coupled to the processor 1206. The demodulator 1262 may be configured to demodulate modulated signals received from the transceivers 1252, 1254 and to provide demodulated data to the receiver data processor 1264. The receiver data processor 1264 may be configured to extract a message or audio data from the demodulated data and send the message or the audio data to the processor 1206.

The base station 1200 may include a transmission data processor 1282 and a transmission multiple input-multiple output (MIMO) processor 1284. The transmission data processor 1282 may be coupled to the processor 1206 and the transmission MIMO processor 1284. The transmission MIMO processor 1284 may be coupled to the transceivers 1252, 1254 and the processor 1206. In a particular implementation, the transmission MIMO processor 1284 is coupled to the media gateway 1270. The transmission data processor 1282 may be configured to receive the messages or the audio data from the processor 1206 and to code the messages or the audio data based on a coding scheme, such as CDMA or orthogonal frequency-division multiplexing (OFDM), as an illustrative, non-limiting examples. The transmission data processor 1282 may provide the coded data to the transmission MIMO processor 1284.

The coded data may be multiplexed with other data, such as pilot data, using CDMA or OFDM techniques to generate multiplexed data. The multiplexed data may then be modulated (i.e., symbol mapped) by the transmission data processor 1282 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data is modulated using different modulation schemes. The data rate, coding, and modulation for each data stream may be determined by instructions executed by processor 1206.

The transmission MIMO processor 1284 may be configured to receive the modulation symbols from the transmission data processor 1282 and may further process the modulation symbols and may perform beamforming on the data. For example, the transmission MIMO processor 1284 may apply beamforming weights to the modulation symbols. The beamforming weights may correspond to one or more antennas of the array of antennas from which the modulation symbols are transmitted.

During operation, the second antenna 1244 of the base station 1200 may receive a data stream 1214. The second transceiver 1254 may receive the data stream 1214 from the second antenna 1244 and may provide the data stream 1214 to the demodulator 1262. The demodulator 1262 may demodulate modulated signals of the data stream 1214 and provide demodulated data to the receiver data processor 1264. The receiver data processor 1264 may extract audio data from the demodulated data and provide the extracted audio data to the processor 1206.

The processor 1206 may provide the audio data to the transcoder 1210 for transcoding. The decoder 118 of the transcoder 1210 may decode the audio data from a first format into decoded audio data and the encoder 114 may encode the decoded audio data into a second format. In a particular implementation, the encoder 114 encodes the audio data using a higher data rate (e.g., upconvert) or a lower data rate (e.g., downconvert) than received from the wireless device. In a particular implementation the audio data is not transcoded. Although transcoding (e.g., decoding and encoding) is illustrated as being performed by a transcoder 1210, the transcoding operations (e.g., decoding and encoding) may be performed by multiple components of the base station 1200. For example, decoding may be performed by the receiver data processor 1264 and encoding may be performed by the transmission data processor 1282. In a particular implementation, the processor 1206 provides the audio data to the media gateway 1270 for conversion to another transmission protocol, coding scheme, or both. The media gateway 1270 may provide the converted data to another base station or core network via the network connection 1260.

The decoder 118 and the encoder 114 may determine, on a frame-by-frame basis, the IPD mode 156. The decoder 118 and the encoder 114 may determine the IPD values 161 having the resolution 165 corresponding to the IPD mode 156. Encoded audio data generated at the encoder 114, such as transcoded data, may be provided to the transmission data processor 1282 or the network connection 1260 via the processor 1206.

The transcoded audio data from the transcoder 1210 may be provided to the transmission data processor 1282 for coding according to a modulation scheme, such as OFDM, to generate the modulation symbols. The transmission data processor 1282 may provide the modulation symbols to the transmission MIMO processor 1284 for further processing and beamforming. The transmission MIMO processor 1284 may apply beamforming weights and may provide the modulation symbols to one or more antennas of the array of antennas, such as the first antenna 1242 via the first transceiver 1252. Thus, the base station 1200 may provide a transcoded data stream 1216, that corresponds to the data stream 1214 received from the wireless device, to another wireless device. The transcoded data stream 1216 may have a different encoding format, data rate, or both, than the data stream 1214. In a particular implementation, the transcoded data stream 1216 is provided to the network connection 1260 for transmission to another base station or a core network.

The base station 1200 may therefore include a computer-readable storage device (e.g., the memory 1232) storing instructions that, when executed by a processor (e.g., the processor 1206 or the transcoder 1210), cause the processor to perform operations including determining an interchannel phase difference (IPD) mode. The operations also include determining IPD values having a resolution corresponding to the IPD mode.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as RAM, MRAM, STT-MRAM, flash memory, ROM, PROM, EPROM, EEPROM, registers, hard disk, a removable disk, or a CD-ROM. An exemplary memory device is coupled to the processor such that the processor can read information from, and write information to, the memory device. In the alternative, the memory device may be integral to the processor. The processor and the storage medium may reside in an ASIC. The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A device for processing audio signals comprising:

an interchannel temporal mismatch analyzer configured to determine an interchannel temporal mismatch value indicative of a temporal misalignment between a first audio signal and a second audio signal;

an interchannel phase difference (IPD) mode selector configured to select an IPD mode based on a comparison of the interchannel temporal mismatch value with a first threshold and a comparison of a strength value with a second threshold, the strength value associated with the interchannel temporal mismatch value; and an IPD estimator configured to determine IPD values based on the first audio signal and the second audio signal, the IPD values having a resolution corresponding to the selected IPD mode.

2. The device of claim 1, wherein the interchannel temporal mismatch analyzer is further configured to generate a first aligned audio signal and a second aligned audio signal by adjusting at least one of the first audio signal or the second audio signal based on the interchannel temporal mismatch value, wherein the first aligned audio signal is temporally aligned with the second aligned audio signal, and wherein the IPD values are based on the first aligned audio signal and the second aligned audio signal.

3. The device of claim 2, wherein the first audio signal or the second audio signal corresponds to a temporally lagging channel, and wherein adjusting at least one of the first audio signal or the second audio signal includes non-causally shifting the temporally lagging channel based on the interchannel temporal mismatch value.

4. The device of claim 1, wherein the IPD mode selector is further configured to, in response to a determination that the interchannel temporal mismatch value is less than the first threshold and the strength value is less than the second threshold, select a first IPD mode as the IPD mode, the first IPD mode corresponding to a first resolution.

5. The device of claim 4, wherein a second resolution is associated with a second IPD mode, and wherein the first resolution corresponds to a first quantization resolution that is higher than a second quantization resolution corresponding to the second resolution.

6. The device of claim 1, further comprising:

a mid-band signal generator configured to generate a frequency-domain mid-band signal based on the first audio signal, an adjusted second audio signal, and the IPD values, wherein the interchannel temporal mismatch analyzer is configured to generate the adjusted second audio signal by shifting the second audio signal based on the interchannel temporal mismatch value;

a mid-band encoder configured to generate a mid-band bitstream based on the frequency-domain mid-band signal; and a stereo-cues bitstream generator configured to generate a stereo-cues bitstream indicating the IPD values.

7. The device of claim 6, further comprising:

a side-band signal generator configured to generate a frequency-domain side-band signal based on the first audio signal, the adjusted second audio signal, and the IPD values; and a side-band encoder configured to generate a side-band bitstream based on the frequency-domain side-band signal, the frequency-domain mid-band signal, and the IPD values.

8. The device of claim 7, further comprising a transmitter configured to transmit a bitstream that includes the mid-band bitstream, the stereo-cues bitstream, the side-band bitstream, or a combination thereof.

9. The device of claim 1, wherein the IPD mode is selected from a first IPD mode or a second IPD mode, wherein the first IPD mode corresponds to a first resolution, wherein the second IPD mode corresponds to a second resolution, wherein the first IPD mode corresponds to the IPD values being based on a first audio signal and a second audio signal, and wherein the second IPD mode corresponds to the IPD values set to zero.

10. The device of claim 1, wherein the resolution corresponds to at least one of a range of phase values, a count of the IPD values, a first number of bits to represent the IPD values, a second number of bits to represent absolute values of the IPD values in bands, or a third number of bits to represent an amount of temporal variance of the IPD values across frames.

11. The device of claim 1, wherein the IPD mode selector is configured to select the IPD mode based on a coder type, a core sample rate, or both.

12. The device of claim 1, further comprising:

an antenna; and a transmitter coupled to the antenna and configured to transmit a stereo-cues bitstream indicating the IPD mode and the IPD values.

13. A device for processing audio signals comprising:

an interchannel phase difference (IPD) mode analyzer configured to determine an IPD mode, the IPD mode selected based on a comparison of an interchannel temporal mismatch value with a first threshold and a comparison of a strength value with a second threshold, wherein the interchannel temporal mismatch value is indicative of a temporal misalignment between a first audio signal and a second audio signal, and wherein the strength value is associated with the interchannel temporal mismatch value; and an IPD analyzer configured to extract IPD values from a stereo-cues bitstream based on a resolution associated with the IPD mode, the stereo-cues bitstream associated with a mid-band bitstream corresponding to the first audio signal and the second audio signal.

14. The device of claim 13, further comprising:

a mid-band decoder configured to generate a mid-band signal based on the mid-band bitstream;

an upmixer configured to generate a first frequency-domain output signal and a second frequency-domain output signal based at least in part on the mid-band signal; and a stereo-cues processor configured to:

generate a first phase rotated frequency-domain output signal by phase rotating the first frequency-domain output signal based on the IPD values; and generate a second phase rotated frequency-domain output signal by phase rotating the second frequency-domain output signal based on the IPD values.

15. The device of claim 14, further comprising:

a temporal processor configured to generate a first adjusted frequency-domain output signal by shifting the first phase rotated frequency-domain output signal based on an interchannel temporal mismatch value; and a transformer configured to generate a first time-domain output signal by applying a first transform on the first adjusted frequency-domain output signal and a second time-domain output signal by applying a second transform on the second phase rotated frequency-domain output signal, wherein the first time-domain output signal corresponds to a first channel of a stereo signal and the second time-domain output signal corresponds to a second channel of the stereo signal.

16. The device of claim 14, further comprising:

a transformer configured to generate a first time-domain output signal by applying a first transform on the first phase rotated frequency-domain output signal and a second time-domain output signal by applying a second transform on the second phase rotated frequency-domain output signal; and a temporal processor configured to generate a first shifted time-domain output signal by temporally shifting the first time-domain output signal based on an interchannel temporal mismatch value, wherein the first shifted time-domain output signal corresponds to a first channel of a stereo signal and the second time-domain output signal corresponds to a second channel of the stereo signal.

17. The device of claim 16, wherein the temporal shifting of the first time-domain output signal corresponds to a causal shift operation.

18. The device of claim 14, further comprising a receiver configured to receive the stereo-cues bitstream, the stereo-cues bitstream indicating the interchannel temporal mismatch value.

19. The device of claim 14, wherein the resolution corresponds to one or more of absolute values of the IPD values in bands or an amount of temporal variance of the IPD values across frames.

20. The device of claim 14, wherein the stereo-cues bitstream is received from an encoder and is associated with encoding of a first audio channel that is shifted in the frequency domain.

21. The device of claim 14, wherein the stereo-cues bitstream is received from an encoder and is associated with encoding of a non-causally shifted first audio channel.

22. The device of claim 14, wherein the stereo-cues bitstream is received from an encoder and is associated with encoding of a phase rotated first audio channel.

23. The device of claim 14, wherein the IPD analyzer is configured to, in response to a determination that the IPD mode includes a first IPD mode corresponding to a first resolution, extract the IPD values from the stereo-cues bitstream.

24. The device of claim 14, wherein the IPD analyzer is configured to, in response to a determination that the IPD mode includes a second IPD mode corresponding to a second resolution, set the IPD values to zero.

25. A method of processing audio signals comprising:

determining, at a device, an interchannel temporal mismatch value indicative of a temporal misalignment between a first audio signal and a second audio signal;

selecting, at the device, an interchannel phase difference (IPD) mode based on a comparison of the interchannel temporal mismatch value with a first threshold and a comparison of a strength value with a second threshold, the strength value associated with the interchannel temporal mismatch value; and determining, at the device, IPD values based on the first audio signal and the second audio signal, the IPD values having a resolution corresponding to the selected IPD mode.

26. The method of claim 25, further comprising, in response to determining that the interchannel temporal mismatch value satisfies the first threshold and that the strength value satisfies the second threshold, select a first IPD mode as the IPD mode, the first IPD mode corresponding to a first resolution.

27. The method of claim 25, further comprising, in response to determining that the interchannel temporal mismatch value fails to satisfy the first threshold or that the strength value fails to satisfy the second threshold, select a second IPD mode as the IPD mode, the second IPD mode corresponding to a second resolution.

28. The method of claim 27, wherein a first resolution associated with a first IPD mode corresponds to a first number of bits that is higher than a second number of bits corresponding to the second resolution.

29. An apparatus for processing audio signals comprising:

means for determining an interchannel temporal mismatch value indicative of a temporal misalignment between a first audio signal and a second audio signal;

means for selecting an interchannel phase difference (IPD) mode based on a comparison of the interchannel temporal mismatch value with a first threshold and a comparison of a strength value with a second threshold, the strength value associated with the interchannel temporal mismatch value; and means for determining IPD values based on the first audio signal and the second audio signal, the IPD values, the IPD values having a resolution corresponding to the selected IPD mode.

30. The apparatus of claim 29, wherein the means for determining the interchannel temporal mismatch value, the means for selecting the IPD mode, and the means for determining the IPD values are integrated into a mobile device or a base station.

31. A computer-readable storage device storing instructions that, when executed by a processor, cause the processor to perform operations comprising:

determining an interchannel temporal mismatch value indicative of a temporal misalignment between a first audio signal and a second audio signal;

selecting an interchannel phase difference (IPD) mode based on a comparison of the interchannel temporal mismatch value with a first threshold and a comparison of a strength value with a second threshold, the strength value associated with the interchannel temporal mismatch value; and determining IPD values based on the first audio signal or the second audio signal, the IPD values having a resolution corresponding to the selected IPD mode.

* * * * *